US005108877A

United States Patent [19]

Asami

[11] Patent Number: 5,108,877

[45] Date of Patent: Apr. 28, 1992

[54] METHOD FOR FORMING COLOR IMAGE

[75] Inventor: Masahiro Asami, Minami Ashigara, Japan

[73] Assignee: Fuji Photo Film Co., Ltd., Kanagawa, Japan

[21] Appl. No.: 682,893

[22] Filed: Apr. 9, 1991

Related U.S. Application Data

[63] Continuation of Ser. No. 416,749, Oct. 3, 1989, abandoned.

[30] Foreign Application Priority Data

Oct. 3, 1988 [JP] Japan ..... 63-249247

[51] Int. Cl.[5] ..... G03C 7/26; G03C 7/30

[52] U.S. Cl. ..... 430/377; 430/372; 430/382; 430/550; 430/567

[58] Field of Search ..... 430/372, 376, 377, 382, 430/550, 567

[56] References Cited

U.S. PATENT DOCUMENTS

| | | | |
|---|---|---|---|
| 4,564,591 | 1/1986 | Tanaki et al. | 430/567 |
| 4,565,774 | 1/1986 | Kajiwata et al. | 430/382 |
| 4,590,155 | 5/1986 | Klötzer | 430/567 |
| 4,693,965 | 9/1987 | Iwama et al. | 430/569 |
| 4,774,168 | 9/1988 | Ogawa et al. | 430/383 |
| 4,837,140 | 6/1989 | Ikeda et al. | 430/550 |
| 4,851,326 | 7/1989 | Ishiwaka et al. | 430/380 |
| 4,880,728 | 11/1989 | Ishikawa et al. | 430/380 |
| 4,892,803 | 1/1990 | Waki et al. | 430/380 |
| 4,912,026 | 3/1990 | Miyoshi et al. | 430/567 |
| 5,001,042 | 3/1991 | Hasebe | 430/377 |
| 5,004,675 | 4/1991 | Yoneyama et al. | 430/382 |
| 5,051,342 | 9/1991 | Shiba et al. | 430/376 |

OTHER PUBLICATIONS

Derwent Abst. of Japanese 63/106655, May 1988.

*Primary Examiner*—Richard L. Schilling

*Attorney, Agent, or Firm*—Sughrue, Mion, Zinn, Macpeak & Seas

[57] ABSTRACT

A method for forming a color image is described, using an image-wise exposed silver halide color photographic material comprising, a reflective support having thereon at least one silver halide emulsion layer containing at least one coupler that forms a dye by means of a coupling reaction with the oxidation product of an aromatic primary amine developing agent and silver halide grains comprising silver bromochloride containing not less than 90 mol % silver chloride and substantially not containing silver iodide, said silver halide grains having a localized silver bromide phase having a silver bromide content of not less than 20 mol % and being chemically sensitized at the surface thereof to provide substantially surface latent image type grains, comprising developing the light-sensitive material with a color developing solution containing from $3.5\times10^{-2}$ to $1.5\times10^{-1}$ mol/l of chloride ions and from $3.0\times10^{-5}$ to $1.0\times10^{-3}$ mol/l of bromide ions.

19 Claims, No Drawings

METHOD FOR FORMING COLOR IMAGE

This is a continuation of application No. 07/416,749 filed Oct. 3, 1989, now abandoned.

FIELD OF THE INVENTION

The present invention concerns a method for forming a color image using a silver halide color photographic light-sensitive material, and, more specifically, relates to a novel method for forming a color image suitable for rapid and stable production of high quality color photographic prints.

BACKGROUND OF THE INVENTION

For the processing of color photographic light-sensitive materials, higher efficiency and higher productivity have been increasingly demanded in recent years. Progress has been particularly remarkable for the production of color photographic prints, in which the reduction of print-processing time has been strongly desired to allow for a short delivery period. The development of color laboratories for producing color prints, including centralized large-scale laboratories of high production efficiency and small scale laboratories suitable for providing finished color prints in a short period of time has progressed simultaneously. While the processing techniques and apparatus of the two types of laboratories are dissimilar, the demand for the shortening of the print processing time is applicable to both. Furthermore, there is also a strong demand for reducing the replenishing amount of processing solution in both types of processes to reduce processing costs and to reduce the amount of liquid waste.

Finishing a color print comprises exposure and color development. Use of a highly sensitive light-sensitive material leads to the shortening of exposure time. On the other hand, to shorten the processing time for color development, the light-sensitive material and processing method cannot be considered alone; each must necessarily be considered in combination. However, there are few satisfactory techniques that provide the combination of a high sensitivity light-sensitive material, and/or a processing solution and processing method capable of rapid processing, while maintaining high sensitivity. In addition, practical techniques which reduce the replenishing amount of the processing solution are uncommon.

Accordingly, it is highly desirable to develop a technique attaining the above-described objective in view of improvement of productivity and efficiency in color laboratories, irrespective of the scale or form, etc. of the color print laboratory.

As a method of attaining the above-described objective, a method has been proposed of processing a color photographic light-sensitive material containing a silver chloride emulsion instead of silver bromochloride emulsion having a high silver bromide content, generally used, as a light-sensitive material for color prints (hereinafter simply referred to as color print paper). For example, International Patent Application W087-04534 discloses a method of rapidly processing a color photographic light-sensitive material comprising a silver chloride emulsion having a high silver chloride content with a color developer not substantially containing sulfite ions and benzyl alcohol. However, when a practical test was conducted by preparing a light-sensitive material in accordance with the disclosed method, including preparing a processing solution as described in the patent literature, and using a conventional automatic developing machine for color print paper, a number of severe significant problems arose.

At first, it was found that the method described in the patent literature results in substantial reciprocity law failure, and the sensitivity or gradation fluctuates remarkably depending on the luminance of exposure such that the method is difficult to use in practice.

Secondly, it was found that the method described in the patent literature results in substantial fogging of the finished prints when stored for a long period of time, which also causes problems in practical use.

Thirdly, it was found that the method described in the patent literature tends to sensitize the portions of the color print material under applied pressure during development. In particular, a stripe-like density increase is seen corresponding to the handling and transport of the color print material in an automatic developing machine, which is a serious drawback for practical use.

Fourthly, it was found that the method described in the patent literature results in a substantial fluctuation in the photographic properties. In particular, a change of the color density in high density portions results upon conducting continuous processing for a long period of time, which also causes problems in practical use.

In addition to the above-described patent literature, JP-A-61-70552 (the term "JP-A" as used herein means an "unexamined published Japanese patent application") proposes a method for reducing the replenishing amount using a high silver chloride color photographic light-sensitive material by limiting the replenishing amount such that the developing bath does not overflow. Further, JP-A-63-106655 discloses a method of processing a high silver chloride content color photographic light-sensitive material with a color developer containing a hydroxylamine compound and chloride ion at a concentration higher than a predetermined level, to stabilize the processing.

However, the drawbacks as described above are not overcome, even in accordance with these methods.

SUMMARY OF THE INVENTION

An objective of the present invention is to provide a method for forming a color image having a high contrast using a highly sensitive color print material and rapid processing to thereby obtain high quality, stable color prints using a reduced replenishing amount for the developing solution (i.e. developer).

A second objective of the present invention is to provide a method for forming a color image having a high contrast without the occurrence of sensitized handling stripes in continuous processing using a reduced replenishing amount for the developer and resulting in reduced fluctuation in photographic properties, using a light-sensitive material with less fogging in storage for a long period of time and which is highly sensitive over a wide illumination range suitable for increasing the speed of the printing step.

The foregoing objectives of the present invention are attained by a method for forming a color image using an imagewise exposed silver halide color photographic material comprising a reflective support having thereon at least one silver halide emulsion layer containing at least one coupler that forms a dye by means of a coupling reaction with the oxidation product of an aromatic primary amine developing agent and silver halide grains comprising silver bromochloride containing not less than 90 mol% silver chloride and substantially not containing silver iodide, said silver halide grains having a localized silver bromide phase having a silver bromide content of not less than 20 mol% and being chemically sensitized at the surface thereof to provide substantially surface latent image type grains comprising developing the light-sensitive material with a color developing solution containing from $3.5\times10^{-2}$ to $1.5\times10^{-1}$ mol/l of chloride ions and from $3.0\times10^{-2}$ to $1.0\times10^{-3}$ mol/l of bromide ions.

DETAILED DESCRIPTION OF THE INVENTION

The silver halide grains for use in the method of the present invention are preferably prepared in the presence of an iridium compound such that the localized silver bromide phase is deposited together with at least 50% of the total iridium added in the preparation of the silver halide grains.

The halogen composition of the silver halide grains according to the method of the present invention is silver bromochloride substantially not containing silver iodide, wherein not less than 90 mol% (preferably from 90 to 99.9 mol%) of the entire silver halide constituting the silver halide grains is silver chloride. "Silver bromochloride substantially not containing silver iodide" as used herein means a silver bromochloride which may have a silver iodide content of not greater than 1.0 mol% as long as the effect of the present invention is not injured. Accordingly, the silver iodide content is preferably not greater than 0.2 mol% and more preferably 0 mol%. The preferred halogen composition of the silver halide grains is silver bromochloride substantially not containing silver iodide wherein not less than 95 mol% of the entire silver halide constituting the silver halide grains is silver chloride.

The silver halide grains of the present invention have at least a 20 mol% localized silver bromide phase. The localized phase having a high silver bromide content may be optionally disposed depending on the purpose. For example, the localized phase may be present at the inside, the surface or sub-surface of the silver halide grains, or the localized phase may be disposed divisionally at the inside and the surface or the sub-surface. Furthermore, the localized phase may constitute a layered structure surrounding the silver halide grains or may have a discrete structure at the inside or the surface. A preferred embodiment for the disposition of the localized phase having a high silver bromide content of not less than 20 mol% is such that the localized phase is epitaxially grown at the surface of the silver halide grains.

While the silver bromide content of the localized phase is necessarily not less than 20 mol%, an excessively high silver bromide content may cause desensitization upon application of pressure to the light-sensitive material, or markedly change the sensitivity and gradation with fluctuations in the composition of the processing solution, etc. The silver bromide content of the localized phase is preferably within the range of from 20 to 60 mol% and, most preferably, within the range of from 30 to 50 mol%, in view of the above. The silver bromide content of the localized phase can be analyzed by using, for example, the X-ray diffraction method as described, for example, in *Lecture on New Experimental Chemistry* 6, *Structural Analysis,* edited by Chemical Society of Japan, and published by the Maruzen Co. or the XPS method as described, for example, in *Surface Analysis, Application of IMA, Auger Electron-Photoelectron Spectroscopy,* (published by the Kodansha, Co.). The localized phase constitutes preferably from 0.1 to 20%, and more preferably, from 0.5 to 7% of the total amount of silver contained in the silver halide grains of the present invention.

The boundary between the localized phase of high silver bromide content and an adjacent phase may be a distinct phase boundary or comprise a short transition region in which the halogen composition changes gradually.

The localized phase having a high silver bromide content may be formed by various methods as described below.

For example, a localized phase may be formed by reacting a soluble silver salt and a soluble halogen salt by a single jet method or a double jet method. Further, the localized phase may also be formed by the conversion method converting a previously formed silver halide into a silver halide having a lower solubility product. Alternatively, the localized phase may also be formed by adding fine silver bromide grains to thereby re-crystallize the silver bromide onto the surface of silver chloride grains.

A useful method of preparing silver halide grains is described in detail in European Patent 273430.

One of preferred embodiments of the present invention is a method of forming a color image, wherein the silver halide grains are formed in the presence of an iridium compound, and the localized silver bromide phase is deposited together with at least 50% of the total iridium added in the preparation of the silver halide grains.

A water soluble iridium compound can be used in the present invention including, for example, iridium(III) halide, iridium (IV) halide or iridium complex salts having halogen, amine or oxalite as a ligand, such as hexachloro iridium(III) or (IV) complex salt, hexaamine iridium(III) or (IV) complex salt, and trioxalite iridium(III) or (IV) complex salt. In the present invention, combinations of iridium compounds having a (III) and (IV) atomic valency can also be used. The iridium compound for use in the present invention is dissolved in water or an appropriate solvent. For stabilizing the solution of the iridium compound, a conventional method may be used, namely, a method of adding an aqueous solution of a hydrogen halide (for example, HCl, HBr or HF) or an alkali halide (for example, KCl, NaCl, KBr, NaBr). Instead of using the water-soluble iridium compound, it is also possible to add and dissolve different kinds of silver halide grains previously doped with iridium upon preparing silver halide grains according to the method of the present invention.

The total amount of the iridium compound added in preparing the silver halide grains according to the method of the present invention is generally from $5\times10^{-9}$ to $1\times10^{-4}$ mol, preferably from $1\times10^{-8}$ to $1\times10^{-5}$ mol and, most preferably, from $5\times10^{-8}$ to $5\times10^{-6}$ mol per mol of the finally formed silver halide grains.

In the embodiment of the present invention described above, the localized phase is deposited together with at least 50% of the total iridium added upon preparing the silver halide grains. Deposition of the localized phase together with the iridium as used herein means that the iridium compound is supplied at the same time, immediately before or immediately after the supply of silver or halide for forming the localized phase. The iridium compound may be present upon preparing a phase other than the localized phase of high silver bromide content, but the localized phase is necessarily deposited together with at least 50% of the total iridium added. It is preferred that the localized phase be deposited together with at least 80% of the total iridium added and, most preferably that the localized phase be deposited together with total iridium added.

It is necessary that the silver halide grains according to the present invention be chemically sensitized at the surface thereof to such an extent as the silver halide grains are substantially a surface latent image type. The chemical sensitization, for use in the present invention includes, for example, sulfur sensitization using a sulfur-containing compound capable of reacting with active gelatin or silver (for example, thiosulfate, thiourea, mercapto compounds and rhodanines); reduction sensitization using reducing substance (for example, stannous salt, amine, hydrazine derivative, formamidine sulfinic acid and silane compound); and noble metal sensitization using a metal compound (for example, gold complex salt, as well as complex salt of metals belonging to the group VIII of the periodic table such as Pt, Ir, Pd, Rh and Fe), either alone or in combination. Among the chemical sensitization methods, sulfur sensitization is preferably used.

The light-sensitive material comprising the silver halide grains prepared as described above are rapidly processed, have high sensitivity and hard tone, exhibit less reciprocity law failure, and furthermore, have high latent image stability and excellent handlability. These properties are not associated with conventional silver chloride emulsions, and accordingly constitute an unexpected result.

The silver halide grains for use according to the method of the present invention may have a (100) face, a (111) face, or have both such faces, at the outer surface, or further constitute an orientation or higher dimension. The configuration of the silver halide grains according to the method of the present invention may have a regular crystal form such as cubic, octahedron, dodecahedron, tetradecahedron or an irregular crystal form such as a spherical form. In addition, the silver halide grains of the present invention may comprise tabular grains such as an emulsion containing tabular grains having a length/thickness ratio of preferably not less than 5, and particularly not less than 8 constituting more than 50% of the total projection area of the grains.

The size of the silver halide grains according to the method of the present invention are within the range generally employed and the average grain size is preferably from 0.1 μm to 1.5 μm. The grain size distribution may be polydispersed or monodispersed, monodispersed grains being preferred. For monodispersed grains, the ratio (s/d) of the statistical standard deviation (s) and the average grain size (d) is preferably not greater than 0.2, and more preferably not greater than 0.15.

The total amount of the coated silver in the silver halide color photographic material according to the method of the present invention is preferably not greater than 0.80 g/m$^2$ and is most preferably from 0.25 to 0.75 g/m$^2$. If the total coating amount of the silver is greater than 0.80 g/m$^2$, the rapid processing property and photographic properties associated with continuous processing fluctuate greatly.

For physically ripening the silver halide grains of the present invention, cadmium salt, zinc slat, thallium salt, lead salt, rhodium salt or complex salt thereof, iron salt or iron complex salt may be used alone or in combination thereof.

In the photographic emulsion for use in the present invention, various compounds can be added to prevent fogging during storing or photographic processing or to stabilize photographic performance. Specifically, various compounds known as antifoggants or stabilizers can be added, such as azoles, e.g., benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (in particular, 1-phenyl-5-mercaptotetrazole), mercaptopyrimidines and mercaptotriazines; thioketo compounds, e.g., oxazolinethione, azaindenes, e.g., triazaindenes, tetraazaindenes (in particular, 4-hydroxy substituted (1,3,3a,7) tetraazaindene) and pentaazaindenes; benzene thiosulfonic acid, benzene sulfinic acid and benzene sulfonic acid amide.

Among them, mercaptothiazoles represented by the following formulae (I), (II) or (III) are preferably added to the coating solution of the silver halide emulsion in an amount of from $1\times10^{-5}$ to $5\times10^{-2}$ mol and, particularly, from $1\times10^{-4}$ to $1\times10^{-2}$ mol per mol of silver halide.

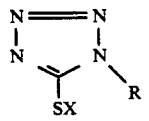

(I)

wherein R represents an alkyl group, alkenyl group or aryl group. Preferably R represents a group having 1 to 30 carbon atoms (particularly 6 to 25 carbon atoms). X represents a hydrogen atom, an alkali metal atom, ammonium group or a precursor. The alkali metal atom is, for example, sodium or potassium atom and the ammonium group is, for example, tetramethyl ammonium, or trimethylbenzyl ammonium. The precursor is a group in which X becomes a hydrogen atom or an alkali metal, under alkaline conditions and represents, for example, acetyl group, cyanoethyl group or methane sulfonyl ethyl group.

Among R described above, the alkyl group and the alkenyl group may be substituted or unsubstituted and also includes cycloaliphatic group. Substituents for the substituted alkyl group include halogen atom, nitro group, cyano group, hydroxyl group, alkoxy group, aryl group, acylamino group, alkoxycarbonylamino group, ureido group, amino group, heterocyclic group, acyl group, sulfamoyl group, sulfonamide group, thioureido group, carbamoyl group, alkylthio group, arylthio group, heterocyclicthio group and furthermore, carboxylic acid group, sulfonic acid group or the salts thereof.

Each of the ureido group, thioureido group, sulfamoyl group, carbamoyl group and amino group may include unsubstituted, n-alkyl substituted or n-aryl substituted group. An example of the aryl group is a phenyl or substituted phenyl group, wherein the substituent may include an alkyl group or the substituents for the alkyl group set forth above.

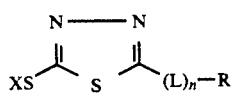

(II)

wherein L represents a bivalent linkage group, R represents a hydrogen atom, an alkyl group, alkenyl group or aryl group. The alkyl group, alkenyl group and aryl group for R have preferably 1 to 30 carbon atoms and more preferably 1 to 20 carbon atoms. The alkyl group and the alkenyl group for R and X have the same meaning as in the formula (I).

Examples of the bivalent linkage group represented by L include

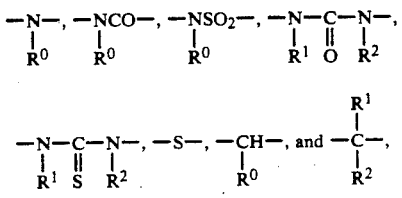

or combination thereof.

n represents 0 or 1, and $R^0$, $R^1$ and $R^2$ each represent a hydrogen atom, alkyl group or aralkyl group. The alkyl group or aralkyl group for $R^0$, $R^1$ and $R^2$ preferably have 1 to 20 carbon atoms.

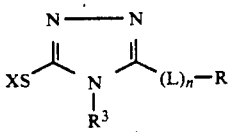

(III)

wherein R and X have the same meaning as in the formula (I) and L and n have the same meaning as in formula (II). $R^3$ has the same meaning as R, and each may be the same or different.

Nonlimiting examples of the compounds represented by formulae (I), (II) and (III) are set forth below.

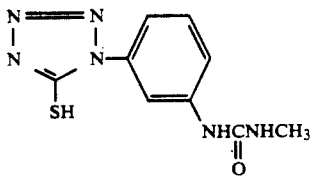

(I-1)

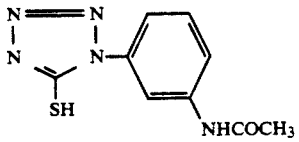

(I-2)

-continued

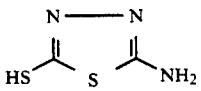

(II-1)

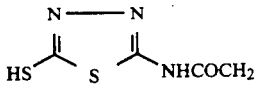

(II-2)

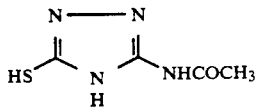

(III-1)

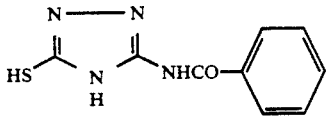

(III-2)

The color photographic light-sensitive material of the present invention generally comprises a support having thereon at least one layer selected from the group consisting of a blue-sensitive silver halide emulsion layer, a green-sensitive silver halide emulsion layer and a red-sensitive silver halide emulsion layer wherein each of the layers may comprise plural layers having the same spectral sensitivity but different speeds. Generally, the layers are coated in the above-described order on the support, but the order may be varied. Color may be reproduced in a subtractive color process by incorporating, into each of light sensitive emulsion layers, a silver halide emulsion sensitive to a specific wavelength region and a dye having a relation of complementary to a sensible light, i.e., a color coupler that forms yellow in the blue sensitive emulsion, magenta to green and cyan to red. However, the light sensitive layer and the coupler hue may also correspond differently.

Spectral sensitization of the emulsion provides sensitivity to a desired light wave length region in each of the emulsion layers of the light-sensitive material according to the method of the present invention. Spectral sensitization is preferably conducted in the present invention by adding a dye that absorbs light of the wavelength region corresponding to the desired spectral sensitivity, i.e., use of a spectrally sensitizing dye. Useful spectrally sensitizing dyes include, for example, those described in F. H. Harmer, *Heterocyclic Compounds Cyanine Dyes and Related Compounds*, published by John Wiley & Sons (New York, London), 1964. The spectrally sensitizing dyes described in JP-A-62-215272, from page 22, upper right column, to page 38 are preferred.

Preferred spectrally sensitizing dyes are represented by formulae (IV) through (VI).

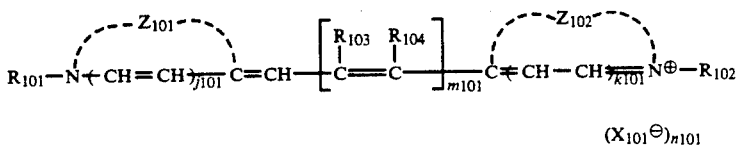

(IV)

wherein each represent an atomic group necessary for forming a heterocyclic ring including 5- or 6-membered rings containing nitrogen, sulfur, oxygen, selenium or tellurium. These heterocyclic rings may further be joined with a condensate ring, which may further be substituted.

Nonlimiting examples of the heterocyclic ring include thiazole ring, benzothiazole ring, naphtho thiazcle ring, selenazole ring, benzoselenazole ring, naphthoselenazole ring, oxazole ring, benzooxazole ring, naphthooxazole ring, imidazole ring, benzimidazole ring, naphthoimidazole ring, 4-quinoline ring, pyrroline ring, pyridine ring, tetrazole ring, indolenine ring, benzindolenine ring, indole ring, tetrazole ring, benzotetrazole ring, naphthotetrazole ring.

$R_{101}$ and $R_{102}$ represent each an alkyl group, alkenyl group preferably having 1 to 10 carbon atoms), alkynyl group (preferably having 1 to 10 carbon atoms) or aralkyl group (preferably having 1 to 10 carbon atoms). These groups and the groups described below may be substituted. The alkyl group,.for example, includes substituted and unsubstituted alkyl groups, which may be linear, branched or cyclic. The number of carbon atoms in the alkyl group is preferably from 1 to 8.

Examples of the substituent for the substituted alkyl group include halogen atom (e.g., chlorine, bromine and fluorine), cyano group, alkoxy group, substituted or unsubstituted amino group, carboxylic acid group, sulfonic acid group and hydroxyl group. The substituent may be used alone or in combination.

An example of the alkenyl group includes a vinyl methyl group.

Examples of the aralkyl group include a benzyl group or phenetyl group.

$m_{101}$ represents 0 or an integer of 1, 2 or 3. When $m_{101}$ is 1, $R_{103}$ represents a hydrogen atom, lower alkyl group, aralkyl group or aryl group.

An example of the aryl group includes a substituted or unsubstituted phenyl group.

$R_{104}$ represents a hydrogen atom when $m_{101}$ is 1. When $m_{101}$ is 2 or 3, $R_{103}$ represents a hydrogen atom, and $R_{104}$ represents a hydrogen atom, a lower alkyl group or aralkyl group, or $R_{104}$ may form a 5- or 6-membered group with $R_{102}$. When $m_{101}$ is 2 or 3 and $R_{104}$ represents a hydrogen atom, $R_{103}$ may join with other groups to form a hydrocarbon ring or heterocyclic ring. The ring is preferably a 5- or 6-membered ring. $j_{101}$ and $k_{101}$ each represent 0 or 1, $X_{101}$ represents an acid anion and $n_{101}$ represents 0 or 1.

those for and $R_{101}$ and $R_{102}$, and $R_{103}$ represents an alkyl, alkenyl, alkynyl or aryl group (e.g., substituted or unsubstituted phenyl group), preferably having 1 to 10 carbon atoms. $m_{201}$ represents 0, 1 or 2. $R_{204}$ represents a hydrogen atom, lower alkyl group (preferably having 1 to 10 carbon atoms) or aryl group preferably having 1 to 10 carbon atoms). When $m_{201}$ is 2, the $R_{204}$ groups may join to form a hydrocarbon ring or heterocyclic ring being preferably 5- or 6-membered rings.

$Q_{201}$ represents a sulfur atom, oxygen atom, selenium atom or

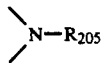

and $R_{205}$ has the same meanings as for $R_{203}$. $j_{201}$, $R_{201}$, $X^{\ominus}_{201}$ and $n_{201}$ have the same meaning as $j_{101}$, $k_{101}$, $X^{\ominus}_{101}$ and $n_{101}$ respectively, in the formula IV.

(VI)

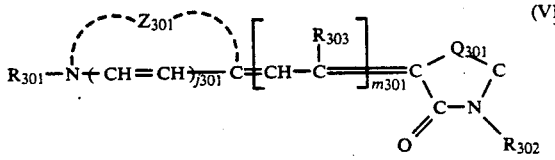

wherein $Z_{301}$ represents an atomic group necessary for forming a heterocyclic ring. Examples of the heterocyclic ring, include those described for $Z_{101}$ or $Z_{102}$ of general formula IV and specific examples thereof further include thiazolidine, thiazoline, benzothiazoline, naphthothiazoline, selenazolidine, selenazoline, benzoselenazoline, naphthoselenazoline, benzooxazoline, naphthooxazoline, dihydropyridine, dihydroquinoline, benzimidazoline and naphthoimidazoline. $Q_{301}$ has the same meaning as $Q_{201}$; $R_{301}$ has the same meaning as $R_{101}$ or $R_{102}$, and $R_{302}$ has the same meaning as $R_{203}$; $m_{301}$ has the same meaning as $m_{201}$; $R_{303}$ has the same meaning as $R_{204}$ and, in addition, $R_{303}$ may join with other $R_{303}$ groups to form a hydrocarbon ring, or heterocyclic ring when $m_{301}$ is 2 or 3; and $j_{301}$ has the same meaning as $j_{101}$, as defined in the formulae IV and V.

Nonlimiting examples of the spectrally sensitizing dyes represented by formulae (IV), (V) and (VI) are set forth below.

(V)

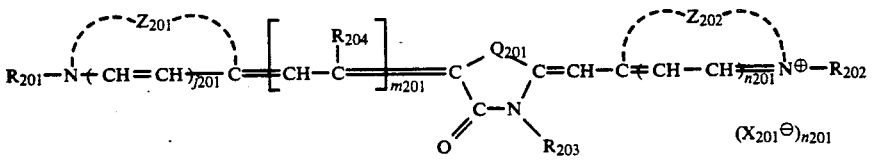

wherein $Z_{201}$, $Z_{202}$ have the same meanings as those for $Z_{101}$ and $Z_{102}$. $R_{201}$ and $R_{202}$ have the same meanings as Dye-1

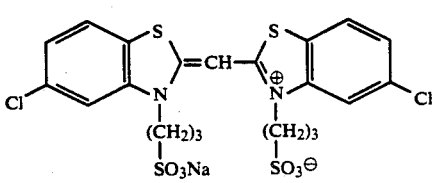

Dye-2

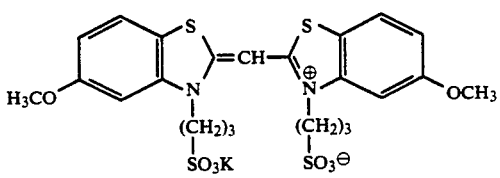

-continued
Dye-3
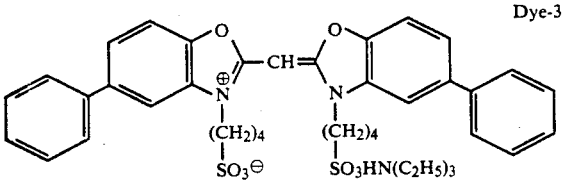
Dye-4
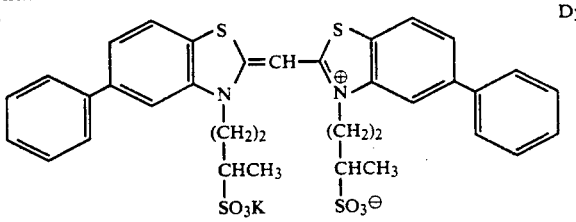
Dye-5
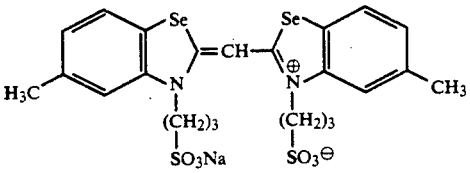
Dye-6
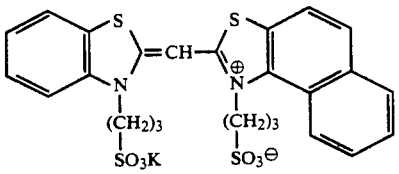
Dye-7
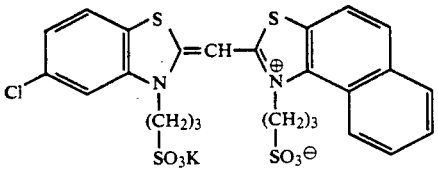
Dye-8
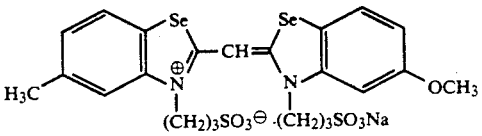
Dye-9
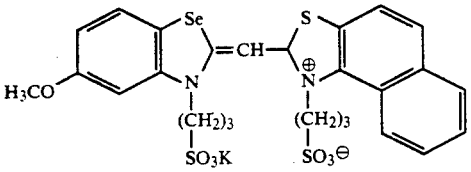
Dye-10
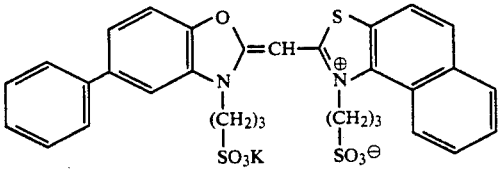
Dye-11
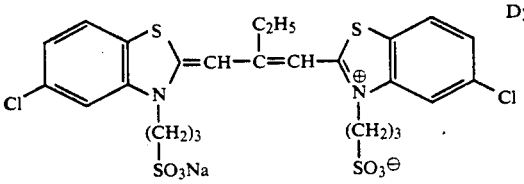
Dye-12
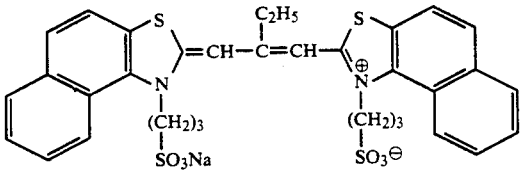
Dye-13
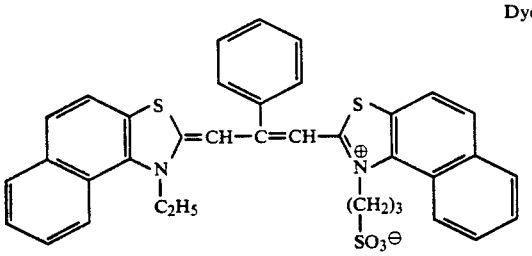
Dye-14
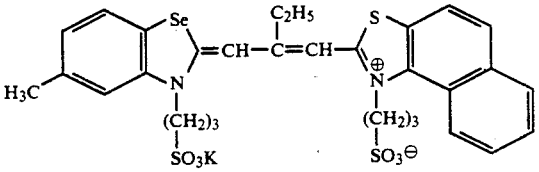
Dye-15
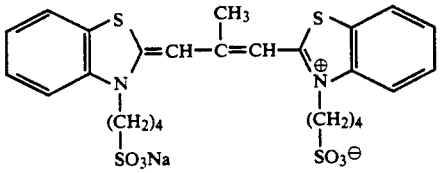
Dye-16
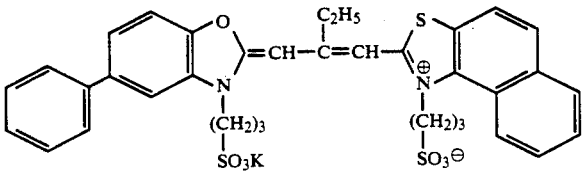

-continued
Dye-17
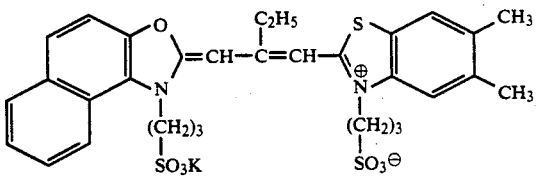
Dye-18
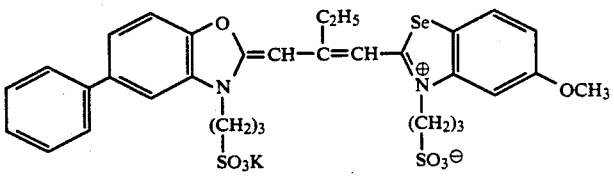
Dye-19
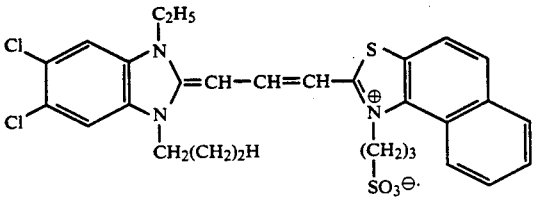
Dye-20
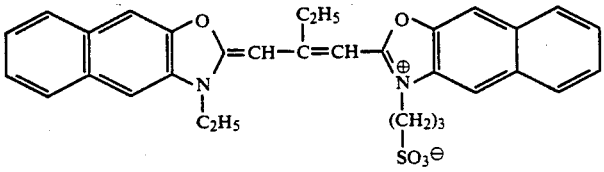
Dye-21
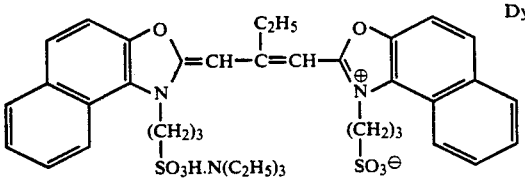
Dye-22
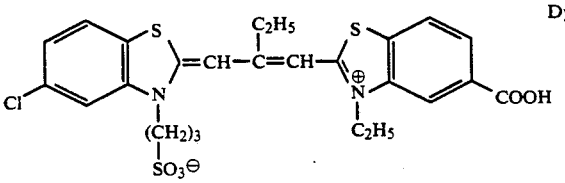
Dye-23
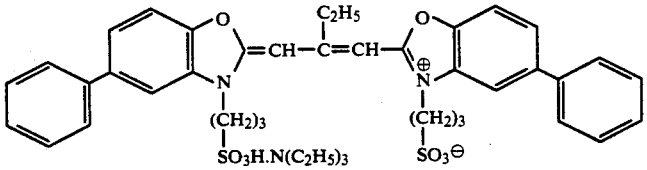
Dye-24
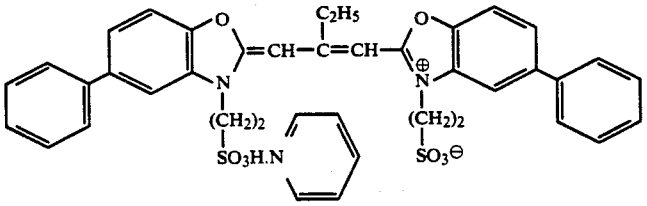
Dye-25
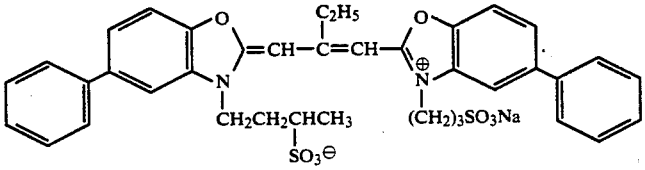

-continued
Dye-26
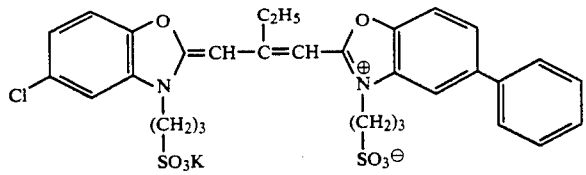
Dye-27
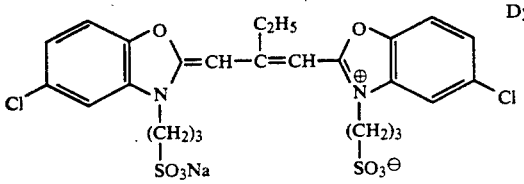
Dye-28
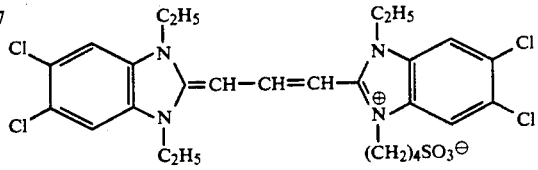
Dye-29
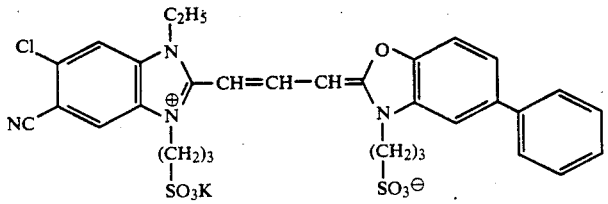
Dye-30
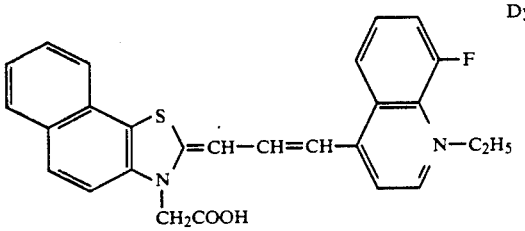
Dye-31
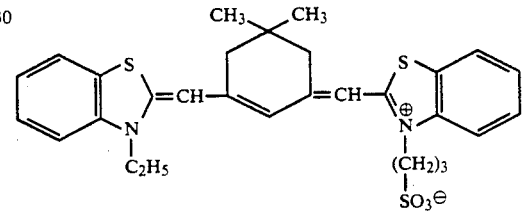
Dye-32
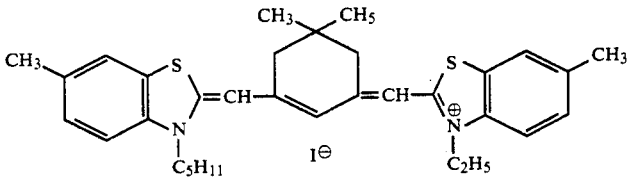
Dye-33
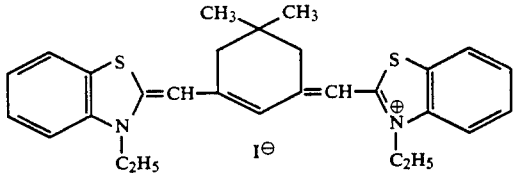
Dye-34
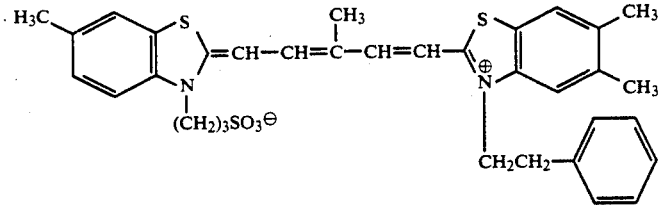
Dye-35
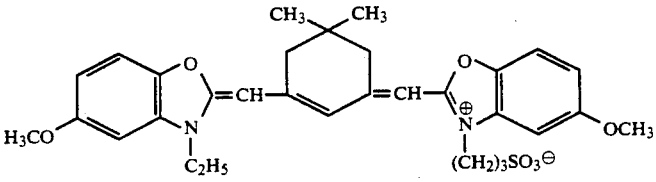

-continued
Dye-36
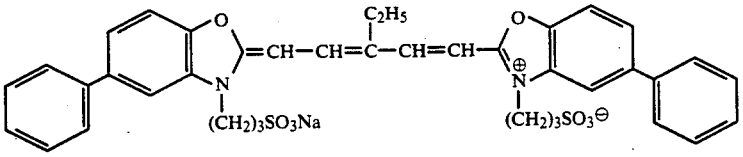
Dye-37
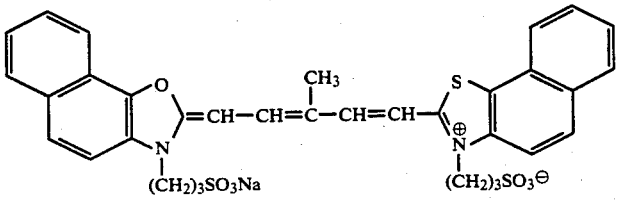
Dye-38
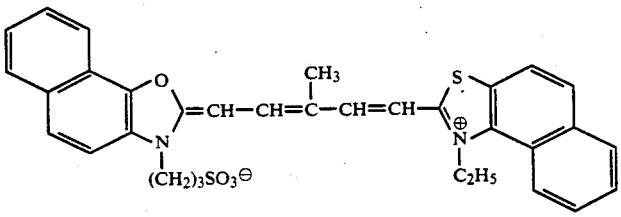
Dye-39
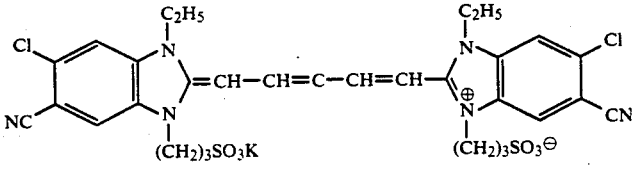
Dye-40
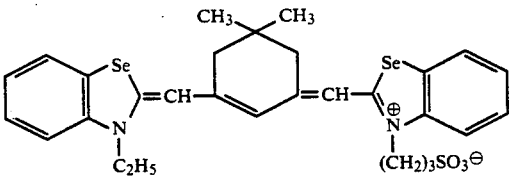
Dye-41
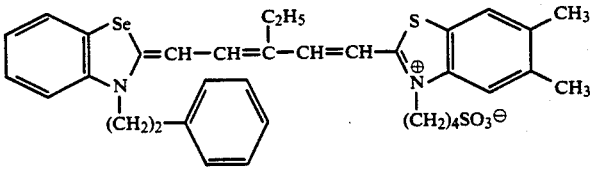
Dye-42
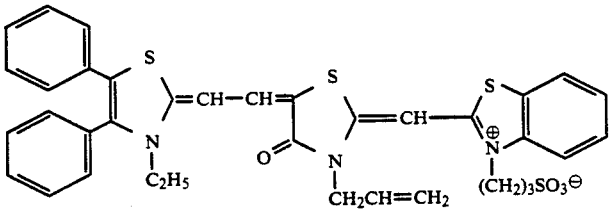

-continued
Dye-43
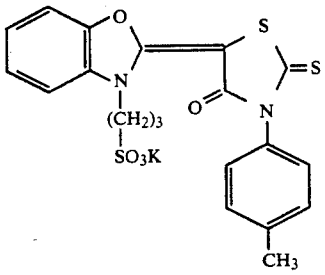
Dye-44
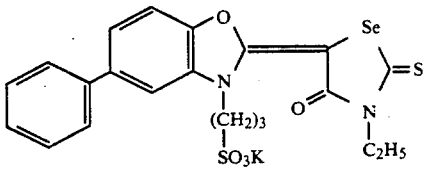
Dye-45
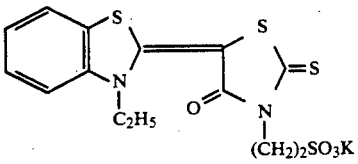
Dye-46
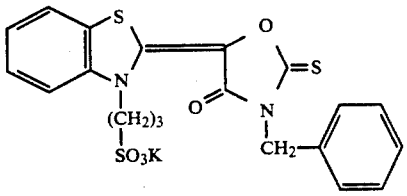
Dye-47
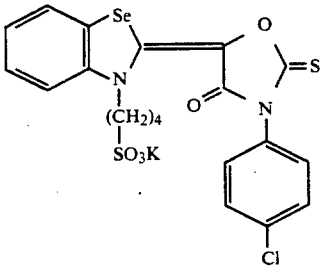
Dye-48
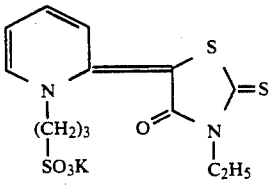
Dye-49
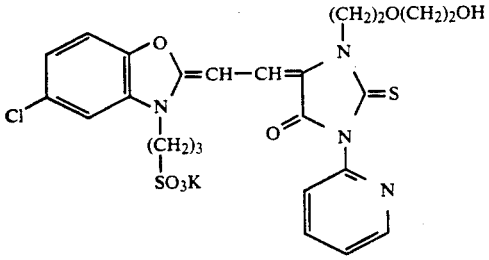
Dye-50
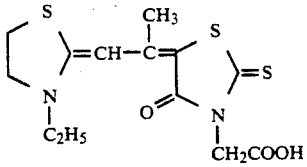
Dye-51
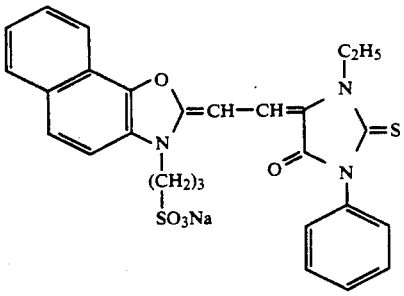
Dye-52
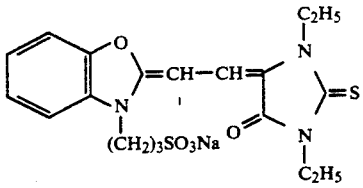
Dye-53
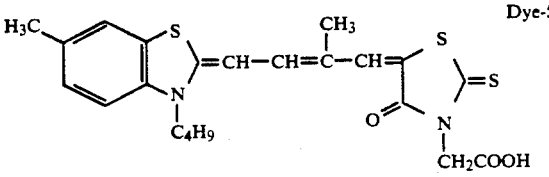
Dye-54
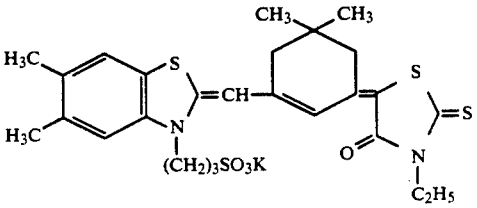

-continued

Dye-55

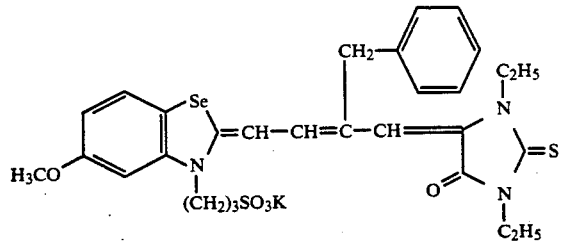

The silver halide color photographic light-sensitive material according to the method of the present invention contains a color coupler which forms a dye through a coupling reaction with the oxidation product of an aromatic primary amine developing agent. The coupler includes those compounds having an active methylene group and which form an azomethine dye after coupling with the oxidation product of the developing agent. As described above, the color couplers include those compounds which form yellow, magenta and cyan dyes.

As the yellow coupler for use in the present invention, acylacetoamide derivatives such as benzoyl acetoanilide and pivaloyl acetoanilide are preferred.

Among them, those represented by formulae (Y-1) and (Y-2) are useful as the yellow coupler.

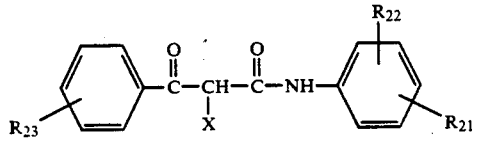

(Y-1)

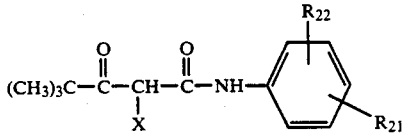

(Y-2)

wherein X represents a hydrogen atom or a coupling releasing group, $R_{21}$ represents a diffusion-resistant group having a total of 8 to 32 carbon atoms, $R_{22}$ represents a hydrogen atom, one or more halogen atoms, lower alkyl group, lower alkoxy group or a diffusion-resistant group having a total of from 8 to 32 carbon atoms. $R_{23}$ represents a hydrogen atom or a substituent group. If two or more $R_{23}$ groups are present, the $R_{23}$ groups may be the same or different.

The pivaloyl acetoanilide type yellow coupler are described in U.S. Pat. No. 4,622,287, from column 3, line 15 to column 8, line 39 and in U.S. Pat. No. 4,623,616, from column 14, line 50 to column 19, line 41.

The benzoyl acetoanilide type yellow coupler are described in, for example, U.S. Pat. Nos. 3,408,194, 3,933,501, 4,046,575, 4,133,958 and 4,401,752.

Examples of the pivaloyl acetoanilide type yellow coupler, for use in the present invention include the compounds (Y-1) to (Y-39) as described in U.S. Pat. No. 4,622,287, from column 37 to column 54. Among them, (Y-1), (Y-4), (Y-6), (Y-7), (Y-15), (Y-21), (Y-22), (Y-23), (Y-26), (Y-35), (Y-36), (Y-37), (Y-38) and (Y-39) are preferred.

Further examples of the pivaloyl acetoanilide type yellow coupler include the compounds (Y-1) to (Y-33) described in U.S. Pat. No. 4,623,616 from column 19 to column 24. Among them, (Y-2), (Y-7), (Y-8), (Y-12), (Y-20), (Y-21), (Y-23) and (Y-29) are preferred.

Additional preferred examples of the pivaloyl acetoanilide type yellow coupler include typical example (34) described in U.S. Pat. No. 3,408,191, column 6, compounds (16) and (19) described in U.S. Pat. No. 3,933,501, column 8, compound (9) described in U.S. Pat. No. 4,046,575, columns 7 to 8, compound (1) described in U.S. Pat. No. 4,133,958, columns 5 to 6, and compound 1 described in U.S. Pat. No. 4,401,752, column 5 and the following compounds (a) to (h).

Useful examples of the compound of the formula (Y-2) are described below.

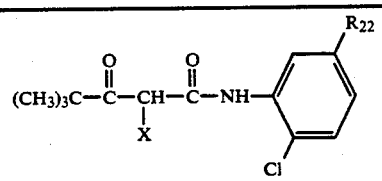

| Compound | $R_{22}$ | X |
|---|---|---|
| a | $-COOCH(CH_3)COOC_{12}H_{25}$ | 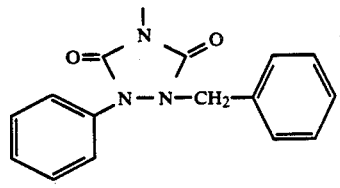 |
| b | $-COOCH(C_4H_9)COOC_{12}H_{25}$ | as in (a) above |

-continued

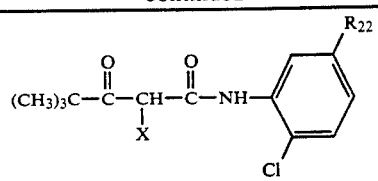

| Compound | $R_{22}$ | X |
|---|---|---|
| c | 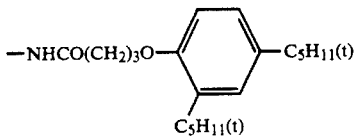 | 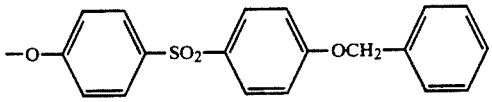 |
| d | as in (c) above | 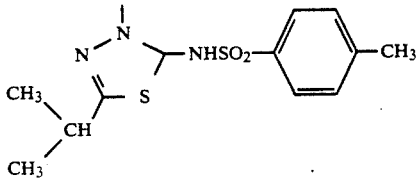 |
| e | as in (c) above | 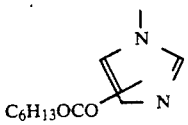 |
| f | $-NHSO_2C_{12}H_{25}$ | 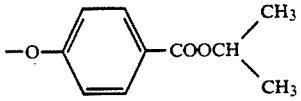 |
| g | $-NHSO_2C_{16}H_{33}$ | 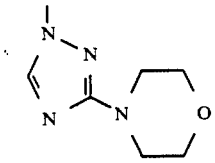 |
| h | 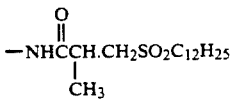 | 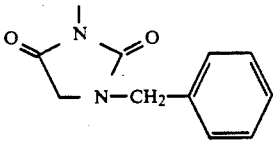 |

Among the couplers described above, those having a nitrogen atom as a releasing atom are particularly preferred.

The magenta coupler for use in the present invention includes oil-protect type indazolone or cyanoacetyl type couplers, preferably, those couplers of pyrazolone type or pyrazoloazoles such as pyrazolotriazole. As the 5-pyrazolone coupler, those substituted with arylamino group or acylamino group at the 3-position are preferred in view of the hue and the color developing density of the color developing dye, and typical examples thereof are described, for example, in U.S. Pat. Nos. 2,311,082 2,343,073, 2,600,788, 2,908,573, 3,062,653, 3,152,896 and 3,936,015. As the releasing group of the 2-equivalent 5-pyrazolone coupler, the nitrogen atom releasing group described in U.S. Pat. No. 4,310,619 or the arylthio group described in U.S. Pat. No. 4,351,897 are preferred. In addition, the 5-pyrazolon type coupler having a ballast group described in European Patent 73,636 provides high color developing density.

The pyrazoloazole type coupler for use in the present invention includes the pyrazole benzimidazoles described in U.S. Pat. No. 2,369,879, and preferably, pyrazolo(5,1-c)(1,2,4)triazoles as described in U.S. Pat. No. 3,725,067, the pyrazolotetrazoles described in Research Disclosure, 24220 (June, 1984) and the pyrazolopyrazoles described in *Research Disclosure*, 24230 (June, 1984). Any of the couplers described above may also be used in the form of a polymer coupler.

The magenta couplers for use in the present invention include those represented by the following formulae (M-1), (M-2) or (M-3).

(M-1)

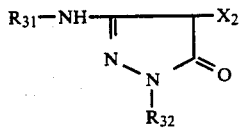

(M-2)

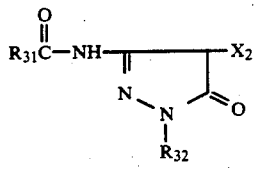

(M-3)

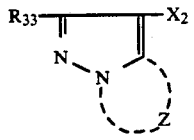

where $R_{31}$ represents a diffusion resistant group having a total of from 8 to 32 carbon atoms, $R_{32}$ represents a phenyl or substituted phenyl group, $R_{33}$ represents a hydrogen atom or a substituent. Z represents a non-metal atom group necessary for forming a 5-membered azole ring containing 2 to 4 nitrogen atoms wherein the azole ring may be substituted and may also form a condensed ring.

$X_2$ represents a hydrogen atom or a releasing group. The substituent on $R_{33}$ and substituents azole ring are disclosed in, for example, U.S. Pat. No. 4,540,654, from column 2, line 41 to column 8, line 27.

Among the pyrazoloazole couplers, the imidazo(1,2-b)pyrazoles described in U.S. Pat. No. 4,500,630 are preferred in view of less yellow sub-absorption and light fastness of the color developed dye, pyrazolo(1,5-b)(1,2,4)triazole as described in U.S. Pat. No. 4,540,654 being particularly preferred.

In addition, the pyrazolotriazole ring wherein a branched alkyl group is directly bonded to 2, 3 or 6-position of the pyrazolotriazole ring as describe in JP-A-61-65254, the pyrazoloazole coupler containing a sulfone amide group in the molecule as described in JP-A-61-65246, the pyrazoloazole coupler having an alkoxy phenylsulfone amide ballast group as described in JP-A-61-147254 and the pyrazolotriazole coupler having an alkoxy or aryloxy group at the 6-position as described in European Patent (Laid-Open) 226849 are preferably used.

Nonlimiting examples of the magenta couplers for use in the present invention are set forth below.

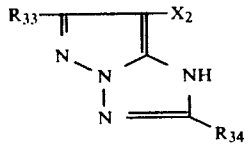
| Compound | $R_{33}$ | $R_{34}$ | $X_2$ |
|---|---|---|---|
| M-1 | $CH_3$— | 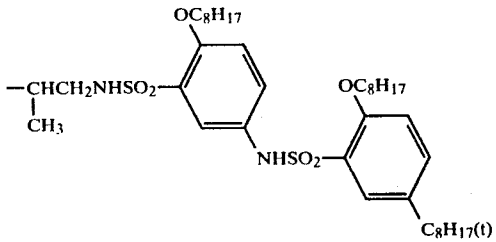 | Cl |
| M-2 | as above | 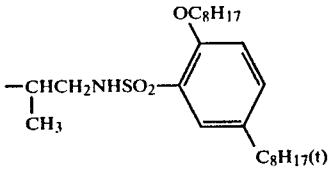 | as above |
| M-3 | as above | 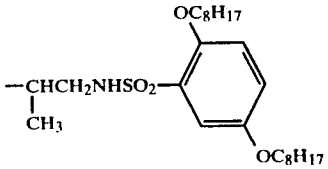 | 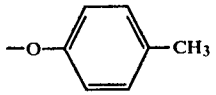 |
| M-4 | 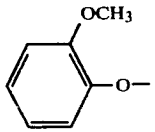 | 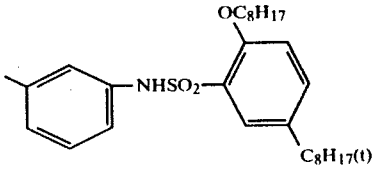 | 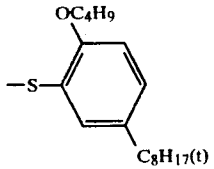 |

-continued
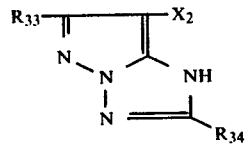
| Compound | $R_{33}$ | $R_{34}$ | $X_2$ |
|---|---|---|---|
| M-5 | $CH_3$— | 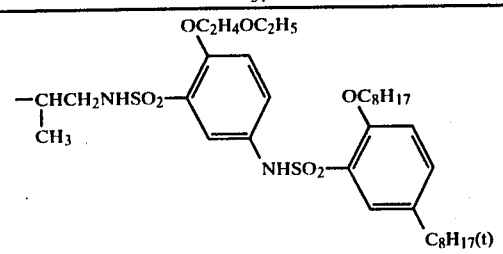 | Cl |
| M-6 | as above | 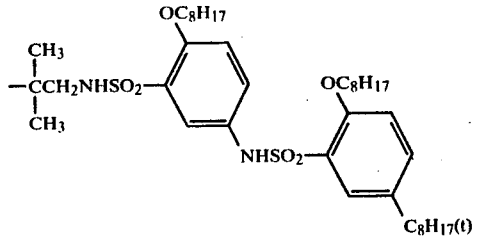 | as above |
| M-7 | 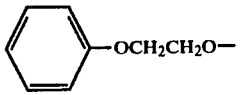 | 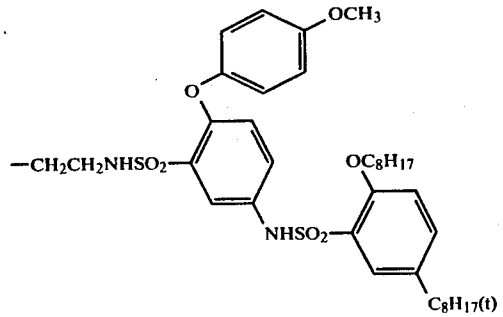 | 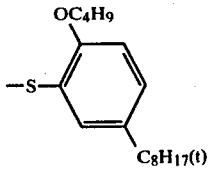 |
| M-8 | $CH_2CH_2O$— | as above | as above |

-continued
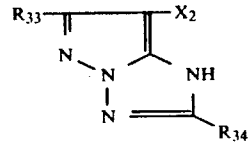
| Compound | $R_{33}$ | $R_{34}$ | $X_2$ |
|---|---|---|---|
| M-9 | 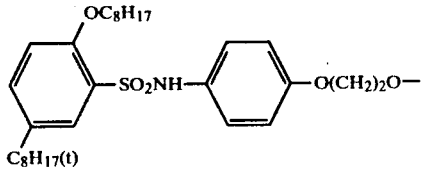 | 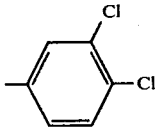 | as above |
| M-10 | $CH_3$— | 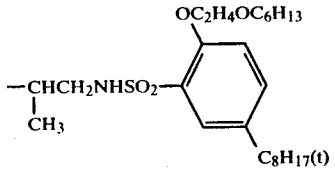 | Cl |
| M-11 | $CH_3$— | 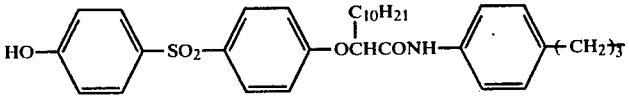 | Cl |
| M-12 | as above | 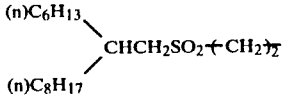 | as above |
| M-13 | 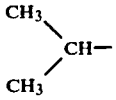 | 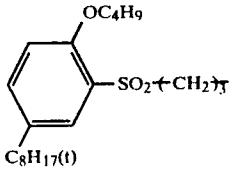 | as above |
| M-14 | 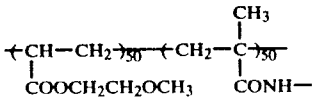 | 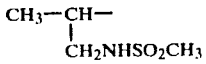 | Cl |

-continued
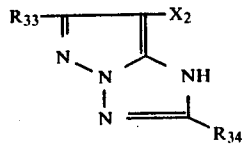
| Compound | $R_{33}$ | $R_{34}$ | $X_2$ |
|---|---|---|---|
| M-15 | 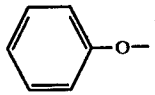 | 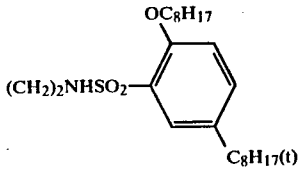 | Cl |
| M-16 | 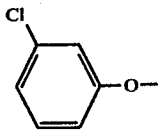 | 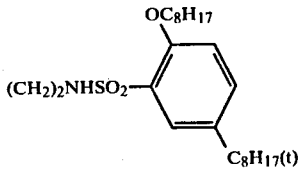 | 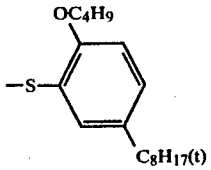 |
| (M-17) | 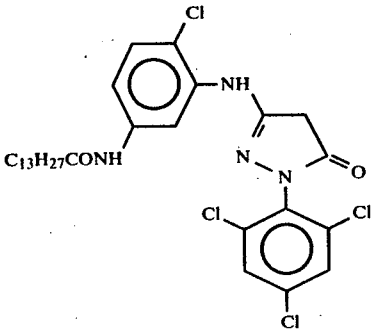 | | |

-continued
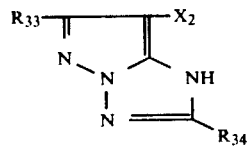
| Compound | $R_{33}$ | $R_{34}$ | $X_2$ |
|---|---|---|---|
| (M-18) | | | |
| (M-19) | | | |
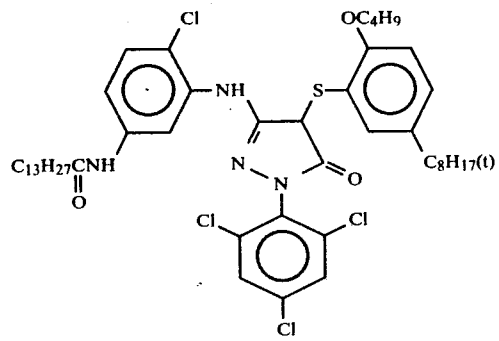
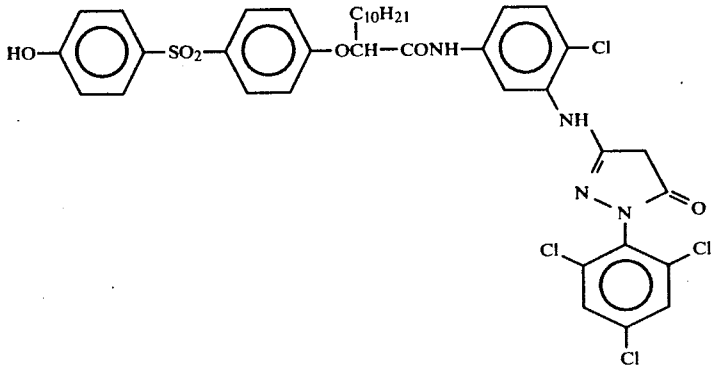

-continued
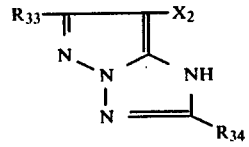
| Compound | $R_{33}$ | $R_{34}$ | $X_2$ |
|---|---|---|---|
| (M-20) | 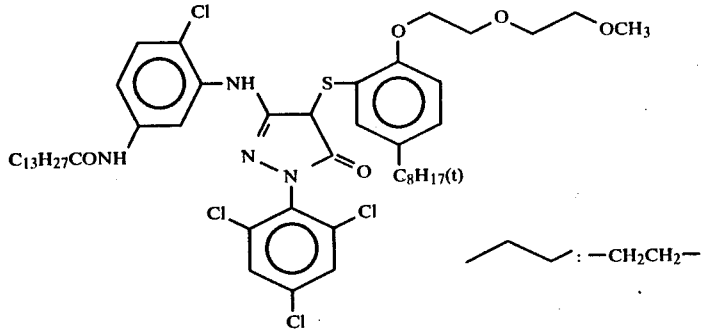 | | |
| (M-21) | 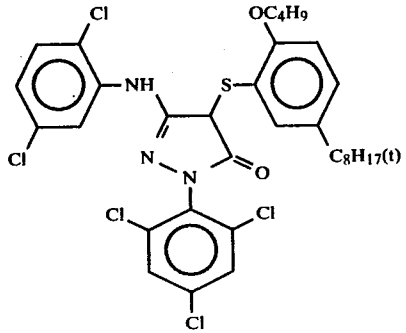 | | |

-continued
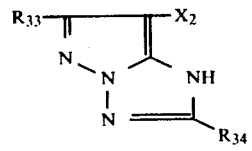
| Compound | $R_{33}$ | $R_{34}$ | $X_2$ |
|---|---|---|---|
| (M-22) | 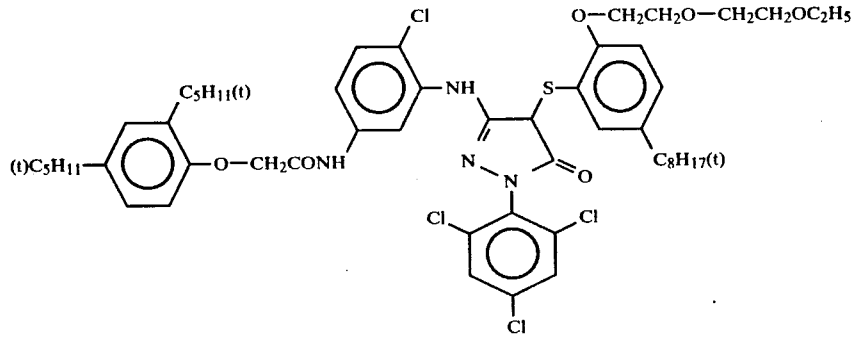 | | |
| (M-23) | 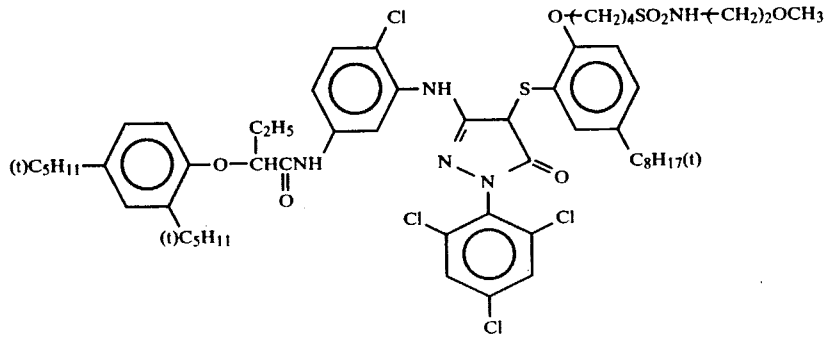 | | |

-continued
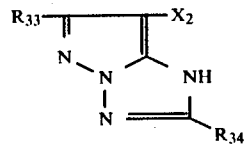
| Compound | $R_{33}$ | $R_{34}$ | $X_2$ |
|---|---|---|---|
| (M-24) | 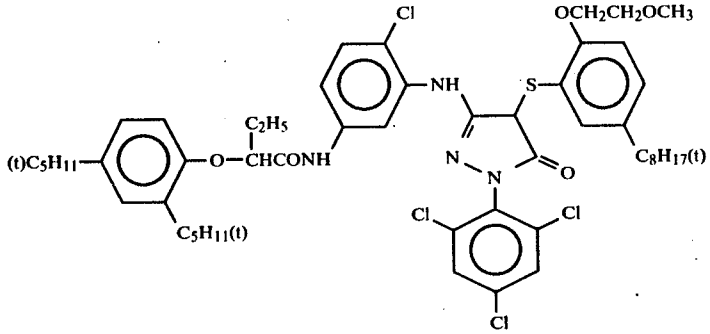 | | |
| (M-25) | 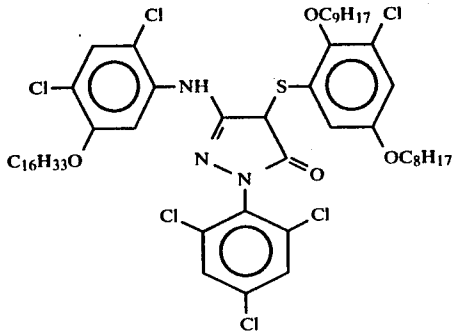 | | |

-continued
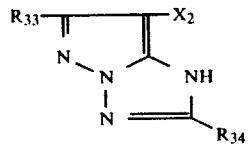
| Compound | $R_{33}$ | $R_{34}$ | $X_2$ |
|---|---|---|---|
| (M-26) | | 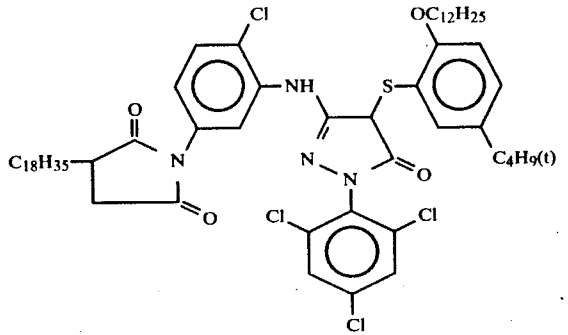 | |
| (M-27) | | 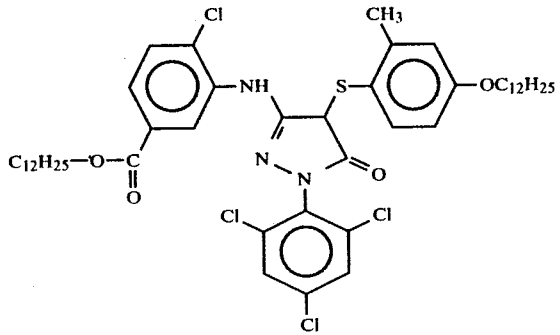 | |

-continued
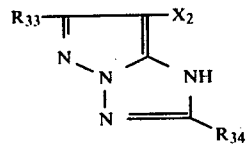
| Compound | $R_{33}$ | $R_{34}$ | $X_2$ |
|---|---|---|---|
| (M-28) | | | |
| (M-29) | | | |
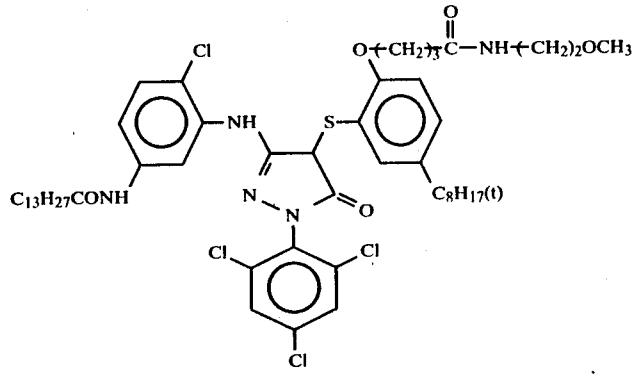
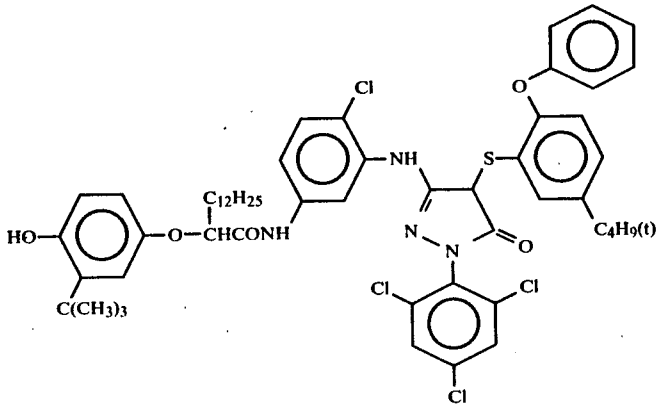

-continued
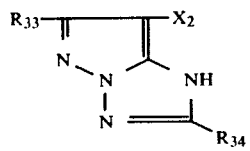
| Compound | $R_{33}$ | $R_{34}$ | $X_2$ |
|---|---|---|---|
| (M-30) | 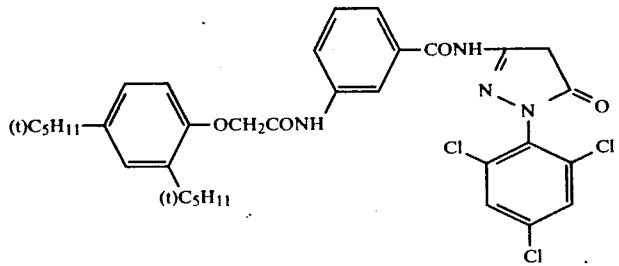 | | |
| (M-31) | 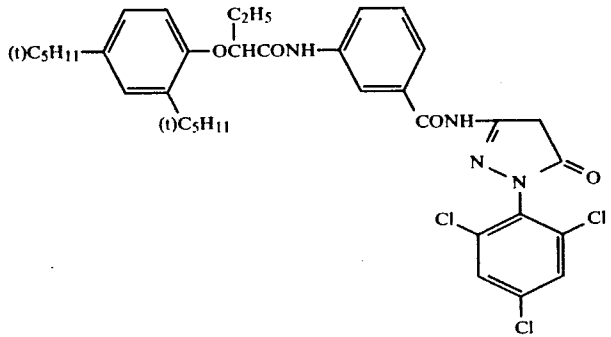 | | |

-continued
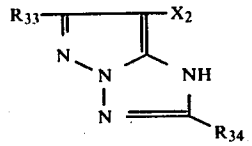
| Compound | $R_{33}$ | $R_{34}$ | $X_2$ |
|---|---|---|---|
| (M-32) | | 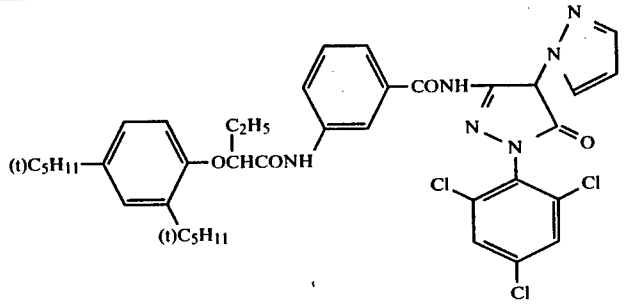 | |
| (M-33) | | 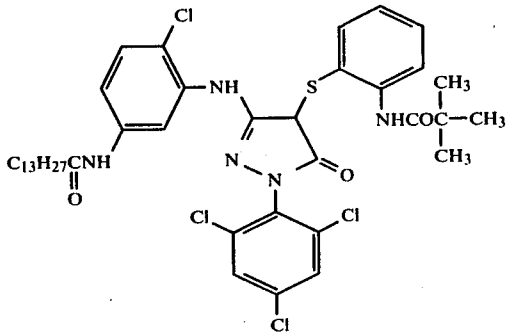 | |
| (M-34) | 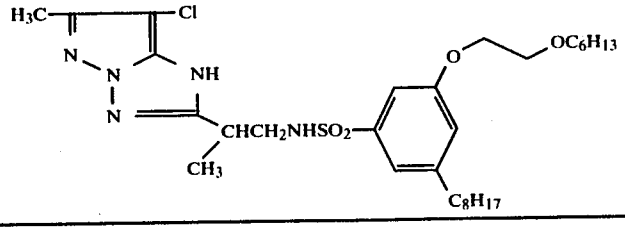 | | |

As the cyan coupler for use in the present invention, the phenol type cyan coupler and naphthol type cyan coupler are useful.

The phenol type cyan coupler for use in the present invention include those described in U.S. Pat. Nos. 2,369,929, 4,518,687, 4,511,647 and 3,772,002 having an acylamino group at 2-position and an alkyl group at 5-position on the phenol ring, including polymer couplers. Typical examples thereof include the coupler of Example 2 as described in Canadian Patent 625,822, compound (1) as described in U.S. Pat. No. 3,772,002, compounds (1-4), or (1-5) as described in U.S. Pat. No. 4,564,590, compounds (1), (2), (3) and (24) as described in JP-A-61-39045 and the compound (C-2) as described in JP-A-62-70846.

The phenol type cyan coupler for use in the present invention also includes the 2,5-diacylaminophenol type coupler as described in U.S. Pat. Nos. 2,772,162, 2,895,826, 4,334,011 and 4,500,653, as well as in JP-A-59-164555. Typical examples, thereof include the compound (V) described in U.S. Pat. No. 2,895,826, the compound (17) described in U.S. Pat. No. 4,557,999, the compounds (2) and (12) described in U.S. Pat. No. 4,565,777, the compound (4) described in U.S. Pat. No. 4,124,396 and the compound (I-19) described in U.S. Pat. No. 4,613,564.

The phenol type cyan coupler for use in the present invention also includes compounds wherein a nitrogen-containing heterocyclic ring is condensed with a phenol ring, as described in U.S. Pat. Nos. 4,372,173, 4,564,586 and 4,430,423, JP-A-61-390441 and JP-A-62-257158. Typical examples thereof include the coupler (1) or (3) described in U.S. Pat. No. 4,327,173, the compound (3) and (16) described in U.S. Pat. No. 4,564,586, the compounds (1) and (3) described in U.S. Pat. No. 4,430,423, as well as the following compounds:

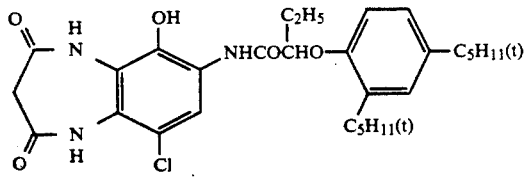

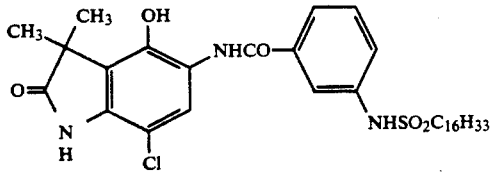

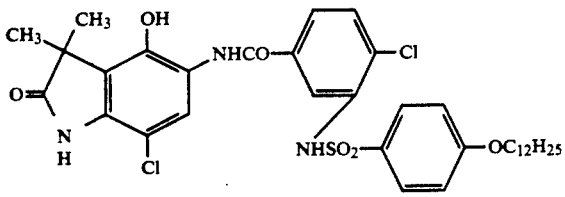

-continued

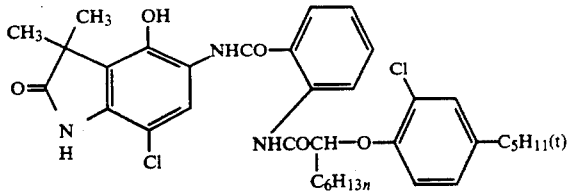

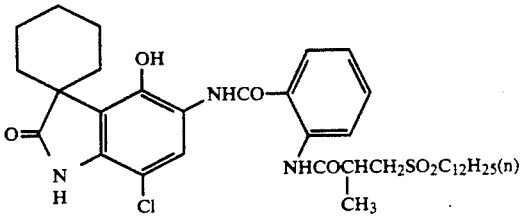

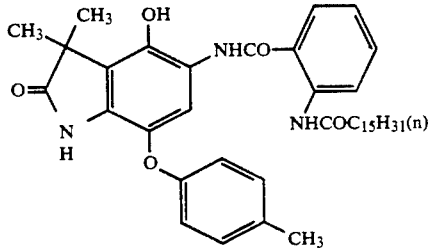

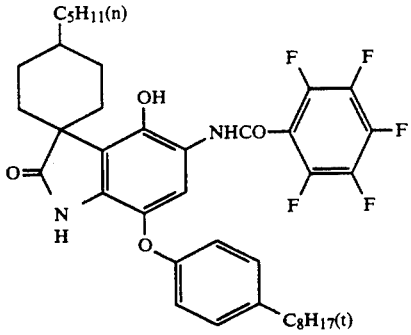

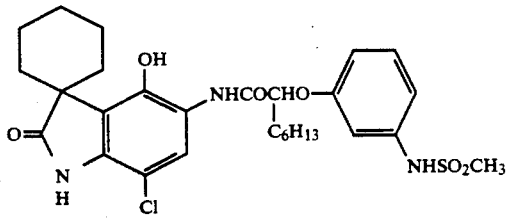

In addition to the above-described phenol type cyan couplers mentioned type, the diphenylimidazole type cyan coupler described in European Patent Application (Laid-Open) 249,453A2 may also be used, representative examples of which are shown below.

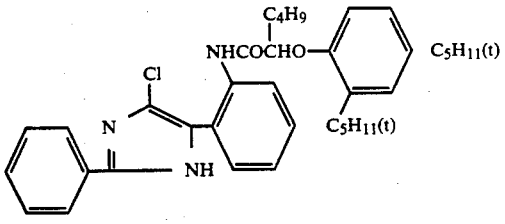

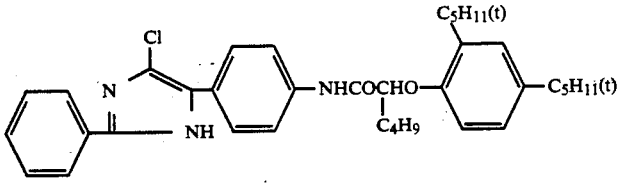

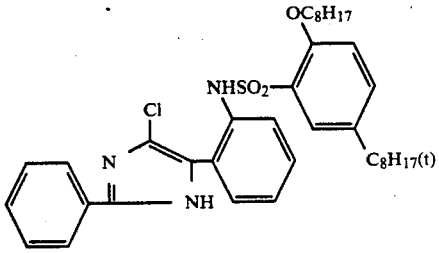

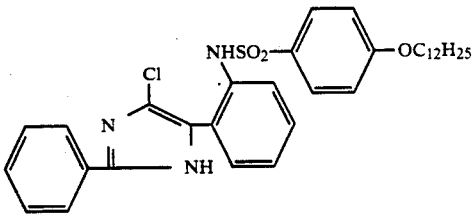

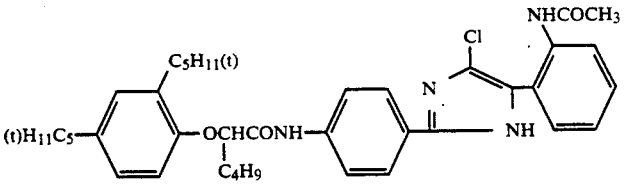

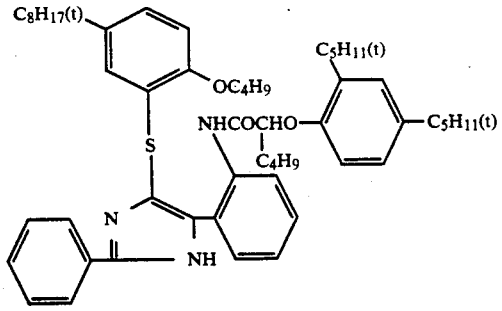

The phenol type cyan coupler for use in the present invention further include the ureido type couplers described in U.S. Pat. Nos. 4,333,999, 4,451,559, 4,444,872, 4,427,767 and 54,579,813, and European Patent 067,689B1. Typical examples thereof include the coupler (7) described in U.S. Pat. No. 4,333,999, the coupler (1) described in U.S. Pat. No. 4,451,559, the coupler (14) described in U.S. Pat. No. 4,444,872, the coupler (3) described in U.S. Pat. No. 4,427,767, the couplers (6) and (24) described in U.S. Pat. No. 4,609,619, the couplers (1) and (11) described in U.S. Pat. No. 4,579,813, the couplers (45) and (50) described in European Patent 067689B1, and the coupler (3) described in JP-A-61-42658.

The naphthol type cyan coupler for use in the present invention include those having an N-alkyl-N-arylcarbamoyl group at 2-position of the naphthol ring as described, for example, in U.S. Pat. No. 2,313,586, those having an alkyl carbamoyl group at 2-position as described, for example, in U.S. Pat. Nos. 2,474,293 and 4,282,312, those having an aryl carbamoyl group at 2-position as described, for example, in JP-B-50-14523 (the term "JP-B" as used herein means an "examined Japanese Patent Publication"), those having a carbon amide or sulfone amide group at the 5-position as described, for example, in JP-A-60-237448, JP-A-61-145557 and JP-A-61-153640, those having an aryloxy releasing group as described, for example, in U.S. Pat. No. 3,46,563, those having a substituted alkoxy releasing group as described, for example, in U.S. Pat. No. 4,296,199, and those having a glycolic acid releasing group as described, for example, in JP-B-60-39217.

The couplers for use in the present invention can be incorporated into a dispersed emulsion layer together with at least one high boiling organic solvent. Preferably, a high boiling organic solvents represented by the following formulae (A) to (E) is used.

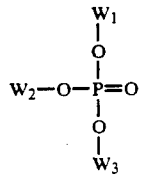
Formula (A)

$W_1-COO-W_2$ Formula (B)

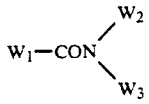
Formula (C)

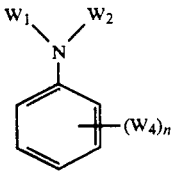
Formula (D)

$W_1-O-W_2$ Formula (E)

where $W_1$, W2 and $W_3$ each represent substituted unsubstituted alkyl group, cycloalkyl group, alkenyl group, aryl group or heterocyclic group, $W_4$ is $W_1$, $OW_1$ or S-$W_1$, n is an integer of 1 to 5 and if n is two or greater, the $W_4$ groups may be the same or different, and $W_1$ and $W_2$ may together form a condensed ring in the formula (E).

Furthermore, the couplers for use in the present invention may be emulsified and dispersed in an aqueous hydrophilic colloidal solution in the presence or absence of a high boiling organic solvent described above by immersing the couplers into a loadable latex polymer as described, for example, in U.S. Pat. No. 4,203,716, or by dissolving the couplers into a water-soluble and an organic solvent-soluble polymer.

Preferably, the homopolymers or copolymers described in pages 12 to 30 of International Laid-Open W088/00723 are used as the polymer or copolymer, and, in particular, use of an acrylic amide polymer is preferred for stability of the color image, etc.

The light-sensitive material prepared according to the method of the present invention, may contain a hydroquinone derivative, aminophenyl derivative, gallic acid derivative, ascorbic acid derivative, etc. as an anti-color foggant.

Various discoloration inhibitors may be used for the light-sensitive material of the present invention. Organic discoloration inhibitors for use with cyan, magenta, and/or yellow images include, as typical examples, hindered phenols, mainly, hydroquinones, 6-hydroxychromane, 5-hydroxycoumarane, spyrochromanes, p-alkoxyphenols and bisphenols; gallic acid derivatives; methylene dioxybenzenes; aminophenols; hindered amines and ether or ester derivatives obtained by silylating or alkylating the phenolic hydroxyl groups in each of the above-noted compounds. Furthermore, the metal complex compounds represented typically by (bissalicyl aldoxymate) nickel complex and (bis-N,N-dialkyldithio carbamate) nickel complex may also be used.

Examples of the organic discoloration inhibitors for use in the present invention are described below, including the hydroquinones described in U.S. Pat. Nos. 2,360,290, 2,418,613, 2,700,453, 2,701,197, 2,728,659, 2,732,300, 2,735,765, 3,982,944 and 4,430,425, British Patent 1,363,921, U.S. Pat. Nos. 2,710,801 and 2,816,028; the 6-hydroxychromanes, 5-hydroxycoumaranes and spyrochromanes described in U.S. Pat. Nos. 3,432,300, 3,573,050, 3,574,627, 3,698,909 and 3,964,337, JP-A-52-152225; the spyroindanes described in U.S. Pat. No. 4,360,589, the p-alkoxyphenols described in U.S. Pat. No. 2,735,765, British Patent 2066975, JP-A-59-10539, JP-B-57-19765, the hindered phenols described in U.S. Pat. No. 3,700,455, JP-A-52-72224, U.S. Pat. No. 4,228,235 and JP-B-52-6623, the gallic acid derivatives methylenedioxybenzenes and aminophenols described in U.S. Pat. Nos. 3,457,097, 4,332,886 and JP-B-56-21144, respectively, the hindered amines described in U.S. Pat. Nos. 3,336,135, 4,268,593, British Patents 132889, 1354313, 1410846, JP-B-51-1420, JP-A-58-114036, JP-A-59-53846 and JP-A-59-78344, ether and ester derivatives of phenolic hydroxyl groups descried in U.S. Pat. Nos. 4,155,765, 4,174,220, 4,254,216, 4,264,720, JP-A-54-145530, JP-A-55-6321, JP-A-58-105147 and JP-A-59-10539, JP-B-57-37856, U.S. Pat. No. 4,279,990 and JP-B-53-3263, metal complexes described in U.S. Pat. Nos. 4,050,938, 4,241,155 and British Patent 2027731(A), respectively. The effect of the discoloration inhibitor is generally attained by coemulsifying from 5 to 100% by weight of the discoloration inhibitor with the corresponding couplers, and adding the mixture to the light sensitive layers. For preventing the degradation of cyan dye image with heat, particularly light, UV-ray absorber are effectively introduced into layers on both sides adjacent to the cyan developing layer.

Among the discoloration inhibitors described above, spyroindanes, hindered amines, etc. are particularly preferred.

In the present invention, the following compounds (F) and (G) described below are preferably used together with the couplers described above, particularly, the pyrazoloazole couplers.

Namely, use of the compound (F) that chemically bonds with the aromatic amine developing agent remaining after color development to form a chemically inert and substantially colorless compound and/or the compound (G) that chemically bonds with the oxidation product of the aromatic amine color developing agent remaining after the color development to form a chemically inert and substantially colorless compound, the compound (F) and (G) either acting simultaneously or individually. The compounds (F) and (G) are preferably used for preventing the occurrence of stains and other side reactions, for example, due to the formation of color developing dye through the reaction between the color developing agent or the oxidation product thereof remaining in the film with the coupler during storage after the processing.

Preferred as the compound (F) are those compounds reacting with p-anisidine (in trioctylphosphate at 80° C.) at a secondary reaction rate constant $k_2$ within a range of from 1.0 l/mol.sec to $1\times10^{-5}$ l/mol.sec. If $k_2$ exceeds this range, the compound itself becomes instable and tends to decompose by reacting with gelatin or water.

On the other hand, if $k_2$ is less than the minimum value of the range, the reaction with the residual aromatic amine developing agent is slow, and the compound (F) can not reliably prevent the side reaction of the remaining aromatic amine type developing agent, which is an object of the present invention.

Preferred examples of the compound (F) are represented by the following formulae (FI) and (FII).

$$R_1-(A)_n-X \qquad \text{(FI)}$$

$$R_2-\underset{\underset{B}{|}}{C}=Y \qquad \text{(FII)}$$

wherein $R_1$ and $R_2$ each represents an aliphatic group, aromatic group or heterocyclic group, n represents 1 or 0, B represents a hydrogen atom, an aliphatic group, aromatic group, heterocyclic group, acyl group or sulfonyl group, and Y represents a group for promoting the addition of the aromatic amine type developing agent to the compound of the formula (FII). $R_1$ and X, Y and $R_2$ or Y and B may join together to form a ring structure.

The compounds (F) and (G) may chemically bond with the residual aromatic amine type developing agent by means of, for example, a substitution reaction or an addition reaction.

Specific examples of the compounds represented by formulae (FI), (FII) are described in JP-A-64-2042, JP-A-64-86139, JP-A-1-55558, JP-A-1-57259, JP-A-1-1198751 and JP-A-1-120554.

The light-sensitive material of the present invention may contain UV ray absorbers in one or more of the hydrophilic colloidal layers. Including, for example, an aryl-substituted benzotriazole compound as described, for example, in U.S. Pat. No. 3,533,794, a 4-thiazolidone compound as described, for example, in U.S. Pat. Nos. 3,314,794 and 3,352,681, benzophenone as described, for example, in JP-A-46-2784, cinnamic acid ester compound as described, for example, in U.S. Pat. Nos. 3,075,805 and 3,707,375, a butadiene compound as described, for example, in U.S. Pat. No. 4,045,229 or a benzoxydole compound as described, for example, in U.S. Pat. No. 3,700,455. A UV-ray absorbing coupler (for example, α-naphthol cyan dye-forming coupler) or a UV-absorbing polymer may also be used. These UV-ray absorber may also be mordanted to a specific layer.

The light-sensitive material of the present invention may also contain a water-soluble dye in one or more of the hydrophilic colloidal layers as a filter dye, anti-irradiation dye or other like purpose including oxonol dye, hemioxonol dye, styryl dye, merocyanine dye, cyanine dye and azo dye. Among them, oxonol dye, hemioxonol dye, cyanine dye and merocyanine dye are especially useful.

The dyes preferably used in the light-sensitive material of the present invention are compounds represented by formulae (VII) through (IX).

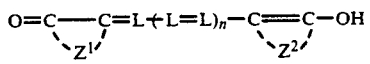

(VII)

wherein $Z^1$ and $Z^2$ which may be the same or different and each represent a non-metal atom group required for forming a heterocyclic ring, L represents a methine group and n represents 0, 1 or 2.

The heterocyclic ring formed with the non-metal atom group represented by $Z^1$ and $Z^2$ is preferably a 5- or 6-membered ring which may be a single ring or condensed ring. Including, for example, 5-pyrazolone ring, barbituric acid, isooxazolone, thiobarbituric acid, rhodanine, imidazopyridine, pyrazolopyrimidine and pyrrolidone. These rings may be further be substituted.

The heterocyclic ring formed by $Z_1$ or $Z_2$ is preferably a 5-pyrazolone ring or barbituric acid having at least one sulfonic acid group or carboxylic acid group. Oxonol dyes having such a pyrazolone ring or barbituric acid ring are described, for example, in British Patents 506385, 1177429, 1311884, 1338799, 1385371, 1467214, 1433102 and 1553516, JP-A-48-85130, JP-A-49-114420, JP-A-55-161233 and JP-A-59-111640 and U.S. Pat. Nos. 3,247,127, 3,469,985 and 4,078,933.

The methine group represented by L may be substituted by, for example, an alkyl group such as methyl or ethyl, aryl group such as phenyl and halogen atom such as chlorine, and the L groups may be bonded together to form a ring (for example, 4,4-dimethyl-1-cyclohexane).

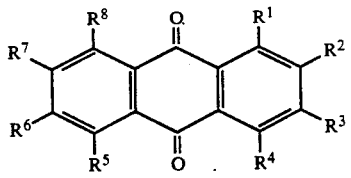

(VIII)

wherein $R^1$, $R^4$ and $R^5$, $R^8$ which may be the same or different, each represent a hydrogen atom, a hydroxy group, alkoxy group (preferably having 1 to 10 carbon atoms), aryloxy group (preferably having 1 to 10 carbon atoms), carbamoyl group or amino group

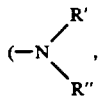

wherein R′ and R″, which may be the same or different, each represent a hydrogen atom or an alkyl or aryl group having at least one sulfonic acid group or carboxylic acid group.

$R^2$, $R^3$, $R^6$ and $R^7$, which may be the same or different, each represent each a hydrogen atom, a sulfonic acid group, carboxylic acid group and an alkyl or aryl group having at least one sulfonic acid group or carboxylic acid group.

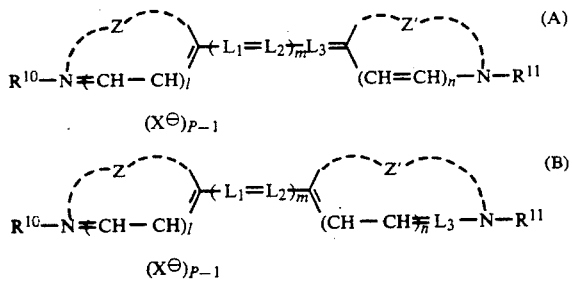

(A)

(B)

wherein $R_{10}$ and $R_{11}$ which may be the same or different, each represent a substituted or unsubstituted alkyl group having preferably 1 to 10 carbon atoms.

$L_1$, $L_2$ and $L_3$ which may be the same or different, each represent a substituted or unsubstituted methylene group as described above and m represents 0, 1, 2 or 3.

Z and Z' which may be the same or different, each represent a non-metal atom group required for forming a substituted or unsubstituted 5- or 6-membered heterocyclic ring; l and n each represents 0 or 1.

$X^{\ominus}$represents an anion. P is 1 or 2, and P is 1 when the compound forms an intramolecular salt.

Details for the cyanine dyes are described in U.S. Pat. Nos. 2,843,486 and 3,294,539.

Nonlimiting examples of the dyes suitably applied to the present invention are shown below.

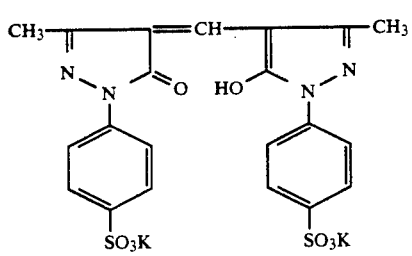

VII-1

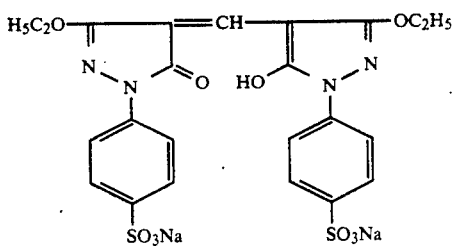

VII-2

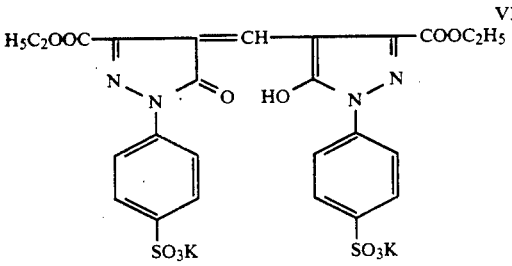

VII-3

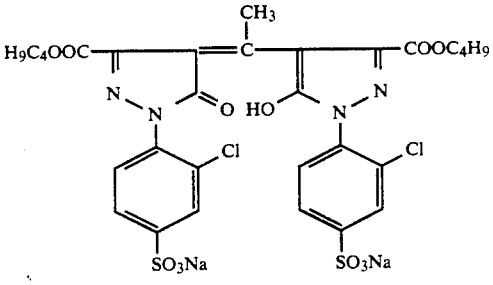

VII-4

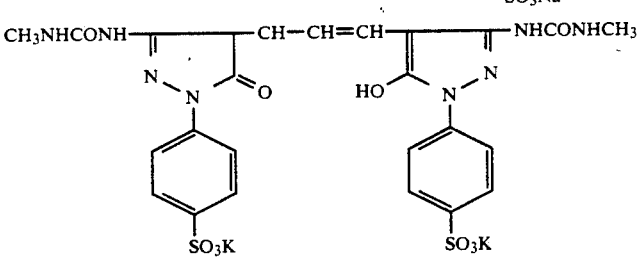

VII-5

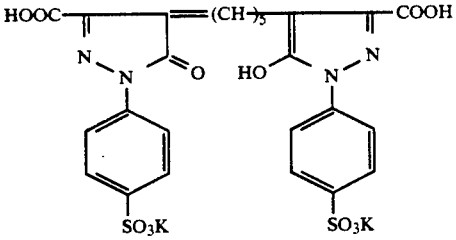

VII-6

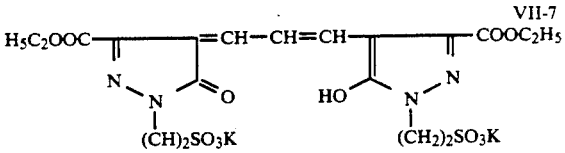

VII-7

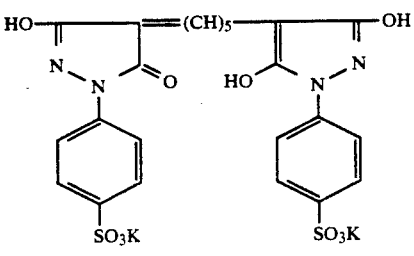

VII-8

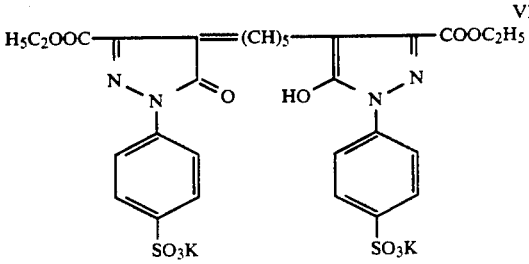

VII-9

-continued
VII-10
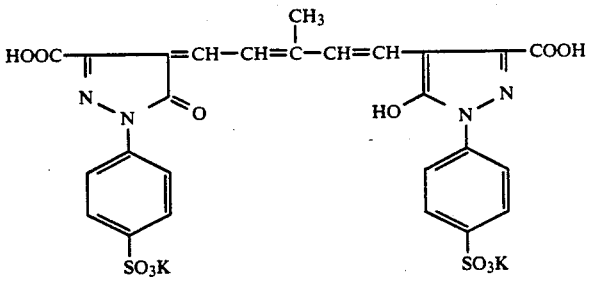
VII-11
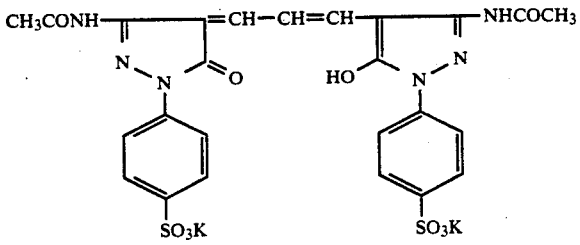
VII-12
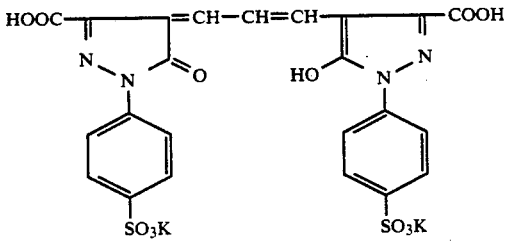
VII-13
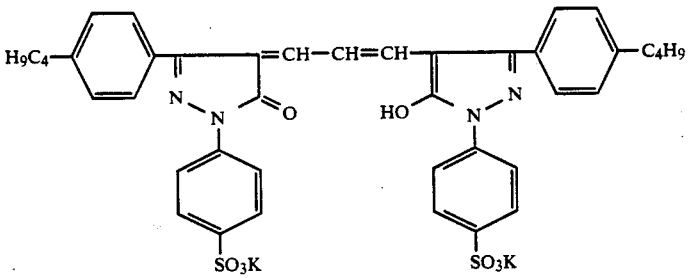
VII-14
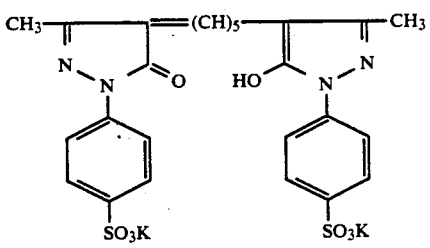
VII-15
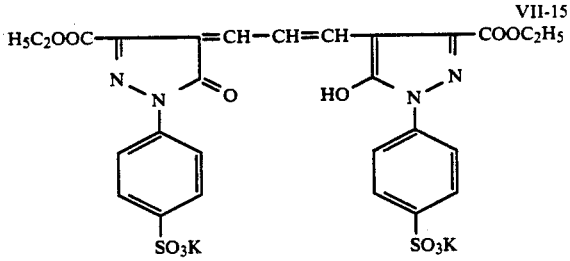
VII-16
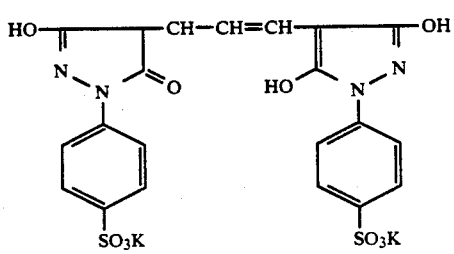
VII-17
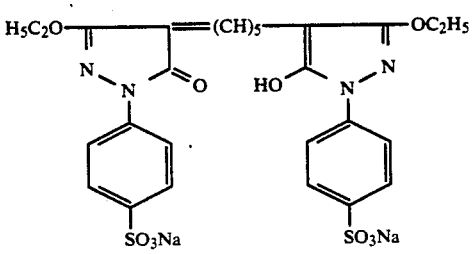

-continued
VII-18
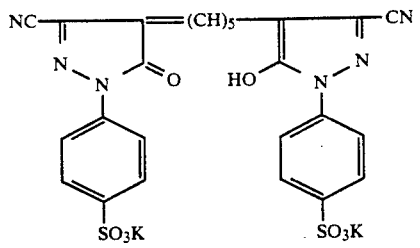
VII-19
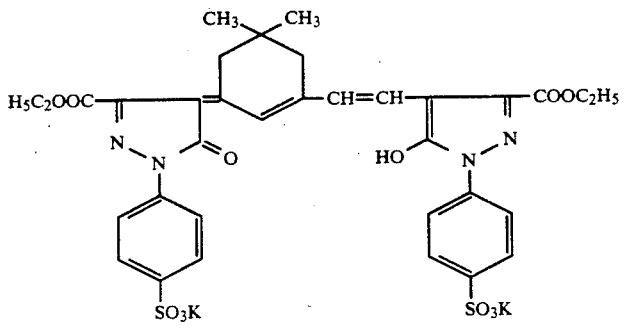
VII-20
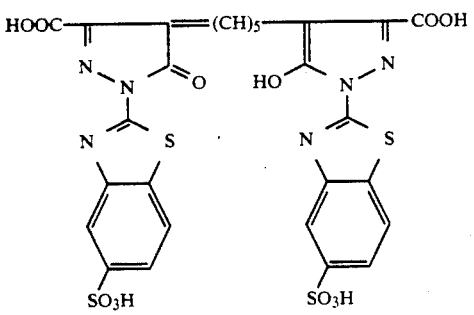
VII-21
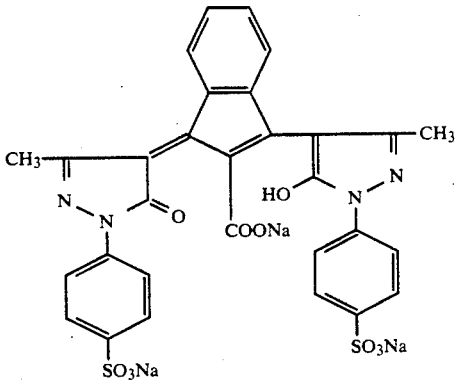
VII-22
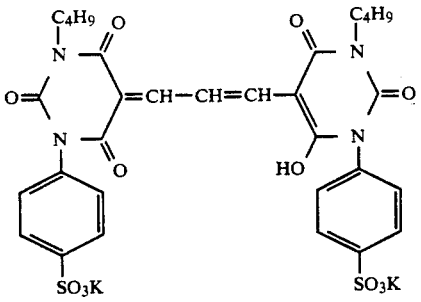
VII-23
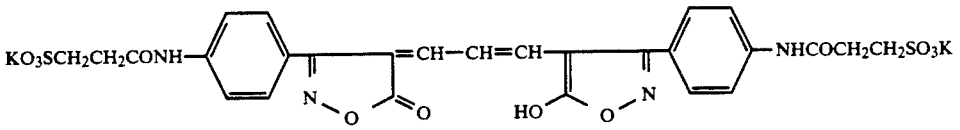
VII-24
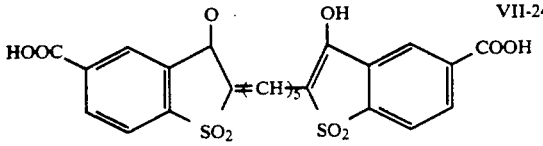
VII-25
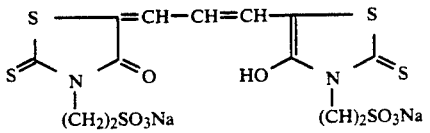

-continued
VII-26
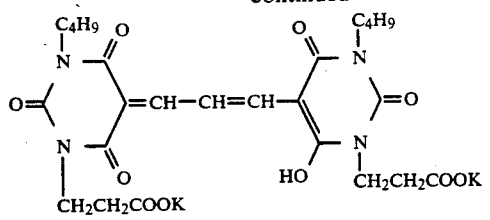
VII-27
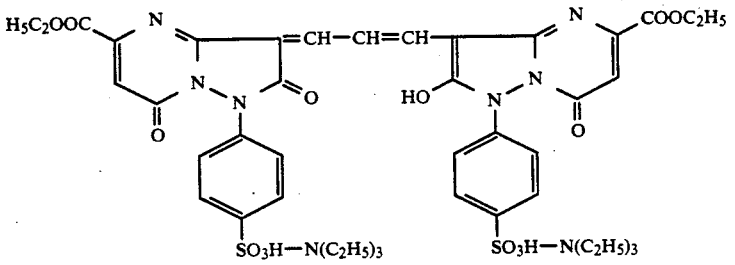
VII-28
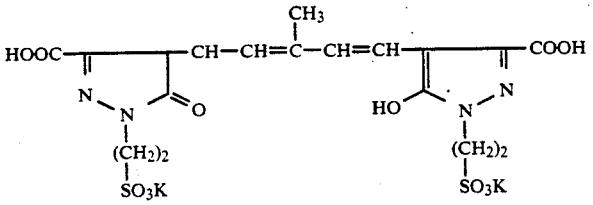
VII-29
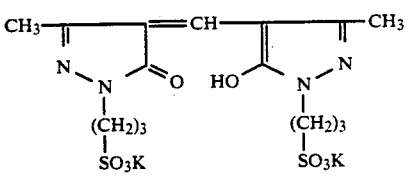
VII-30
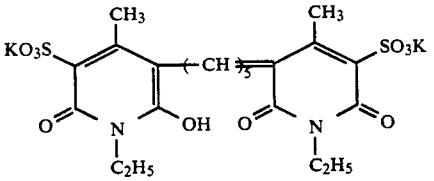
VII-31
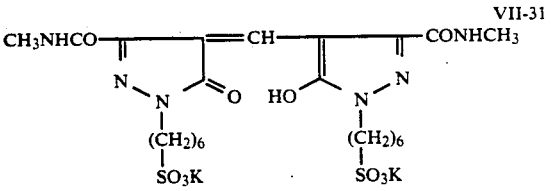
VII-32
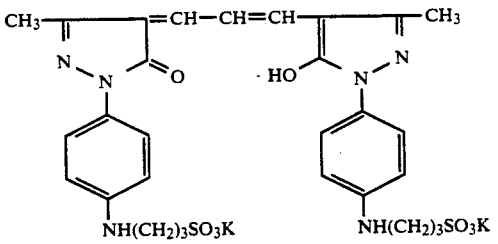
VII-33
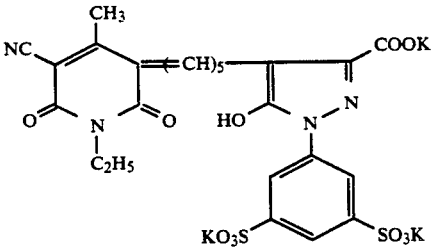
VII-34
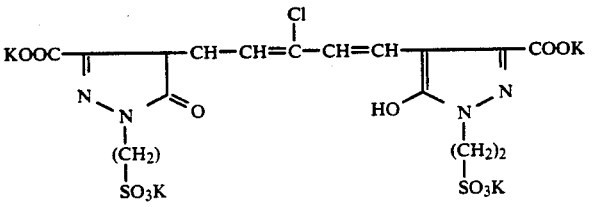

-continued
VII-35
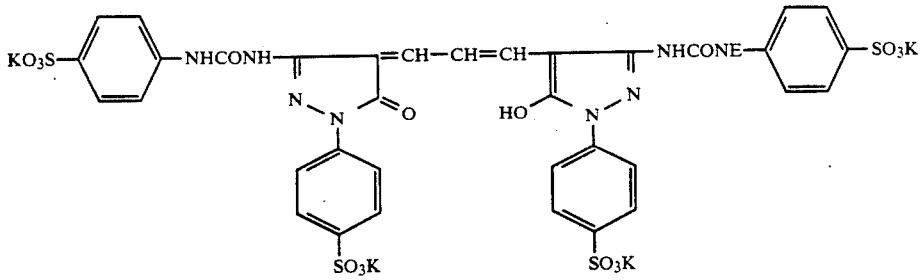
VII-36
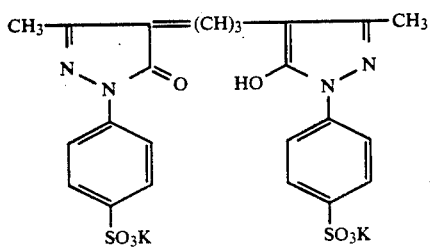
VII-37
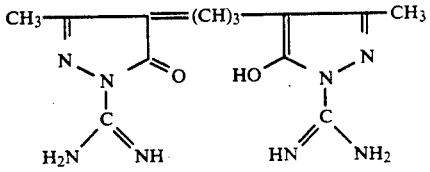
VII-38
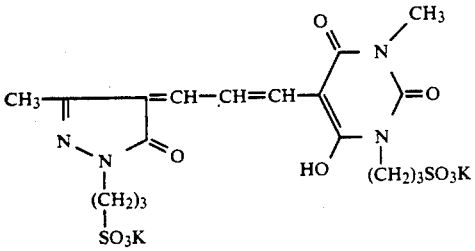
VII-39
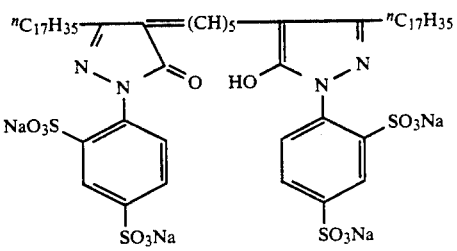
VII-40
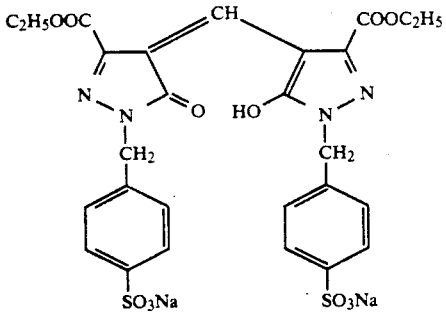
VII-41
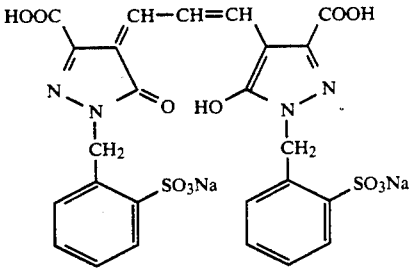
VII-42
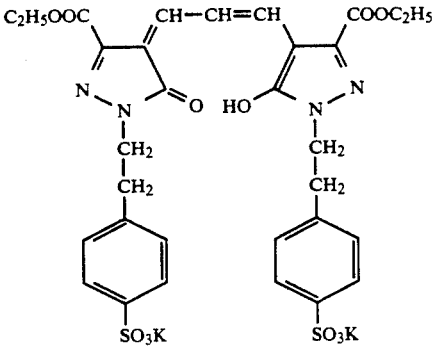

-continued
VII-43
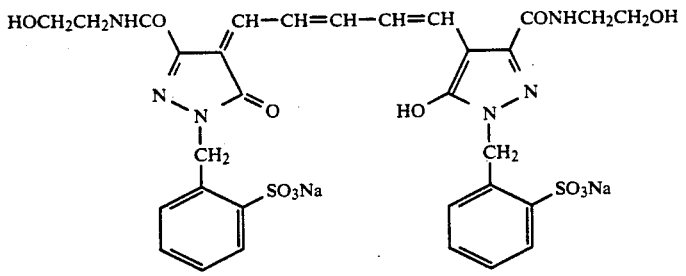
VIII-1
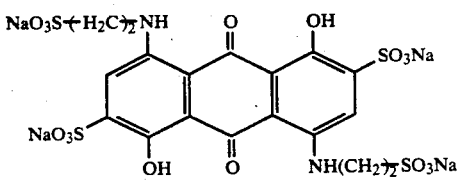
VIII-2
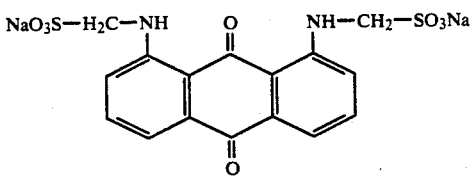
VIII-3
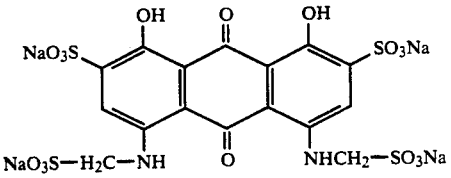
VIII-4
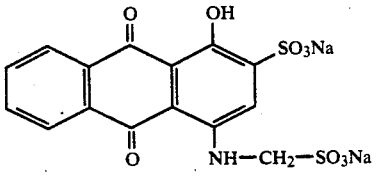
VIII-5
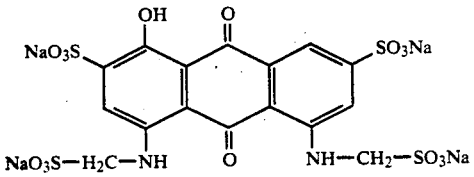
VIII-6
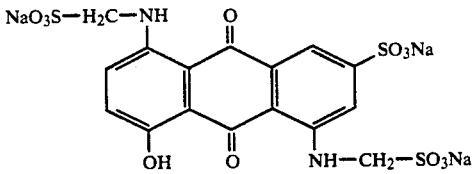
VIII-7
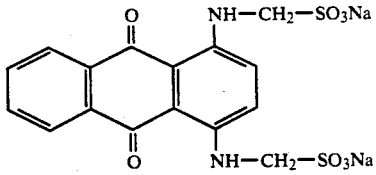
VIII-8
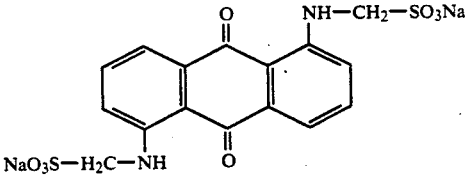
VIII-9
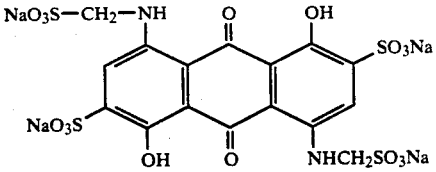
VIII-10
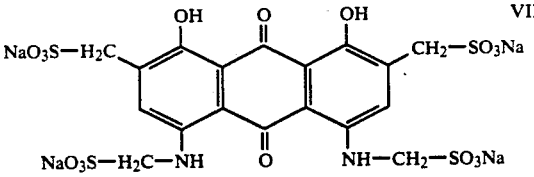
VIII-11
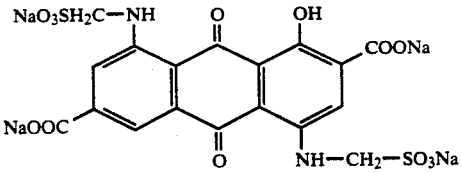
VIII-12
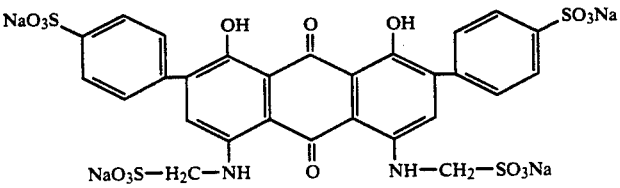

-continued
VIII-13
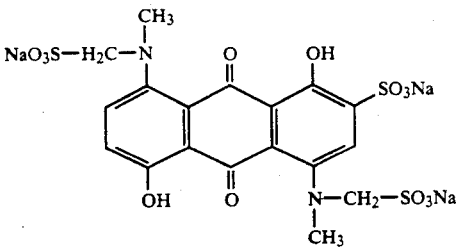
VIII-14
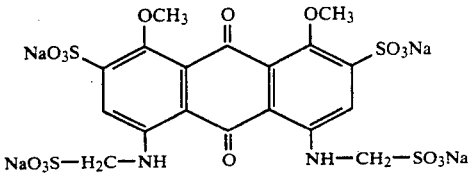
VIII-15
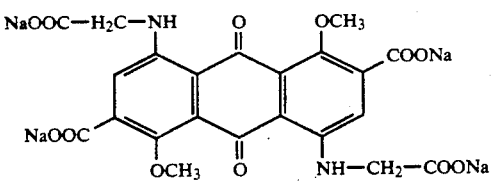
VIII-16
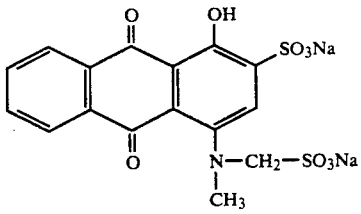
VIII-17
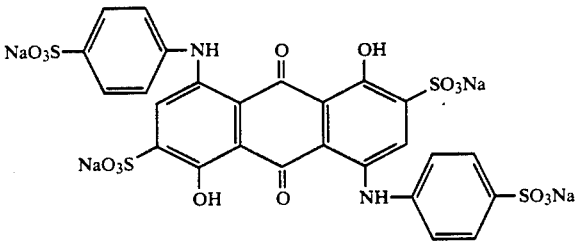
VIII-18
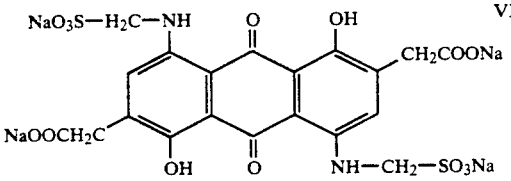
VIII-19
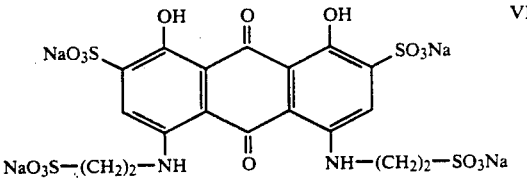
VIII-20
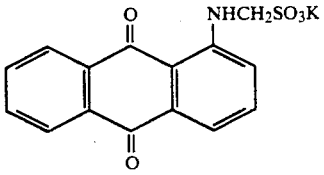
VIII-21
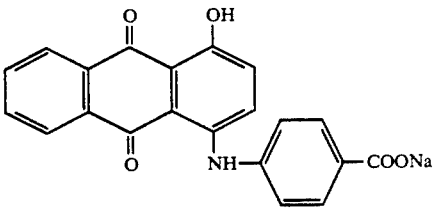
VIII-22
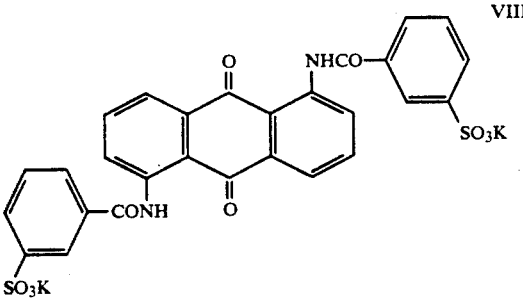
VIII-23
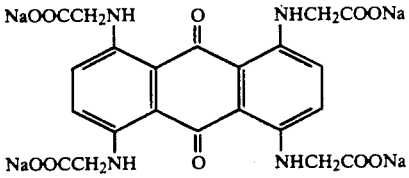
IX-1
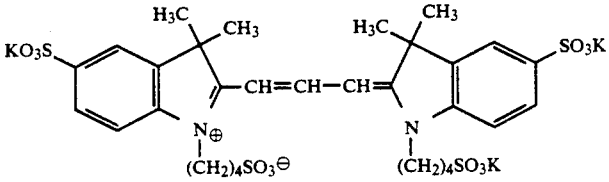

-continued
IX-2
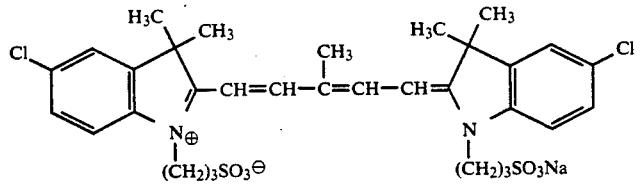
IX-3
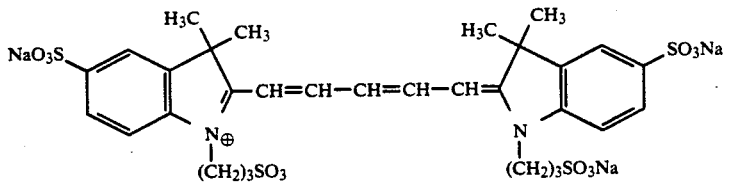
IX-4
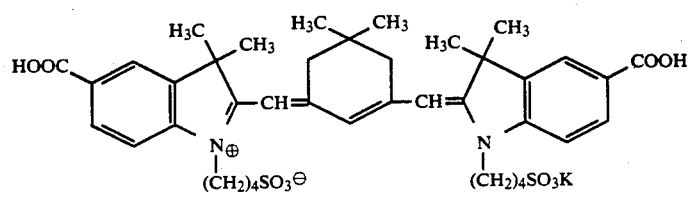
IX-5
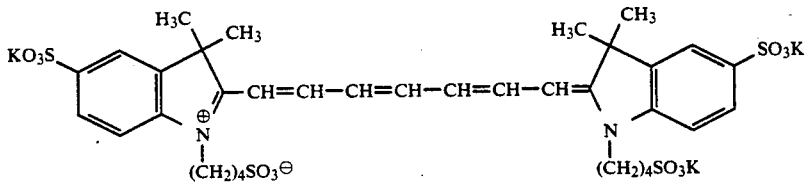
IX-6
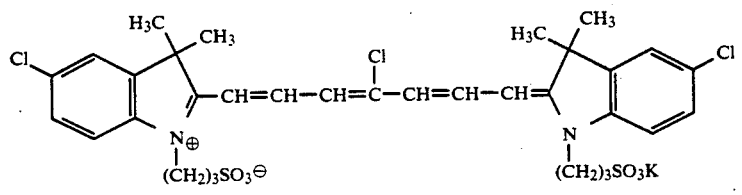
IX-7
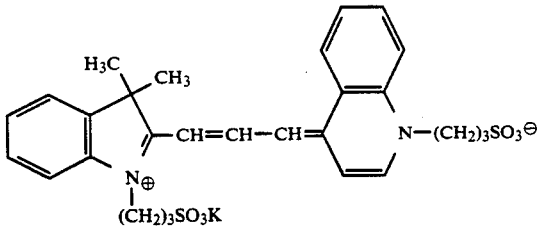
IX-8
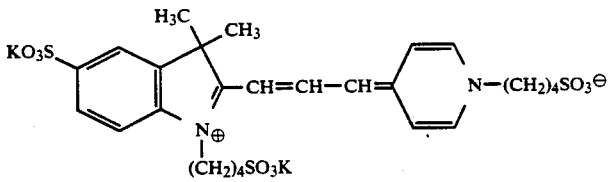
IX-9
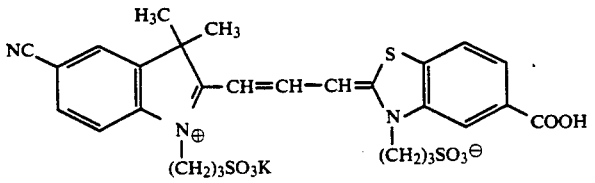

-continued
IX-10
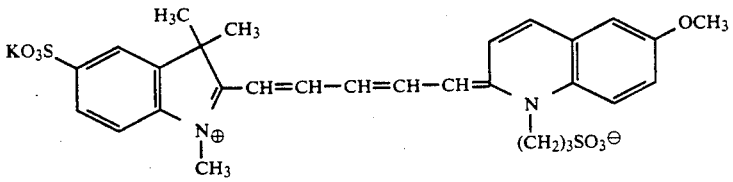
IX-11
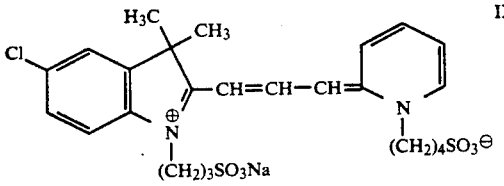
IX-12
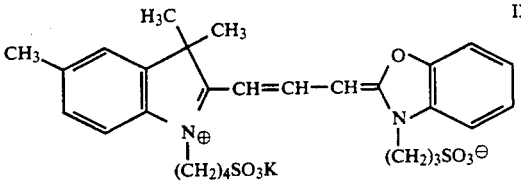
IX-13
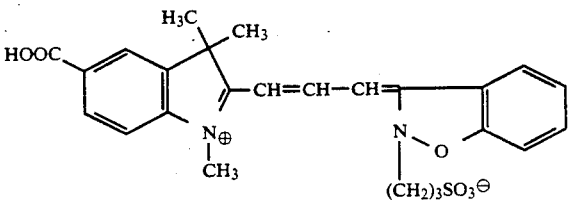
IX-14
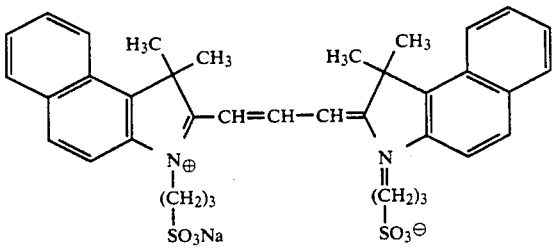
IX-15
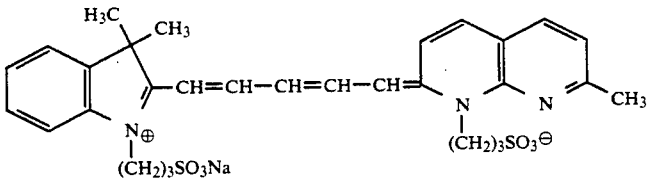
IX-16
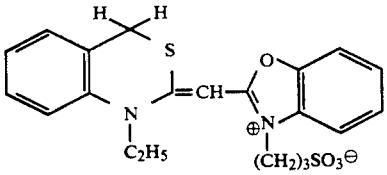
IX-17
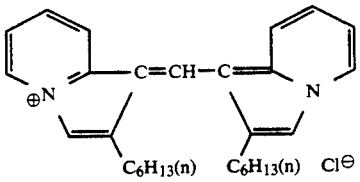
IX-18
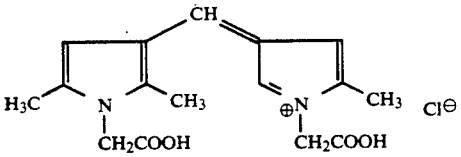
IX-19
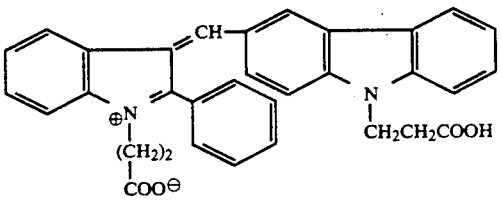
IX-20
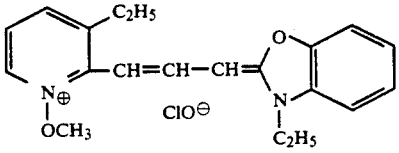

-continued
IX-21
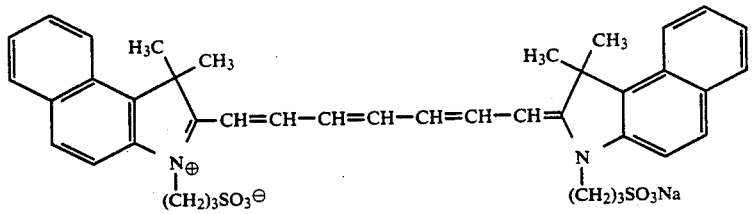
IX-22
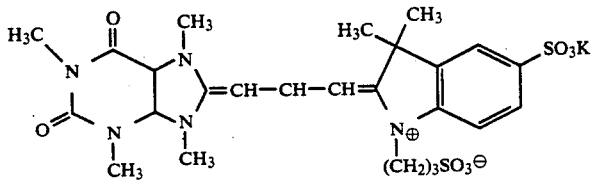
IX-23
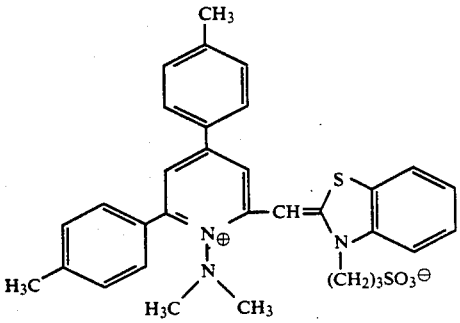
IX-24
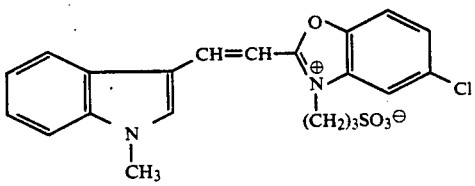
IX-25
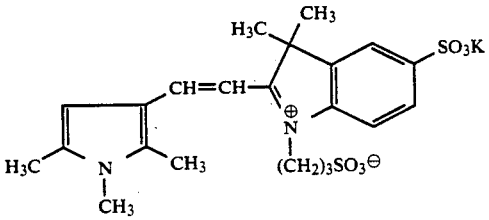
IX-26
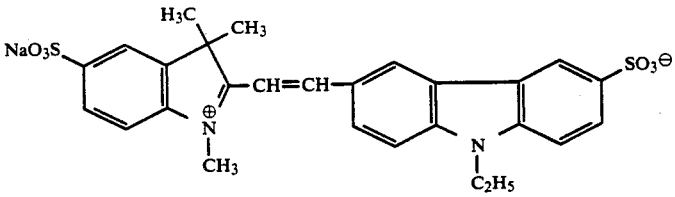
IX-27
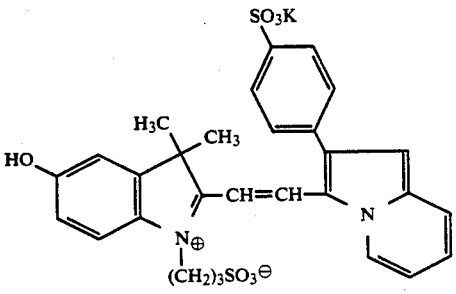
IX-28
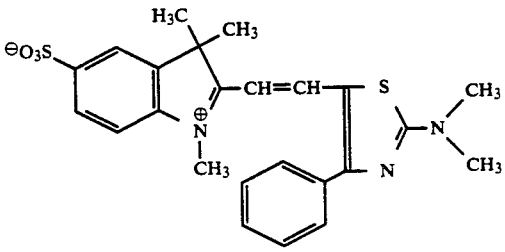

-continued

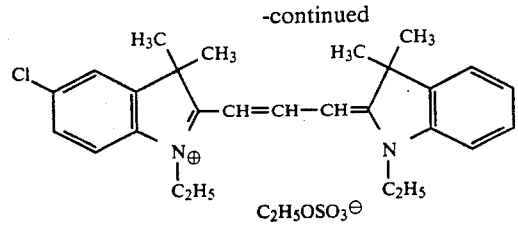

IX-29

As the binder or the protection colloid for use in the emulsion layer of the light-sensitive material of the present invention, gelatin is advantageously used, but other hydrophilic colloids can also be used alone or together with gelatin.

The gelatin for use in the present invention may be treated with lime or acid. Details for the method of preparing gelatin are described in *The Macromolecular Chemistry of Gelatin,* written by Authur Weise, (published by the Academic Press in 1964).

The "reflective support" for use in the present invention means a support in which the reflectivity of the support, is increased, thereby providing a sharper dye image as formed in the silver halide emulsion layer. Such a reflective support may include those prepared by coating, on a support, a hydrophobic resin containing a light reflective substance dispersed therein such as titanium oxide, zinc oxide, calcium carbonate and calcium sulfate, or the support itself may contain a hydrophobic resin containing light reflecting material dispersed therein. Examples of the reflective support for use in the present invention include, for example, baryta paper polyethylene coated paper, polypropylene type synthetic paper, a transparent support having thereon a reflection layer or incorporating a reflective substance therein, the transparent support being, for example, glass plate, polyester film such as of polyethylene terephthalate, cellulose triacetate or cellulose nitrate; polyamide film; polycarbonate film; polystyrene film or vinyl chloride resin, which may properly be selected depending on the intended purpose.

As the light reflective material, white pigment kneaded sufficiently in the presence of a surface active agent is preferred. Furthermore, the use of pigment particles, the surface of which is treated with 2 to 4 hydric alcohols, is preferred.

The area ratio (%) of fine white pigment particles per prescribed unit area can be determined, generally, by dividing an observed area into adjacent unit areas each of 6 $\mu m \times 6$ $\mu m$ and measuring the occupying area ratio (%) (Ri) of fine particles projected on the unit area. The variation coefficient of the area ratio (%) can be determined based on the ratio $s/\overline{R}$ of the standard deviation s for Ri to the average value ($\overline{R}$) for $R_1$. The number (n) of the unit areas as an object is preferably 6 or more. Accordingly, the variation coefficient $s/\overline{R}$ can be determined in accordance with the following equation.

$$\sqrt{\frac{\sum_{n=1}^{n} (Ri - R)^2}{n-1}} \Big/ \frac{\sum_{i=1}^{n} Ri}{n}$$

In the present invention, the variation coefficient of the area ratio of the fine pigment particles is preferably less than 0.15 and, particularly preferably, less than 0.12. If it is less than 0.08, the particles are considered to be dispersed in a substantially homogenous manner.

The silver halide color photographic light-sensitive material of the present invention is color developed to form a color image. The color development generally comprises the steps of color development, bleach-fixing and water washing (or stabilization).

In the present invention, the color developing solution necessarily contains chloride ion in a concentration of from $3.5\times10^{-2}$ to $1.5\times10^{-1}$ mol/l and bromide ion in a concentration of from $3.0\times10^{-5}$ to $1.0\times10^{-3}$ mol/l. Preferably, the chloride ion concentration is from $4.0\times10^{-2}$ to $1.0\times10^{-1}$ mol/l. If the chloride ion concentration is higher than $1.5\times10^{-1}$ mol/l, the development is retarded and a high contrast image is not obtained within a rapid processing time, thereby failing to attain the objective of the present invention. On the contrary, a chloride ion concentration lower than $3.5\times10^{-2}$ mol/l, is insufficient to suppress the sensitized streaks that would otherwise occur during processing and furthermore, the photographic properties fluctuate undesirably in continuous processing over an extended period of time. The photographic properties of interest in the present invention include fogging, sensitivity and maximum color density, etc. The more preferred value for the bromide ion concentration is from $5.0\times10^{-5}$ to $5.0\times10^{-4}$ mol/l. If the bromide ion concentration is higher than $1.0\times10^{-3}$ mol/l, the development is undesirably retarded. On the other hand, if the bromide ion concentration is lower than $3.0\times10^{-5}$ mol/l, it is insufficient to suppress the sensitized streaks that would otherwise occur during processing solution and the photographic properties fluctuate undesirably in continuous processing over an extended period of time. Additionally, a low bromide ion concentration results in insufficient desilvering in the bleach-fixing step thereby increasing the residual amount of silver, in the continuous processing.

The effect of the present invention is attained only when the color light-sensitive material having silver halide grains specified for use in the present invention is color developed by a developer containing chloride ion and bromide ion in the prescribed concentration prescribed in the present invention. Particularly, the method of the present invention provides and excellent color image forming system allowing stable, high quality color prints to be processed rapidly. This is a novel finding that could not be expected from the prior art.

In the present invention, to provide chloride ion and bromide ion each at the prescribed concentration in the developing solution, a compound dissociating these ions in the solution and/or the solution thereof may directly be added to the developing solution, or the chloride ion and bromide ion may be leached out from the light-sensitive material during development to provide, in part, the prescribed concentration.

For direct addition to the color developing solution, sodium chloride, potassium chloride, ammonium chloride, nickel chloride, magnesium chloride, manganese chloride, calcium chloride and cadmium chloride may be used as the chloride ion supplying material, sodium chloride and potassium chloride being preferred.

Furthermore, the chloride ion and bromide ion may be supplied in the form of a chloride or bromide salt of a brightening agent added to the developing solution. The bromide ion supplying material for use in the present invention includes sodium bromide, potassium bromide, ammonium bromide, lithium bromide, calcium bromide, magnesium bromide, manganese bromide, nickel bromide, cadmium bromide, cerium bromide and thallium bromide, potassium bromide and sodium bromide being preferred.

Where leaching from the light-sensitive material into the developing solution is employed, both of the chloride ion and the bromide ion may be supplied from an emulsion layer or supplied from other than the emulsion (e.g., the compounds other than the emulsion include a water soluble chloride, a water soluble bromide or a compound releasing a bromine ion by reacting with an alkali).

JP-A-63-106655 describes a method of treating a silver halide light-sensitive material containing at least 80 mol% silver chloride as the silver halide with a developing solution containing a chloride ion concentration of $2\times10^{-2}$ mol or more. However, in JP-A-62-106655, regarding the silver halide light-sensitive material, only the silver chloride content is defined, and the concentration of the bromide in the developing solution is out of the scope of the present invention and furthermore is silent with respect to the inherent effect obtained by the combination of an appropriate amount for each of bromide ion and chloride ion in the present invention. Moreover, JP-A-63-106655 does not disclose the problems or source thereof solved by the present invention.

The effect of the present invention of suppressing the fluctuation of the photographic properties in continuous processing due to the combination of chloride ion and bromide ion in accordance with the present invention cannot be explained merely by the high developing activity due to the use of the high silver chloride content emulsion and an increase of the developing activity due to the presence of the bromide ion and the chloride ion. Each in an appropriate amount, that is, highly active and highly suppressing type development is attributable to the suppression for the fluctuation of the photographic property. The "photographic properties" as described herein include fogging, relative sensitivity and maximum color density, etc. The significance of the combination of the bromide ion and the chloride ion in the range of concentration of the present invention will become apparent by the examples of the present invention presented below.

In the present invention, sulfite ions are preferably substantially not contained in the color developing solution to promote stability in continuous processing and to prevent streak-like pressure fogging. However, the developing solution cannot be used for a long period of time by the degradation of the developing solution used repeatedly. In order to prevent air oxidation of the developing solution, physical means may be employed such as the use of a floating cover or reducing the open area of the developing tank, or chemical means may be employed such as reducing the temperature of the developing solution or adding an organic preservative. Among them, the use of an organic preservative is advantageous for simplicity.

The organic preservative for addition to the developer for use in the present invention is an organic compound that reduces the degradation rate of the aromatic primary amine color developer. The organic preservative includes organic compounds which prevent the air oxidation of the color developing agent and, among all, hydroxylamine derivatives (excluding hydroxylamine here and hereinafter), hydroxamic acids, hydrazines, hydrazides, phenols, α-hydroxy ketones, α-amino ketones, saccharides, monoamines, diamines, polyamines, quarternary ammonium salts, nitroxy radials, alcohols, oximes, diamide compounds and condensed ring amines are particularly useful organic preservatives. Organic preservative for use in the present invention are disclosed, for example, in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, European Patent 25428A, JP-A-63-44657 and JP-A-63-44656, U.S. Pat. Nos. 3,615,503 and 2,494,903 and JP-A-52-143020 and JP-B-48-30496.

General formulae and exemplary compounds for the preferred organic preservatives are set forth below, but the present invention is not limited thereto.

The amount of the following organic preservative compounds to be added to the color developing solution is preferably from 0.005 mol/l to 0.5 mol/l, and more preferably, from 0.03 mol/l to 0.1 mol/l.

In particular, the addition of a hydroxylamine derivative and/or hydrazine derivative is preferred.

The hydroxylamine derivative represented by formula (X) is preferred:

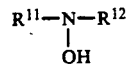

(X)

wherein $R^{11}$ and $R^{12}$ represent each a hydrogen atom, a substituted or unsubstituted alkyl group having preferably 1 to 10 carbon atoms, substituted or unsubstituted alkenyl group having preferably 1 to 10 carbon atoms, substituted or unsubstituted aryl group having preferably 6 to 15 carbon atoms or heterocyclic aromatic group, with the proviso that $R^{11}$ and $R^{12}$ cannot both be hydrogen atoms. $R^{11}$ and $R^{12}$ may join to form a hetero ring together with a nitrogen atom. The structure of the hetero ring is 5- or 6-membered ring, which may be further saturated or unsaturated, and having ring members selected from carbon atoms, hydrogen atoms, halogen atoms, oxygen atoms, nitrogen atoms, sulfur atoms, etc.

$R^{11}$ and $R^{12}$ are preferably an alkyl or alkenyl group having from 1 to 10 carbon atoms and more preferably, 1 to 5. As the nitrogen-containing heterocyclic ring formed with $R^{11}$ and $R^{12}$ includes a piperidyl group, pyrrolidyl group, N-alkylpiperadyl group, morpholyl group, indolinyl group, benzotriazol group, etc.

Preferred substituents for $R^{11}$ and $R^{12}$ include hydroxy group, alkoxy group, alkyl or aryl sulfonyl group, amide group, carboxy group, cyano group, sulfo group, nitro group and amino group.

Nonlimiting examples of the compound (X) are shown below.

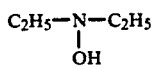

X-1

-continued

X-2 $CH_3OC_2H_4-N(OH)-C_2H_4-OCH_3$

X-3 $C_2H_5OC_2H_4-N(OH)-CH_2-CH=CH_2$

X-4 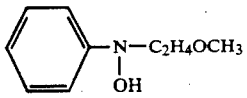

X-5 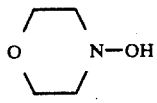

X-6 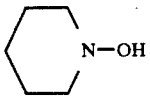

X-7 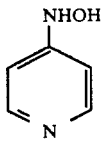

X-8 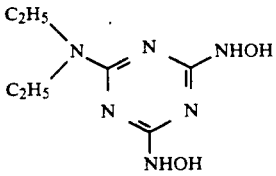

As hydrazines and hydrazides, the followings are preferred:

(XI) 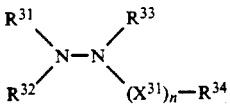

wherein $R^{31}$, $R^{32}$ and $R^{33}$ represent each a hydrogen atom, a substituted or unsubstituted alkyl group having preferably 1 to 10 carbon atoms, aryl group having preferably 6 to 15 carbon atoms or heterocyclic group, $R^{34}$ represents a hydroxy group, a hydroxyamino group, substituted or unsubstituted alkyl group having preferably 1 to 10 carbon atoms, aryl group having preferably 6 to 15 carbon atoms, heterocyclic group, alkoxy group having from 1 to 10 carbon atoms, aryloxy group having preferably 6 to 15 carbon atoms, carbamoyl group and amino group. The heterocyclic group is a 5- or 6-membered ring which may be saturated or unsaturated and constituted with C, N, O, N, S and halogen atoms. $X^{31}$ represents a bivalent group selected from —CO—, $—SO_2—$or $$-\overset{\overset{NH}{|}}{C}-,$$

and n represents 0 or 1. In particular when n=0, $R^{34}$ represents a group selected from alkyl group, aryl group and heterocyclic group and $R^{33}$ and $R^{34}$ may join together to form a heterocyclic ring.

$R^{31}$, $R^{32}$ and $R^{33}$ in the formula (XI) is preferably, hydrogen atom or alkyl group having 1 to 10 carbon atoms and it is most preferred that $R^{31}$ and $R^{32}$ are hydrogen, atoms.

$R^{34}$ in the formula (XI) is, preferably, an alkyl group, aryl group, alkoxy group, carbamoyl group and amino group. Particularly preferably, it is an alkyl group or substituted alkyl group. Preferred substituent for the alkyl group is, for example, a carboxyl group, sulfo group, nitro group, amino group and phosphono group. $X^{31}$ is preferably, —CO—or $SO_2$ and, most preferably, —CO—.

Nonlimiting examples of the compound represented by formula (XI) are shown below.

XI-1 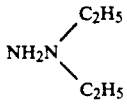

XI-2 $NH_2NH(CH_2)_4SO_3H$

XI-3 $NH_2NH(CH_2)_2OH$

XI-4 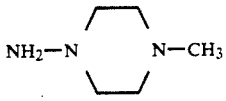

XI-5 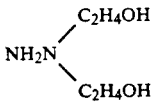

XI-6 $NH_2NHCOCH_3$

XI-7 $NH_2NHCOOC_2H_5$

XI-8 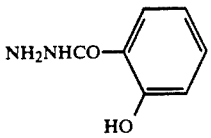

XI-9 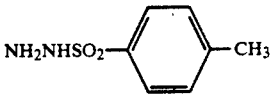

XI-10 $NH_2NHCONH_2$

XI-11 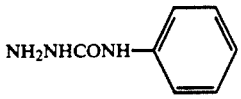

XI-12 $NH_2NHSO_3H$

XI-13 $NH_2NHC(=NH)NH_2$

XI-14 $NH_2NHCOCONHNH_2$

XI-15 $NH_2NHCH_2CH_2CH_2SO_3H$

-continued

XI-16

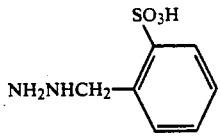

XI-17

$NH_2NHCH(C_4H_9(n))COOH$

XI-18

$NH_2NHCH_2CH_2COOH$

XI-19

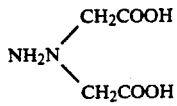

XI-20

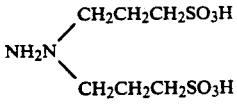

XI-21

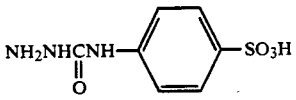

XI-22

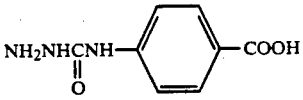

Combined use of the compound represented by formula (X) or (XI) and the amines represented by formulae (XII) or (XIII) is preferred for improving the stability of the color developing solution and, thus, for improving stability of the continuous processing.

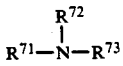

(XII)

wherein $R^{71}$, $R^{72}$ and $R^{73}$ each represent a hydrogen atom, an alkyl group having preferably 1 to 10 carbon atoms, an alkenyl group having preferably 1 to 10 carbon atoms, aryl group having preferably 6 to 15 carbon atoms, aralkyl group having preferably 7 to 15 carbon atoms or heterocyclic group. $R^{71}$ and $R^{72}$, $R^{71}$ and $R^{73}$, $R^{72}$ and $R^{73}$ may be joined together to form a nitrogen-containing heterocyclic ring.

$R^{71}$, $R^{72}$ and $R^{73}$ may be substituted. Hydrogen atom and alkyl group are particularly preferred for $R^{71}$, $R^{72}$ and $R^{73}$. The substituents for $R^{71}$, $R^{72}$ and $R^{73}$ include, for example, hydroxyl group, sulfo group, carboxyl group, halogen atom, nitro group, amino group, etc.

Nonlimiting examples of the compound of the formula (XII) are shown below.

XII-1 $N(CH_2CH_2OH)_3$

XII-2 $H_2NCH_2CH_2OH$

XII-3 $HN(CH_2CH_2OH)_2$

XII-4 $C_7H_{15}N(CH_2CH(OH)CH_2OH)_2$

-continued

XII-5

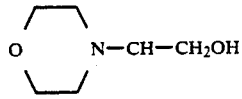

XII-6

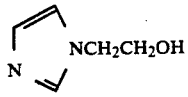

XII-7

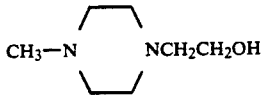

XII-8

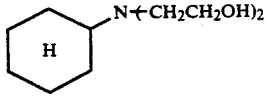

XII-9

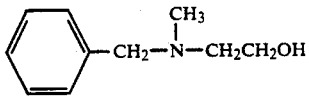

XII-10 $(HOCH_2CH_2)_2NCH_2CH_2SO_2CH_3$

XII-11 $HN(CH_2COOH)_2$

XII-12 $HOOCCH_2CH_2CH(NH_2)COOH$

XII-13 $H_2NCH_2CH_2SO_2HN_2$

XII-14

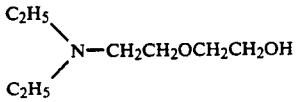

XII-15 $H_2N-C(CH_2OH)_2$

XII-16 $HOCH_2CH(NH_2)COOH$

XII-17

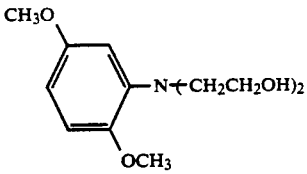

XII-18

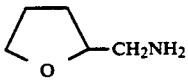

XII-19

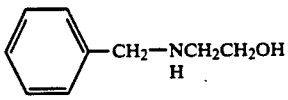

XII-20

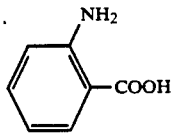

-continued (XIII)

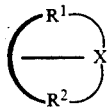

wherein X represents a trivalent atomic group necessary for completing a condensed ring and $R^1$ and $R^2$ each represent an alkylene group having preferably 1 to 10 carbon atoms, arylene group having preferably 6 to 15 carbon atoms, alkenylene group having preferably 2 to 10 carbon atoms or aralkylene group having preferably 7 to 15 carbon atoms.

$R^1$ and $R^2$ may be the same or different.

Particularly preferred compounds of the formula (XIII) are those compounds represented by formulae (XIII-a) and (XIII-b):

(XIII-a)

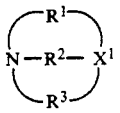

where $X^1$ represents

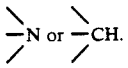

$R^1$ and $R^2$ have the same meaning as in the formula (XIII) and $R^3$ is the same as $R^1$ and $R^2$, or is the group

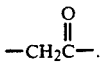

In the formula (XIII-a), $X^1$ is preferably,

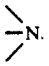

$R^1$, $R^2$ and $R^3$ each preferably have from 1 to 6 carbon atoms, more preferably not more than 3 and most preferably not more than 2 carbon atoms.

$R^1$, $R^2$ and $R_3$ are preferably an alkylene group or arylene group, and most preferably an alkylene group.

(XIII-b)

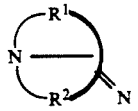

where $R^1$ and $R^2$ have the same meaning as in the formula (XIII).

In the formula (XIII-b), $R^1$ and $R^2$ each preferably have from 1 to 6 carbon atoms. $R^1$ and $R^2$ are preferably an alkylene group or arylene group and, most preferably, an alkylene group.

Among the compounds of the formulae (XIII-a) and (XIII-b), the compounds represented by formula (XIII-a) are particularly preferred.

Nonlimiting example of the compound of general formula (XIII) are shown below.

XIII-1

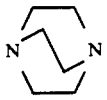

XIII-2

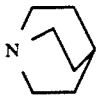

XIII-3

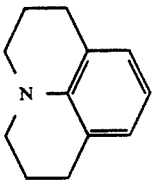

XIII-4

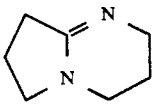

XIII-5

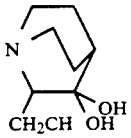

XIII-6

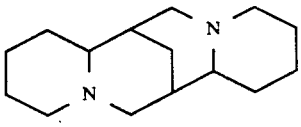

XIII-7

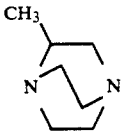

XIII-8

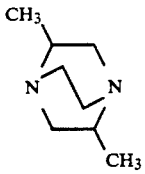

XIII-9

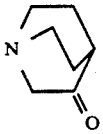

XIII-10

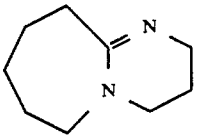

-continued

XIII-11

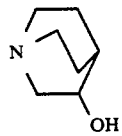

XIII-12

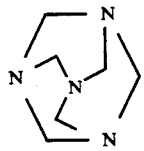

XIII-13

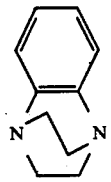

XIII-14

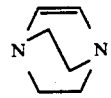

XIII-15

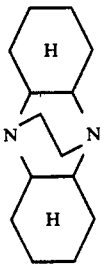

XIII-16

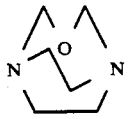

XIII-17

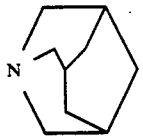

XIII-18

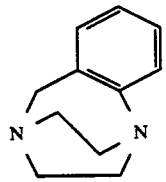

The organic preservatives described above are available as commercial products and, in addition, they can also be synthesized by the methods as described in JP-A-62-124038 and JP-A-62-24374.

The color developing solution for use in the present invention is described below.

The color developing solution for use in the present invention contains a known aromatic primary amine color developing agent. A preferred example is p-phenylene diamine and typical examples are shown below with no particular restriction to the use thereof.

D-1 N,N-diethyl-p-phenylenediamine

D-2 4-(N-ethyl-N-(β-hydroxyethyl)amino)aniline

D-3 2-methyl-4-(N-ethyl-N-(β-hydroxyethyl)amino)-aniline

D-4 4-amino-3-methyl-N-ethyl-N-(β-methanesulfonamidoethyl)aniline

The p-phenylenediamine derivative may be a salt, for example, a sulfate, hydrochloride or p-toluene sulfonate. The addition amount of the aromatic primary amine developing agent is preferably from about 0.1 to 20 g, and more preferably, from about 0.5 to 10 g per liter of the color developing solution.

The pH of the color developing solution for use in the present invention is preferably from 9 to 12, and more preferably from 9 to 11.0. Furthermore compounds commonly present in the color developing solution can be incorporated into the color developing solution of the present invention.

For maintaining the pH, various buffers may preferably be used including, for example, sodium carbonate, potassium carbonate, sodium hydrogen carbonate, potassium hydrogen carbonate, trisodium phosphate, tripotassium phosphate, disodium phosphate dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate}.

The addition amount of the buffer to the color developing solution is, preferably, not less than 0.1 mol/l and particularly preferably, from 0.1 mol to 0.4 mol/l.

In addition, various chelating agents may be added to the color developing solution as a precipitation inhibitor for calcium or magnesium or for the improvement of the stability of the color developing solution.

Nonlimiting examples are shown below with no particular restriction to the use thereof, nitrilotriacetic acid, diethylenetriamine pentaacetic acid, ethylenediamine tetraacetic acid, triethylenetetramine hexaacetic acid, N,N,N-trimethylenephosphonic acid, ethylenediamine-N,N,N',N'-tetramethylene phosphonic acid, 1,3-diamino-2-propanol tetraacetic acid, transcyclohexanediamine tetraacetic acid, nitrilotripropionic acid, 1,2-diaminopropane tetraacetic acid, hydroxyethylimino diacetic acid, glycol ether diamine tetraacetic acid, hydroxyethylenediamine triacetic acid, ethylene diamino-o-hydroxyphenylacetic acid, butane-1,2,4-tricarboxylic acid, 1-hydroxyethylidene-1,1-diphosphonic acid, N,N'-bis-(2-hydroxybenzyl)ethylenediamine-N,N'-diacetic acid, catechol-3,4,6-trisulfonic acid, catechol-3,5-disulfonic acid, 5-sulfosalicylic acid and 4-sulfosalicylic acid.

The chelating agents may be used in combination as necessary.

The chelating agents are added in such an amount as to be sufficient to chelate metal ions in the color developing solution, the concentration generally being about from 0.1 g to 10 g per one liter of the color developing solution.

Developing accelerators can be added as necessary to the color developing solution.

Developing accelerators for adding to the color developing solution include, for example, the thioether type compounds described in JP-B-37-16088, JP-B-37-5987, JP-B-38-7826, JP-B-44-12380 and JP-B-45-9019 and U.S. Pat. No. 3,813,247; the p-phenylenediamine compounds described in JP-A-52-49829 and JP-A-50-1555;, the quarternary ammonium salt described in JP-A-50-137726, JP-B-44-30074, and JP-A-56-156826 and JP-A-52-43429; the p-aminophenols described in U.S. Pat. Nos. 2,010,122 and 4,119,462; the amine compound described in U.S. Pat. Nos. 2,494,903, 3,128,182, 4,230,796 and 3,253,919, JP-B-41-11431 and U.S. Pat. Nos. 2,482,546, 2,596,926 and 3,582,346; the polyalkylene oxide described in JP-B-37-16088 and JP-B-42-25201, U.S. Pat. No. 3,128,183, JP-B-41-11431 and JP-B-42-23883 and U.S. Pat. No. 3,532,501, as well as 1-phenyl-3-pyrazolidones, hydrazines, meso-ion type compounds, ion type compounds and imidazoles.

The color developing solution for use in the present invention does not substantially contain benzyl alcohol. Herein, "substantially not containing" means that the color developing solution contains 2.0 ml or less of benzyl alcohol per liter, or more preferably, does not contain any benzyl alcohol. If the color developing solution does not substantially contain benzyl alcohol, the fluctuation of photographic properties is reduced in continuous processing and preferred results are obtained.

In the present invention, any desired antifoggant can be added to the color developing solution in addition to chloride ion and bromide ion. As the antifoggant, an alkali metal halide such as potassium iodide and organic antifoggants can be used. Organic antifoggants for use in the color developing solution include, for example, nitrogen-containing heterocyclic compounds such as benzotriazole, 6-nitrobenzoimidazole, 5-nitroisoindazole, 5-methylbenzotriazole, 5-nitrobenzotriazole, 5-chlorobenzotriazole, 2-thiazolyl-benzoimidazole, 2-thiazolylmethylbenzoimidazole, indazole, hydroxyazaindolydine and adenine.

The color developing solution for use in the present invention preferably contains a brightening agent. As the brightening agent, a 4,4'-diamino-2,2'-disulfostilbene type compound is preferred. The addition amount is from 0 to 10 g/l, and preferably, from 0.1 to 6 g/l.

Further, various surface active agents such as alkylsulfonic acid, arylphosphonic acid, aliphatic carboxylic acid and aromatic caroxylic acid may be added as necessary.

The processing temperature of the color developing solution of the present invention is from 20° to 50° C. and preferably, from 30° to 40° C. The processing time is from 20 sec to 5 min and preferably, from 30 sec to 2 min.

Generally, the developing solution is replenished in the color development. The replenishing amount varies depending on the light sensitive material to be processed, and is generally from about 180 to 1000 ml per square meter of the light-sensitive material. In continuous processing using an automatic developing apparatus, etc., replenishing serves for refreshing the color developing solution in order to avoid a change in the development properties due to a change in the concentration of the ingredients. Since replenishment inevitably results in a great amount of overflow solution, the replenishing amount of replenisher is preferably reduced in view of economy and environmental factors. Preferred replenishing amount is from 20 to 150 ml per 1 $m^2$ of the light-sensitive material. While somewhat different depending on the light-sensitive material, 20 ml of the replenishing amount of replenisher per 1 $m^2$ of the light-sensitive material is an amount about equal to the amount being carried out from the developing tank by the light-sensitive material such that overflow does not occur. The present invention is effective at such low replenishing amounts.

In accordance with the method of the present invention, desilvering is carried out after the color development. The desilvering step generally comprises a bleaching step and a fixing step and it is particularly preferred that the bleaching and fixing be conducted together in a single operation.

The bleaching solution or bleach-fixing solution for use in the present invention may contain re halogenating agent such as bromide (e.g., potassium bromide, sodium bromide and ammonium bromide), chloride (e.g., potassium chloride, sodium chloride and ammonium chloride), iodide (e.g., ammonium iodide), etc.

If desired, one or more of organic acids, inorganic acids or alkali metal or ammonium salt thereof having a pH buffering function may be added such as boric acid, borax, sodium metaborate, acetic acid, sodium acetate, sodium carbonate, potassium carbonate, phosphorous acid, phosphoric acid, sodium phosphate, citric acid, sodium citrate and tartaric acid. A corrosion inhibitor such as ammonium nitrate or guanidine may also be added.

The fixing agent for use in the bleach-fixing solution or fixing solution of the present invention may be a conventional fixing agent including a thiosulfate such as sodium thiosulfate and ammonium thiosulfate; a thiocyanate such as sodium thiocyanate and ammonium thiocyanate; a thioether compound such as ethylene bisthioglycolic acid and 3,6-dithio-1,8-octane diol and a water-soluble silver halide dissolving agent such as thiourea, which may be used alone or in combination. Furthermore, a specific bleach-fixing solution comprising a combination of a fixing agent and a large amount of a halide such as potassium iodide as described in JP-A-55-155354 may also be used. In the present invention, use of thiosulfate, particularly, ammonium thiosulfate is preferred. The amount of the fixing agent per liter of the bleach-fixing solution or fixing solution is preferably from 0.3 to 2 mol and, more preferably from 0.5 to 1.0 mol.

The pH range for the bleach-fixing solution or fixing solution of the present invention is preferably from 3 to 10 and more preferably, from 5 to 9. If pH is lower than the above specified range, degradation of the solution and leuconization of cyan dye are accelerated, although the desilvering property is improved. On the other hand, if the pH value is higher than the above range, desilvering is retarded and stains are liable to occur.

For adjusting pH, chloric acid, nitric acid, acetic acid, hydrogen carbonate, ammonia, potassium sulfate, sodium hydroxide, sodium carbonate, potassium carbonate, etc. may be added to the bleach-fixing or fixing solution as necessary.

In addition, the bleach-fixing solution may further contain various brightening agents, defoamers or surface active agents, or organic solvents such as polyvinyl pyrrolidone and methanol.

The bleach-fixing solution or fixing solution of the present invention may contain, as a preservative, a sulfite ion releasing compound such as sulfite (e.g., sodium sulfite, potassium sulfite and ammonium sulfite), bisulfite (e.g., ammonium bisulfite, sodium bisulfite and potassium sulfite), metabisulfite (e.g., potassium metabisulfite, sodium metabisulfite and ammonium metabisulfite), etc. The concentration of sulfite ion is, preferably from about 0.02 to 0.50 mol/l and more preferably, from 0.04 to 0.40 mol/l based on the bleach-fixing or fixing solution as calculated in terms of sulfite ion.

As the preservative, sulfite is generally used and, in addition, ascorbic acid, carbonyl bisulfite adduct, sulfinic acids, carbonyl compounds, sulfinic acids, etc. may be used.

Furthermore, a buffer, brightening agent, chelating agent and mildew proofing agent, etc. may be added if desired.

The silver halide color photographic light-sensitive material of the present invention is generally processed through a water washing and/or stabilization step after the desilvering treatment.

The amount of washing water for use in the water washing step varies depending on the characteristics of the light-sensitive material (e.g., the coupler constituents) application, temperature of the washing water, number of water washing stages, the water replenishing system employed such as a countercurrent or cocurrent system and various other conditions. The relationship between the number of water stages and the amount of water for use in a multi-stage countercurrent system is determined by the method described in *Journal of the Society of Motion Picture and Television Engineers,* vol. 64, p. 248–253 (May, 1955).

Use of a multi-stage countercurrent system markedly reduces the amount of washing water, but results in problems such as the propagation of bacteria due to the increase of the residence time of the water in the washing tank, and the deposition of floating matter onto the light-sensitive material. In the processing of color light-sensitive material according to the present invention, the method of reducing calcium or magnesium as described in JP-A-62-288838 is used effectively. Furthermore, an isothiazolone compound or thiabendazoles may be added to the wash water in addition to the chlorine type sterilizers such as chlorinated sodium isocyanurate, as described in JP-A-57-8542, as well as fungicides such as benzotriazoles as described in *Chemistry for Anti-Bacterial and Anti-Mildew Agent,* written by Hiroshi Horiguchi, *Microorganism Controlling Sterilizing and Mildew Proofing Technology* edited by the Society of Sanitary Technology, *Bacteria Static And Mildew Proofing Encyclopedia,* edited by the Bacteria Static and Mildew Proofing Society of Japan.

The pH of the washing water for processing the light-sensitive material of the present invention is from 4 to 9 and preferably, from 5 to 8. The temperature for the washing water and water washing time varies depending on the characteristics and the application of the light-sensitive material, but is generally selected within the ranges, for example, of from 20 sec to 10 min at 15° to 45° C., and preferably, from 30 sec to 5 min at 25° to 40° C.

Furthermore, the light-sensitive material of the present invention can be directly processed with a stabilization solution in place of water washing. For stabilization processing, all of known methods can be used as described in JP-A-57-8543, JP-A-58-14834, JP-A-59-184343, JP-A-60-220345, JP-A-60-238832, JP-A-60-239784, JP-A-60-239749, JP-A-61-4054 and JP-A-61-118749. In particular, a stabilization bath containing 1-hydroxyethylidene-1,1-diphosphonic acid, 5-chloro-2-methyl-4-isothiazolin-3-one, bismuth compounds and ammonium compounds is preferred.

A stabilization step may further be carried out after the water washing. Such a stabilization bath includes, for example, a stabilization bath containing formaldehyde and a surface active agent which is carried out as a final bath of color light-sensitive material.

The time for the processing as used herein is the time from the contact of the light sensitive material with the color developing solution to the time of removal from the final bath, (generally, a water washing or stabilization bath). The effect of the present invention is remarkably attained in such a rapid processing system, where the time for the processing is 4 min and 30 sec or less and preferably, 4 min or less.

The present invention is explained with specific reference to the following Examples, but the present invention is not limited thereto.

EXAMPLE 1

After adding 32 g of lime-treated gelatin to 1000 ml of distilled water and dissolving the same at 40° C., 3.3 g of sodium chloride was added and the temperature was raised to 52° C. 3.2 ml of N,N'-di-methylimidazolidine-2-thione (1% aqueous solution) was added to the solution. Then, a solution containing 32.0 g of silver nitrate dissolved in 200 ml of distilled water and a solution containing 11.0 g of sodium chloride dissolved in 200 ml of distilled water were added and mixed to the above-described solution for 14 min while maintaining the temperature at 52° C. Furthermore, a solution containing 128.0 g of silver nitrate dissolved in 560 ml of distilled water and a solution containing 44.0 g of sodium chloride dissolved in 560 ml of distilled water were admixed for 20 min while maintaining the temperature at 52° C. One minute after the completion of the addition of the aqueous solution of silver nitrate and the aqueous solution, of sodium chloride, 286.7 mg of a pyridium salt of 2-(5-phenyl-2-(2-(5-phenyl-3-(2-sulfonate ethyl)benzooxazoline-2-ylidenemethyl)-1-butenyl)-3-benzooxazolio)ethane sulfonic acid was added. After maintaining the temperature for 15 min at 52° C., the temperature was lowered to 40° C. and desilvering and a water washing treatment were conducted. Furthermore, lime-treated gelatin was added to obtain an emulsion (A). The resulting emulsion contained cubic silver chloride grains having an average grain size of 0.45 μm, and a variation coefficient of the grain size distribution of 0.08.

Using the same procedures as in the preparation of emulsion (A) except for changing the aqueous solution of sodium chloride to be added together with the aqueous solution of silver nitrate to a mixed solution of sodium chloride and potassium bromide (in which the total number of mols of solute was the same, but wherein the molar ratio chloride to bromide was set at 98/2), to obtain a silver bromochloride emulsion (B) containing 2 mol% of silver bromide. The addition time for the reaction solution was controlled such that the average grain size of the silver halide grains contained in the emulsion was equal to that in the emulsion (A). The resulting grains were cubic and had a variation coefficient of the grain size of 0.08.

Using the same procedures as in the preparation of emulsion (A) except for changing the aqueous solution of sodium chloride to be added together with the aqueous solution of silver nitrate to a mixed solution of sodium chloride and potassium bromide (in which the total number of mols of solute was the same, but wherein the molar ratio chloride to bromide was set at 8/2), to obtain a silver bromochloride emulsion (C) containing 20 mol% of silver bromide. The addition time for the reaction solution was controlled such that the average grain size of the silver halide grains contained in the emulsion was equal to that in the emulsion (A). The resulting grains were cubic and had a variation coefficient of the grain size of 0.09.

After controlling the pH and pAg of the thus obtained three emulsions, optimal chemical sensitization was conducted respectively by adding triethyl thiourea to obtain emulsions (A-1), (B-1) and (C-1).

Separately, two types of fine grain silver bromide emulsions having an average grain size of 0.05 μm were prepared. Emulsion (a-1) did not contain a polyvalent metal impurity, while the other emulsion (a-2) contained potassium hexachloride iridium (IV) acid in an amount of $2.5\times10^{-5}$ mol per mol of silver bromide as impurity in the grains).

After adding the emulsion (a-1) in an amount corresponding to 2 mol% of silver halide to the emulsion (A), triethyl thiourea was added for optimal chemical sensitization, to prepare an emulsion (A-2).

An emulsion (a-2) was likewise used instead of the emulsion (a-1), to prepare an emulsion (A-3). To each of the five types of silver halide emulsions, the following compound was added as a stabilizer in an amount of $5.0\times10^{-4}$ mol per mol of the silver halide.

Stabilizer (I-1)

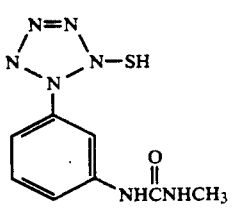

For the thus obtained five types of silver halide emulsions (i.e., (A-1), (A-2), (A-3), (B-1) and (C-1)), the halogen composition and distribution thereof were examined by X-ray diffraction method.

As a result, a single diffraction peak was shown, corresponding to 100% silver chloride for the emulsion (A-1), 98% silver chloride (2% silver bromide) for the emulsion (B-1) and 80% silver chloride (20% silver bromide) for the emulsion (C-1), respectively. On the other hand, a broad sub-peak having a center corresponding to 70% silver chloride (30% silver bromide) and trailing to about 60% silver chloride (40% silver bromide) was observed in addition to the main peak corresponding to 100% silver chloride for each of the emulsions (A-2) and (A-3).

Then, 10 g of magenta coupler (M-17), 3.9 g (Cpd-1) 2.9 g (Cpd-2) and 1.9 g (Cpd-3) of color image stabilizers were dissolved by adding 10 ml of ethyl acetate, 6.5 ml of solvent (Solv-1) and 6.5 ml of solvent (Solv-2). The solution was added to 150 ml of an aqueous 10% gelatin solution containing 8 ml of 10% sodium dodecylbenzene sulfonate and stirred vigorously to obtain an emulsified dispersion.

A coating solution was prepared by joining the thus obtained silver halide emulsion and the emulsified dispersion of the magenta coupler, which was coated together with a protective layer on a reflective paper support laminated both sides thereof with polyethylene, to prepare 5 types of light-sensitive materials of the composition shown in Table 1.

For the gelatin hardener in each of the layers, sodium 1-oxy-3,5-dichloro-s-triazine salt was used in an amount of 14.0 mg per gram of gelatin.

TABLE 1

| Layer/Content | Sample 101 | Sample 102 | Sample 103 | Sample 104 | Specimen 105 |
|---|---|---|---|---|---|
| Second Layer: (Protection layer) | | | | | |
| Gelation | | | 1.33 g/m² | | |
| Acrylic modified copolymer of polyvinyl alcohol (17% modification) | | | 0.17 g/m² | | |
| Liquid paraffin | | | 0.03 ml/m² | | |
| First Layer: (Green sensitive layer) | | | | | |
| Silver halide emulsion | A-1 | B-1 | C-1 | A-2 | A-3 |
| (Coating amount as silver) | 0.36 g/m² | 0.36 g/m² | 0.36 g/m² | 0.36 g/m² | 0.36 g/m² |
| Magenta coupler (M-17) | 0.31 g/m² | 0.31 g/m² | 0.31 g/m² | 0.31 g/m² | 0.31 g/m² |
| Color image stabilizer | | | | | |
| (Cpd-1) | 0.12 g/m² | 0.12 g/m² | 0.12 g/m² | 0.12 g/m² | 0.12 g/m² |
| (Cpd-2) | 0.09 g/m² | 0.09 g/m² | 0.09 g/m² | 0.09 g/m² | 0.09 g/m² |
| (Cpd-3) | 0.06 g/m² | 0.06 g/m² | 0.06 g/m² | 0.06 g/m² | 0.06 g/m² |
| Solvent | | | | | |
| (Solv-1) | 0.21 ml/m² | 0.21 ml/m² | 0.21 ml/m² | 0.21 ml/m² | 0.21 ml/m² |
| (Solv-2) | 0.21 ml/m² | 0.21 ml/m² | 0.21 ml/m² | 0.21 ml/m² | 0.21 ml/m² |
| Gelatin | 1.24 g/m² | 1.24 g/m² | 1.24 g/m² | 1.24 g/m² | 1.24 g/m² |

Paper support laminated with polyethylene on both sides (polyethylene on the side having the emulsion layer contains $TiO_2$ and a trace amount of ultramarine)

Color image stabilizer (Cpd-1)

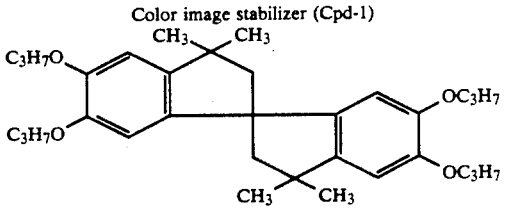

Color image stabilizer (Cpd-2)

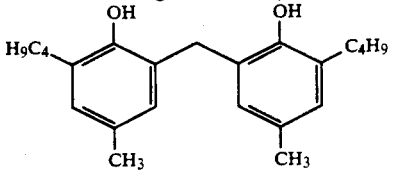

Color image stabilizer (Cpd-3)

-continued

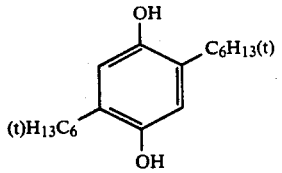

Solvent (Solv-1)

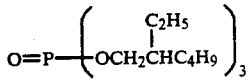

Solvent (Solv-2)

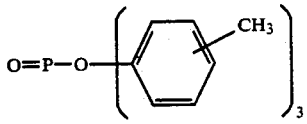

For evaluating the photographic properties of the coated samples, the following tests were carried out.

Each of the samples were gradation-exposed for sensitometry using a sensitometer (Model FWH, manufactured by Fuji Photo Film Co., color temperature of light source: 3200K) through a green filter and an optical wedge. The exposure amount was 250 CMS and the exposure time included exposures of 1/100, 1/10 and 10 sec.

After exposure, the samples were color developed in an automatic developing machine using the processing steps and processing solutions shown below, and the image density as a function of exposure amount was measured by a densitometer to obtain a characteristic curve. From the results, fog density, maximum color density and relative sensitivity were determined. The relative sensitivity is defined herein as a reciprocal of an exposure amount providing a density of 0.5 greater than the fog density, and is represented as a relative value taken as 100 for the sensitivity of the specimen 101.

Furthermore, for evaluating the fluctuation of the photographic properties, the same tests were also conducted for samples stored for two days under conditions of 60° C. and 60% RH to simulate the effect of storage over a long period of time. The exposure time for samples evaluated in this manner was set to 1/10 sec.

Furthermore, for evaluating the extent of sensitization when pressure is applied to the samples in the processing solution, the same color development was conducted to that for the previous samples after uniform exposure to provide a density of 0.8. After processing the number of sensitized streaks formed by the applied pressure were counted. The evaluation was based on the following four grades.

| Evaluation | Number of Sensitized Streaks (per 500 cm$^2$) |
|---|---|
| A | not found |
| B | 1–5 |
| C | 6–10 |
| D | 10 or more |

The results are shown in Table 2

| Processing Step | Temperature | Time |
|---|---|---|
| Color development | 38° C. | 45 sec |
| Bleach-fixing | 30–36° C. | 45 sec |
| Rinsing (1) | 30–37° C. | 30 sec |
| Rinsing (2) | 30–37° C. | 30 sec |
| Rinsing (3) | 30–37° C. | 30 sec |
| Drying | 70–88° C. | 60 sec |

| | |
|---|---|
| Color Developing Solution: | |
| Water | 800 ml |
| Ethylenediamine-N,N,N',N'-tetramethylene phosphonic acid | 3.0 g |
| Organic preservative (XI-19) | 4.5 g |
| Triethanolamine | 10.0 g |
| Sodium chloride | see Table 2 |
| Potassium chloride | see Table 2 |
| Potassium carbonate | 25.0 g |
| N-ethyl-N-(β-methanesulfoneamideethyl)-3-methyl-4-aminoaniline sulfate | 5.0 g |
| Brightening agent (WHITEX-4, manufactured by Sumitomo Kagaku) | 1.2 g |
| Water to make | 1000 ml |
| pH (at 25° C.) | 10.05 |
| Bleach-Fixing Solution: | |
| Water | 400 ml |
| Ammonium thiosulfate (55 wt %) | 100 ml |
| Sodium sulfite | 17.0 g |
| Iron(III) ammonium ethylenediamine tetraacetate | 55.0 g |
| Disodium ethylenediamine tetraacetate | 5.0 g |
| Ammonium bromide | 40.0 g |
| Glacial acetic acid | 9.0 g |
| Water to make | 1000 ml |
| pH (at 25° C.) | 5.80 |
| Rinsing Solution: | |
| Ion exchange treated water (calcium, magnesium, each being less than 3 ppm) | |

TABLE 2

| | Experiment No. | | | | | | | |
|---|---|---|---|---|---|---|---|---|
| | 1 | 2 | 3 | 4 | 5 | 6 | 7 | 8 |
| Light-sensitive material | Sample 101 | Sample 102 | Sample 103 | Sample 104 | Sample 105 | Sample 104 | Sample 104 | Sample 104 |
| Iridium | — | — | — | — | presence | — | — | — |
| AgCl (mol %) | 100 | 98 | 80 | 98 | 98 | 98 | 98 | 98 |
| Concentration in developer (mol/l) | | | | | | | | |
| [Cl$^-$] | $6.0 \times 10^{-2}$ | $6.0 \times 10^{-2}$ | $6.0 \times 10^{-2}$ | $6.0 \times 10^{-2}$ | $6.0 \times 10^{-2}$ | $6.0 \times 10^{-2}$ | 0 | $3.0 \times 10^{-1}$ |
| [Br$^-$] | $2.1 \times 10^{-4}$ | $2.1 \times 10^{-4}$ | $2.1 \times 10^{-4}$ | $2.1 \times 10^{-4}$ | $2.1 \times 10^{-4}$ | 0 | $2.1 \times 10^{-4}$ | $2.0 \times 10^{-3}$ |
| Just after Coating | | | | | | | | |
| Fogging | 0.12 | 0.11 | 0.09 | 0.10 | 0.09 | 0.12 | 0.11 | 0.08 |
| Relative sensitivity | | | | | | | | |
| (1/100 sec exposure) | 45 | 48 | 77 | 219 | 235 | 226 | 225 | 196 |
| (1/10") | 100 | 102 | 151 | 263 | 254 | 271 | 269 | 238 |
| (10") | 68 | 71 | 108 | 242 | 251 | 249 | 248 | 219 |
| Maximum color density | 2.54 | 2.51 | 2.27 | 2.53 | 2.52 | 2.55 | 2.55 | 2.41 |
| After storing 2 days at 60° C., 60% RH | | | | | | | | |
| Fogging | 0.28 | 0.27 | 0.18 | 0.13 | 0.12 | 0.14 | 0.13 | 0.12 |

TABLE 2-continued

| | | | | | | | | |
|---|---|---|---|---|---|---|---|---|
| Relative sensitivity (1/10 sec exposure) | 129 | 127 | 174 | 268 | 255 | 277 | 276 | 241 |
| Maximum color density | 2.23 | 2.22 | 2.05 | 2.49 | 2.48 | 2.42 | 2.43 | 2.22 |
| Pressure-sensitized streak in processing solution | C | C | B | A | A | D | C | A |
| Remarks | Comp. Example | Comp. Example | Comp. Example | This Invention | This Invention | Comp. Example | Comp. Example | Comp. Example |

| | Experiment No. | | | | | | |
|---|---|---|---|---|---|---|---|
| | 9 | 10 | 11 | 12 | 13 | 14 | 15 |
| Light-sensitive material | Sample 105 | Sample 105 | Sample 105 | Sample 105 | Sample 105 | Sample 105 | Sample 105 |
| Iridium | presence | presence | presence | presence | presence | presence | presence |
| AgCl (mol %) | 98 | 98 | 98 | 98 | 98 | 98 | 98 |
| Concentration in developer (mol/l) | | | | | | | |
| $[Cl^-]$ | 0 | $6.0 \times 10^{-2}$ | 0 | $3.0 \times 10^{-2}$ | $3.5 \times 10^{-2}$ | $1.5 \times 10^{-1}$ | $3.0 \times 10^{-1}$ |
| $[Br^-]$ | 0 | 0 | $2.1 \times 10^{-4}$ | $2.0 \times 10^{-5}$ | $3.0 \times 10^{-5}$ | $1.0 \times 10^{-3}$ | $2.0 \times 10^{-3}$ |
| Just after Coating | | | | | | | |
| Fogging | 0.13 | 0.12 | 0.11 | 0.10 | 0.09 | 0.08 | 0.07 |
| Relative sensitivity | | | | | | | |
| (1/100 sec exposure) | 247 | 243 | 241 | 236 | 236 | 232 | 211 |
| (1/10") | 267 | 262 | 260 | 256 | 255 | 251 | 228 |
| (10") | 264 | 257 | 257 | 253 | 252 | 248 | 225 |
| Maximum color density | 2.54 | 2.53 | 2.52 | 2.52 | 2.53 | 2.51 | 2.39 |
| After storing 2 days at 60° C., 60% | | | | | | | |
| Fogging | 0.14 | 0.12 | 0.12 | 0.12 | 0.12 | 0.11 | 0.11 |
| Relative sensitivity (1/10 sec exposure) | 268 | 263 | 262 | 257 | 257 | 253 | 229 |
| Maximum color density | 2.50 | 2.49 | 2.48 | 2.49 | 2.48 | 2.46 | 2.27 |
| Pressure-sensitized streak in processing solution | D | D | C | B | A | A | A |
| Remarks | Comp. Example | Comp. Example | Comp. Example | Comp. Example | This Invention | This Invention | Comp. Example |

(note):
For the relative sensitivity, the specimen 101 was exposed just after coating for 1/10 sec with 250 CMS and processed in the developing solution of Experiment No. 1, the sensitivity thereof being defined as 100. The relative sensitivity was expressed by a relative value based thereon.

As is apparent from the results of Table 2, although the maximum color density is increased, high sensitivity cannot be obtained only with an increase in the silver chloride content. Furthermore, when samples were stored at 60° C., fogging increases remarkably, such that the color paper can no longer be practically used. Rapid developing speed and high sensitivity, and storage stability can be obtained only with the high silver chloride content emulsion having a localized silver bromide phase. However, without using the developing solution of the present invention, sensitized streaks are undesirably formed during processing.

It has been found that excellent performance is obtained for all photographic properties using the developing solution as defined in the present invention. If the chloride ion concentration and the bromide ion concentration are lower than the prescribed levels, the occurrence of sensitized streaks is not suppressed. On the other hand, if the chloride and bromide ion concentrations are in excess of the levels defined in the present invention, development is suppressed thereby reducing the color density.

On the other hand, the emulsion having a localized silver bromide phase deposited in the presence of an iridium compound provides high sensitivity over a wide range of luminosity and has excellent performance.

EXAMPLE 2

After adding 32 g of lime-treated gelatin to 1000 ml of distilled water and dissolving the same at 40° C., 5.8 g of sodium chloride was added and the temperature was raised to 75° C. 3.8 ml of N,N'-dimethylimidazolidine-2-thione (1% aqueous solution) was added to the solution. Then, a solution containing 6.4 g of silver nitrate dissolved in 181 ml of distilled water and a solution containing 2.2 g of sodium chloride dissolved in 180 ml of distilled water were added and mixed to the above-described solution for 10 min while maintaining the temperature at 75° C. Furthermore, a solution containing 153.6 g of silver nitrate dissolved in 410 ml of distilled water and a solution containing 52.8 g of sodium chloride dissolved in 410 ml of distilled water were admixed for 35 min while maintaining the temperature at 75° C. After the completion of the addition of the aqueous solution of silver nitrate and the aqueous solution of the sodium chloride, the temperature was maintained at 75° C. for 5 min and then lowered to 40° C. and desalting and water washing were conducted. Then, lime-treated gelatin was added and then 111.1 mg of a triethylammonium salt of 3-(2-(5-chloro-3-(3 -sulfonatepropyl)benzothiazoline-2-ylidenemethyl)-3-naphto-(1,2-d)thiazolio) propanesulfonic acid and 112.8 mg of the triethylammonium salt of 4-(2-(5-chloro-3-(4-sulfonatebutyl)benzothiazolin-2-ylidenemethyl)-5-chlorobenzothiazolio)butanesulfonic acid, were added to obtain an emulsion (D). The resulting emulsion contained cubic silver chloride grains having an average grain size of 1.12 μm and a variation coefficient of the grain size distribution of 0.07.

Using the same procedures as in the preparation of emulsion (D) except for changing the aqueous solution of sodium chloride to be added together with the aqueous solution of silver nitrate to a mixed solution of sodium chloride and potassium bromide (in which the total number of mols of solute was the same but wherein the molar ratio of chloride to bromide was set at 98/2), to obtain a silver bromochloride emulsion (E) containing 2 mol% of silver bromide. The addition time for the reaction solution was controlled such that the average grain size of the silver halide grains contained in the emulsion was equal to that in the emulsion (D). The resultant grains were cubic and had a variation coefficient of the grain size of 0.08.

Using the same procedures as in the preparation of emulsion (D) except for changing the aqueous solution of sodium chloride to be added together with the aqueous solution of silver nitrate to a mixed solution of sodium chloride and potassium bromide (in which the total number of mols of solute the same, but wherein the molar ratio of chloride to bromide was set at 8/2), to obtain a silver bromochloride emulsion (F) containing 20 mol% of silver bromide. The addition time for the reaction solution was controlled such that the average grain size of the silver halide grains contained in the emulsion was equal to that in the emulsion (D). The resulting grains were cubic and had a variation coefficient of the grain size of 0.09.

After controlling the pH and pAg of the thus obtained three emulsions, optimal chemical sensitization was conducted respectively by adding triethyl thiourea to obtain emulsions (D-1), (E-1) and (F-1).

After adding the emulsion (a-1) as prepared in Example 1 in an amount corresponding to 0.6 mol% of silver halide to the emulsion (D), triethyl thiourea was added for optimal chemical sensitization, to prepare an emulsion (D-2).

An emulsion (a-2) was likewise used instead of the emulsion (a-1), to prepare an emulsion (D-3).

To each of the five types of silver halide emulsions, the stabilizer (I-1) was added in an amount of $3.6\times10^{-4}$ mol per mol of the silver halide.

As a result, a single diffraction peak was shown corresponding to 100% silver chloride for the emulsion (D-1), 98% silver chloride (2% silver bromide) for the emulsion (E-1) and 80% silver chloride (20% silver bromide) for the emulsion (F-1) respectively. On the other hand, a broad sub-peak having a center corresponding to 75% silver chloride (25% silver bromide) and trailing to about 70% silver chloride (30% silver bromide) were observed in addition to the main peak corresponding to 100% silver chloride for each of the emulsions (D-2) and (D-3).

Then, emulsions (G-1), (G-2), (H-1) and (I-1) were prepared in the same manner except for adding 60.0 mg of 2-(2,4-(2,2-dimethyl-1,3-propano)-5-(6-methyl-3-pentylbenzothiazolin-2-ylidene)-1,3-pentadienyl)-3-ethyl-6-methylbenzothiazolium iodide instead of 286.0 mg of the pyridinium salt of 2-(5-phenyl-2-(2-5-phenyl-3-(2-sulfonate ethyl)benzooxazolin-2-ylidenemethyl)-1-butenyl)-benzooxazolio)ethane sulfonic acid added in the emulsions (A-1), (A-2), (A-3), (B-1) and (C-1). However, the emulsion (a-1) added in the emulsion (G-2) and the emulsion (a-2) added in the emulsion (G-3) were changed each to about 3 mol% as silver halide based on the emulsion (G).

To each of the five types (i.e., (G-1), (G-2), (G-3), (H-1) and (I-1)) of silver halide emulsions, the halogen composition and distribution thereof were examined by X-ray diffraction method.

As a result, a single diffraction peak was shown corresponding to 100% silver chloride for the emulsion (G-1), 98% silver chloride (2% silver bromide) for the emulsion (H-1) and 80% silver chloride (20% silver bromide) for the emulsion (H-1) respectively. On the other hand, a broad sub-peak having the center corresponding to 60% silver chloride (40% silver bromide) and trailing to about 50% silver chloride (50% silver bromide) was observed in addition to the main peak corresponding to 100% silver chloride for each of the emulsions (G-2) and (G-3).

Emulsion dispersions of color couplers were prepared in the same manner as in Example 1 and coated, in combination with each of the silver halide emulsions, on a reflective paper support laminated with polyethylene on both sides thereof, to prepare the multi-layered color light-sensitive materials of the layer structure shown in Table 3.

The following compound was added in an amount of $2.6\times10^{-3}$ mol per mol of the silver halide to the red-sensitive emulsion layer.

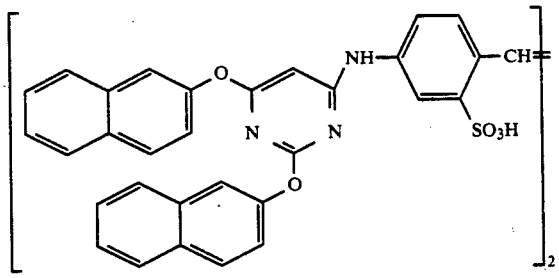

As the gelatin hardener for each of the layers, the sodium salt of 1-oxy-3,5-dichloro-s-triazine was added in an amount of 14.0 mg per gram of gelatin.

The following dyes were also added as irradiation preventing dyes.

Dye (VII-12)

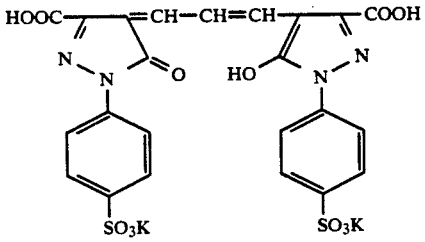

Coating amount: 8.0 mg/m$^2$

Dye (VII-43)

-continued

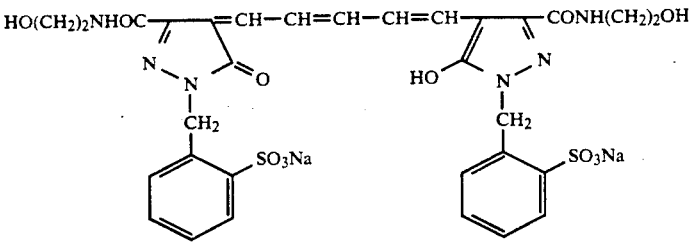

Coating amount: 14.0 mg/m$^2$

Yellow coupler (Y-1)

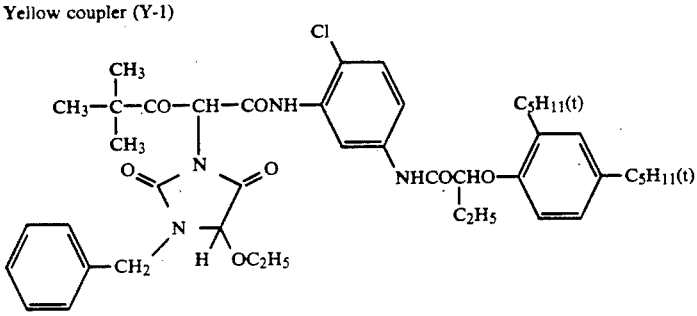

Cyan coupler (C-1)

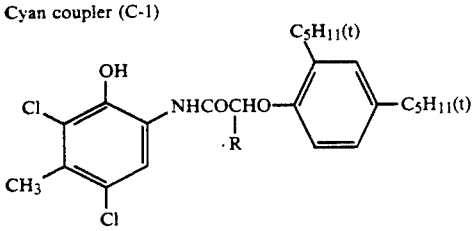

in which R = $C_2H_5$ and $C_4H_9$ (a) (b)

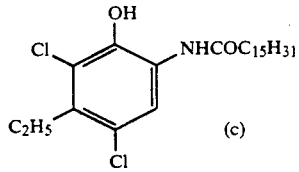

(c)

as a 2/4/4 mixture (weight ratio) of (a)/(b)/(c)

TABLE 3

| Layer/Content | Sample 201 | Sample 202 | Sample 203 | Sample 204 | Specimen 205 |
|---|---|---|---|---|---|
| Seventh Layer: (Protection layer) | | | | | |
| Gelatin | | | 1.33 g/m$^2$ | | |
| Acrylic modified copolymer of polyvinyl alcohol (17% modification | | | 0.17 g/m$^2$ | | |
| Liquid paraffin | | | 0.03 ml/m$^2$ | | |
| Sixth Layer: UV-ray absorption layer) | | | | | |
| Gelatin | | | 0.53 g/m$^2$ | | |
| UV-absorber (UV-1) | | | 0.16 g/m$^2$ | | |
| Color mixing inhibitor (Cpd-4) | | | 0.02 g/m$^2$ | | |
| Solvent (Solv-3) | | | 0.09 ml/m$^2$ | | |
| Fifth Layer: (Red sensitive layer) | | | | | |
| Silver halide emulsion | G-1 | H-1 | I-1 | G-2 | G-3 |
| (Coating amount as silver) | 0.23 g/m$^2$ | 0.23 g/m$^2$ | 0.23 g/m$^2$ | 0.23 g/m$^2$ | 0.23 g/m$^2$ |
| Cyan coupler (C-1) | 0.32 g/m$^2$ | 0.32 g/m$^2$ | 0.32 g/m$^2$ | 0.32 g/m$^2$ | 0.32 g/m$^2$ |
| Color image stabilizer | | | | | |
| (Cpd-5) | 0.17 g/m$^2$ | 0.17 g/m$^2$ | 0.17 g/m$^2$ | 0.17 g/m$^2$ | 0.11 g/m$^2$ |
| (Cpd-6) | 0.04 g/m$^2$ | 0.04 g/m$^2$ | 0.04 g/m$^2$ | 0.04 g/m$^2$ | 0.04 g/m$^2$ |
| (Cpd-7) | 0.40 g/m$^2$ | 0.40 g/m$^2$ | 0.40 g/m$^2$ | 0.40 g/m$^2$ | 0.40 g/m$^2$ |
| Solvent (Solv-4) | 0.15 g/m$^2$ | 0.15 g/m$^2$ | 0.15 g/m$^2$ | 0.15 g/m$^2$ | 0.15 g/m$^2$ |
| Gelatin | 1.34 g/m$^2$ | 1.34 g/m$^2$ | 1.34 g/m$^2$ | 1.34 g/m$^2$ | 1.34 g/m$^2$ |
| Fourth Layer: | | | | | |

TABLE 3-continued

| Layer/Content | Sample 201 | Sample 202 | Sample 203 | Sample 204 | Specimen 205 |
|---|---|---|---|---|---|
| UV-ray absorption layer) | | | | | |
| Gelation | | | 1.58 g/m$^2$ | | |
| UV-absorber (UV-1) | | | 0.47 g/m$^2$ | | |
| Color mixing inhibitor (Cpd-4) | | | 0.05 g/m$^2$ | | |
| Solvent (Solv-3) | | | 0.26 ml/m$^2$ | | |
| Third Layer: | | | | | |
| (Green sensitive layer) | | | | | |
| Silver halide emulsion | A-1 | B-1 | C-1 | A-2 | A-3 |
| (Coating amount as silver) | 0.12 g/m$^2$ | 0.12 g/m$^2$ | 0.12 g/m$^2$ | 0.12 g/m$^2$ | 0.12 g/m$^2$ |
| Magenta coupler | | | | | |
| (M-5) | 0.13 g/m$^2$ | 0.13 g/m$^2$ | 0.13 g/m$^2$ | 0.13 g/m$^2$ | 0.13 g/m$^2$ |
| (M-10) | 0.09 g/m$^2$ | 0.09 g/m$^2$ | 0.09 g/m$^2$ | 0.09 g/m$^2$ | 0.09 g/m$^2$ |
| Color image stabilizer | | | | | |
| (Cpd-1) | 0.15 g/m$^2$ | 0.15 g/m$^2$ | 0.15 g/m$^2$ | 0.15 g/m$^2$ | 0.15 g/m$^2$ |
| (Cpd-8) | 0.02 g/m$^2$ | 0.02 g/m$^2$ | 0.02 g/m$^2$ | 0.02 g/m$^2$ | 0.02 g/m$^2$ |
| (Cpd-9) | 0.03 g/m$^2$ | 0.03 g/m$^2$ | 0.03 g/m$^2$ | 0.03 g/m$^2$ | 0.03 g/m$^2$ |
| Solvent | | | | | |
| (Solv-1) | 0.34 ml/m$^2$ | 0.34 ml/m$^2$ | 0.34 ml/m$^2$ | 0.34 ml/m$^2$ | 0.34 ml/m$^2$ |
| (Solv-2) | 0.17 ml/m$^2$ | 0.17 ml/m$^2$ | 0.17 ml/m$^2$ | 0.17 ml/m$^2$ | 0.17 ml/m$^2$ |
| Gelatin | 1.25 g/m$^2$ | 1.25 g/m$^2$ | 1.25 g/m$^2$ | 1.25 g/m$^2$ | 1.25 g/m$^2$ |
| Second Layer: | | | | | |
| (Color mixing preventive layer) | | | | | |
| Gelation | | | 1.25 g/m$^2$ | | |
| Color mixing inhibitor (Cpd-4) | | | 0.11 g/m$^2$ | | |
| Solvent (Solv-2)/(Solv-5) | | | 0.24/0.26 ml/m$^2$ | | |
| First Layer: | | | | | |
| (Blue sensitive layer) | | | | | |
| Silver halide emulsion | D-1 | E-1 | F-1 | D-2 | D-3 |
| (Coating amount as silver) | 0.30 g/m$^2$ | 0.30 g/m$^2$ | 0.30 g/m$^2$ | 0.30 g/m$^2$ | 0.30 g/m$^2$ |
| Yellow coupler (Y-1) | 0.82 g/m$^2$ | 0.82 g/m$^2$ | 0.82 g/m$^2$ | 0.82 g/m$^2$ | 0.82 g/m$^2$ |
| Color image stabilizer (Cpd-7) | 0.09 g/m$^2$ | 0.09 g/m$^2$ | 0.09 g/m$^2$ | 0.09 g/m$^2$ | 0.09 g/m$^2$ |
| Solvent (Solv-6) | 0.28 ml/m$^2$ | 0.28 ml/m$^2$ | 0.28 ml/m$^2$ | 0.28 ml/m$^2$ | 0.28 ml/m$^2$ |
| Gelatin | 1.75 g/m$^2$ | 1.75 g/m$^2$ | 1.75 g/m$^2$ | 1.75 g/m$^2$ | 1.75 g/m$^2$ |

Paper support laminated with polyethylene on both sides (polyethylene on the side having the emulsion layer contained $TiO_2$ and a trace amount of ultramarine)

Color mixing inhibitor (Cpd-4)

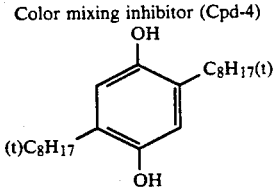

Color Image stabilizer (Cpd-1)
Same as in Example 1

Color image stabilizer (Cpd-5)

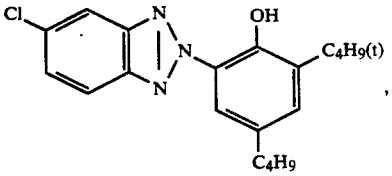

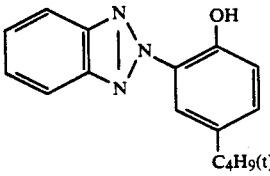

-continued

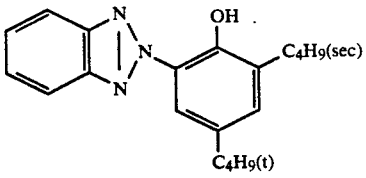

as 2:4:4: mixture (weight ratio)

Color image stabilizer (Cpd-6)

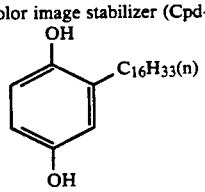

Color image stabilizer (Cpd-7)

$$\leftarrow CH_2-\underset{\underset{CONHC_4H_9(t)}{|}}{CH}\rightarrow_n$$

Color image stabilizer (Cpd-8)

-continued

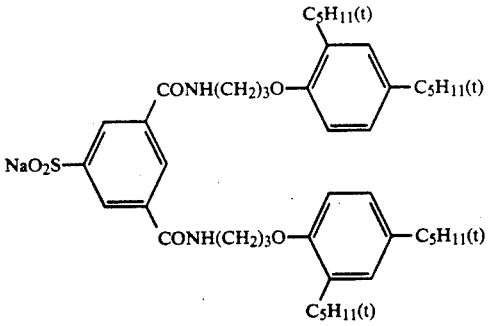

Color image stabilizer (Cpd-9)

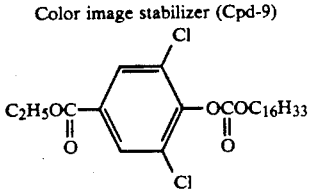

Solvent (Solv-1)
Same as in Example 1

Solvent (Solv-2)
Same as in Example 1

Solvent (Solv-3)

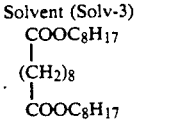

Solvent (Solv-4)

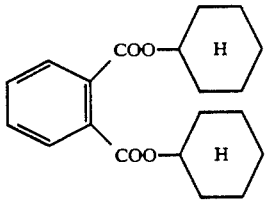

Solvent (Solv-5)

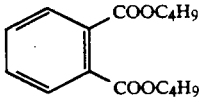

Solvent (Solv-6)
$O{=}P{+}O{-}C_9H_{19}\text{-(iso)})_3$

UV-absorber (UV-1)

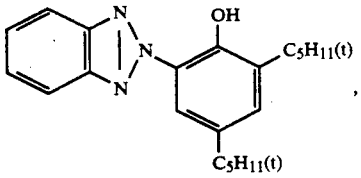

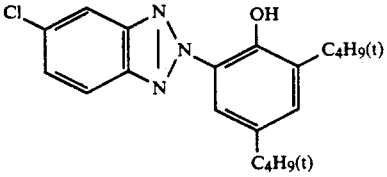

-continued

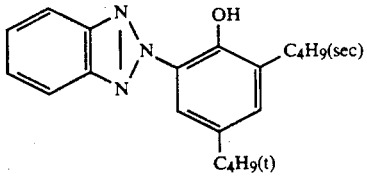

For evaluating the photographic properties of the coated samples, the following tests were conducted.

At first, a 1/10 sec exposure was carried out in the same manner as in Example 1 (using blue, green and red three color filters for conducting sensitometry of each of the layers), and color development processing was conducted with the processing solutions used in Experiment No. 1 and in the same manner as in Example 1. As a result of the measurement for the density, since the sample 203 shows poor color development for each of yellow, magenta and cyan colors and was not suitable for practical use, the sample 203 was not used in subsequent tests.

Then, a practical continuous processing test was conducted using the four remaining types of the samples, excluding the sample 203.

Each of the samples was image-wise exposed using typical negatives scene films corresponding to average color development in markets was applied with continuous processing.

The processing steps and processing solutions employed were as shown below and the processing was continued until the total of the replenishing amount reached twice the tank capacity.

| Processing Step | Temperature | Time | Replenishing Amount | Volume of Tank (l) |
|---|---|---|---|---|
| Color development | 38° C. | 45 sec | See Table 4 | 4.0 |
| Bleach-fixing | 30–36° C. | 45 sec | 61 ml | 4.0 |
| Water washing (1) | 30–37° C. | 30 sec | — | 2.0 |
| Water washing (2) | 30–37° C. | 30 sec | — | 2.0 |
| Water washing (3) | 30–37° C. | 30 sec | 364 ml | 2.0 |
| Drying | 70–88° C. | 60 sec | | |

(The replenishing amount (i.e., the amount of replenisher) represents the amount per 1 $m^2$ of the light-sensitive material processed. The water washing step was a 3-tank counter current system of (3)-(1), in which the solution of water washing (1) was replenished to the bleach-fixing solution in an amount of 122 ml per 1 $m^2$ of the light-sensitive material).

| Color Developing Solution: (Tank solution) | |
|---|---|
| Water | 800 ml |
| Ethylenediamine-N,N,N',N'-tetramethylene phosphonic acid | 3.0 g |
| Organic preservative (XI-19) | 4.5 g |
| Triethanolamine | 8.0 g |
| Sodium chloride | See Table 4 |
| Potassium chloride | See Table 4 |
| Potassium carbonate | 25.0 g |
| N-ethyl-N-(β-methanesulfoneamidoethyl)-3-methyl-4-aminoaniline sulfate | 5.0 g |
| Brightening agent | 1.0 g |

-continued

| | |
|---|---|
| (WHITEX-4, manufactured by Sumitomo Kagaku) | |
| Water to make | 1000 ml |
| pH (at 25° C.) | 10.05 |

(Replenisher)

| | Replenisher | | | |
|---|---|---|---|---|
| | i | ii | iii | iv |
| Ethylenediamine-N,N,N',N'-tetramethylene phosphonic acid | 3.0 g/l | 3.0 g/l | 3.0 g/l | 3.0 g/l |
| Triethanolamine | 12.0 g/l | 12.0 g/l | 12.0 g/l | 12.0 g/l |
| Potassium chloride | See Table 4 | | | |
| Potassium bromide | See Table 4 | | | |
| Potassium carbonate | 26.0 g/l | 26.0 g/l | 26.0 g/l | 26.0 g/l |
| N-ethyl-N-(β-methanesulfoneamidethyl)-3-methyl-4-amino aniline sulfate | 6.0 g/l | 7.0 g/l | 9.0 g/l | 11.0 g/l |
| Organic preservative (XI-19) | 6.0 g/l | 6.0 g/l | 7.0 g/l | 9.0 g/l |
| Brightening agent (WHITEX-4, manufactured by Sumitomo Kagaku | 1.5 g/l | 2.0 g/l | 2.5 g/l | 3.0 g/l |
| pH (at 25° C.) (adjusted with KOH or $H_2SO_4$) | 10.35 | 10.45 | 10.55 | 10.65 |

Bleach-Fixing Solution:

(Tank solution)

| | |
|---|---|
| Water | 400 ml |
| Ammonium thiosulfate (55 wt %) | 100 ml |
| Ammonium sulfite | 38.0 g |

-continued

| | |
|---|---|
| Iron(III) ammonium ethylenediamine tetraacetate | 55.0 g |
| Disodium ethylenediamine tetraacetate | 5.0 g |
| Ammonium bromide | 40.0 g |
| Glacial acetic acid | 9.0 g |
| Water to make | 1000 ml |
| pH (25° C.) | 5.80 |

(Replenisher)

A solution having the same components of the tank solution, but each component having a concentration of 2.5 times that in the tank solution.

Water Washing Solution

Ion exchange treated water (calcium, magnesium, each 3 ppm or less):

Continuous processing was conducted while compensating for the evaporization in the processing solution by adding distilled water in an amount corresponding to the evaporated water to the color developing solution, bleach-fixing solution and water-washing solution.

The fluctuation in the photographic properties under conditions of continuous processing for each of the samples was evaluated as described below.

Color development was conducted after exposing for sensitometry in the same manner as in the Example 1 (using blue, green and red color filters for conducting sensitometry for each of the respective layers) at the beginning and at the end of the continuous processing.

Furthermore, for evaluating the sensitized streaks formed in the processing solution, each of the samples were exposed to provide a uniform gray density of 0.8. using an automatic printer (FAP-3500, manufactured by Fuji Photographic Film Co.). The samples were processed after the end of the continuous processing, and evaluation of the sensitized streaks was made in the same manner as in Example 1.

The results obtained are shown in Table 4.

TABLE 4A

| Experiment No. | 16 | 17 | 18 | 19 | 20 | 21 | 22 |
|---|---|---|---|---|---|---|---|
| Light-sensitive material | Sample 205 | Sample 205 | Sample 205 | Sample 205 | Sample 205 | Sample 205 | Sample 205 |
| Replenishing solution | i | iii | iii | iii | iv | i | ii |
| Replenishing amount | 300 ml | 100 ml | 100 ml | 100 ml | 100 ml | 300 ml | 200 ml |
| Concentration in developer (mol/l) | | | | | | | |
| $[Cl^-]$ Tank solution | $1.4 \times 10^{-2}$ | $4.3 \times 10^{-2}$ | $5.0 \times 10^{-2}$ | $1.5 \times 10^{-1}$ | $4.3 \times 10^{-2}$ | $3.6 \times 10^{-2}$ | $6.0 \times 10^{-2}$ |
| Replenishing solution | — | — | $0.7 \times 10^{-2}$ | $1.0 \times 10^{-2}$ | — | $2.2 \times 10^{-2}$ | $4.0 \times 10^{-2}$ |
| $[Br^-]$ Tank solution | $2.0 \times 10^{-5}$ | $1.2 \times 10^{-4}$ | $5.0 \times 10^{-4}$ | $1.0 \times 10^{-3}$ | $1.7 \times 10^{-3}$ | $4.0 \times 10^{-5}$ | $2.0 \times 10^{-4}$ |
| Replenishing solution | — | — | $3.8 \times 10^{-4}$ | $9.0 \times 10^{-4}$ | $1.6 \times 10^{-3}$ | $2.0 \times 10^{-5}$ | $1.4 \times 10^{-4}$ |
| At the start of continuous processing | | | | | | | |
| Fogging | | | | | | | |
| B | 0.11 | 0.10 | 0.09 | 0.08 | 0.07 | 0.10 | 0.09 |
| G | 0.10 | 0.09 | 0.08 | 0.09 | 0.08 | 0.09 | 0.09 |
| R | 0.10 | 0.09 | 0.09 | 0.09 | 0.08 | 0.10 | 0.09 |
| Relative sensitivity (1/10 sec exposure) | | | | | | | |
| B | 260 | 259 | 256 | 248 | 213 | 259 | 255 |
| G | 264 | 263 | 260 | 252 | 221 | 263 | 259 |
| R | 278 | 277 | 274 | 265 | 234 | 277 | 273 |
| Maximum color development density | | | | | | | |
| B | 2.31 | 2.30 | 2.27 | 2.27 | 2.02 | 2.31 | 2.29 |
| G | 2.52 | 2.51 | 2.48 | 2.47 | 2.36 | 2.51 | 2.47 |
| R | 2.73 | 2.64 | 2.60 | 2.58 | 2.49 | 2.71 | 2.58 |
| At the end of continuous processing | | | | | | | |
| Fogging | | | | | | | |
| B | 0.22 | 0.12 | 0.11 | 0.10 | 0.08 | 0.11 | 0.11 |

TABLE 4A-continued

| Experiment No. | 16 | 17 | 18 | 19 | 20 | 21 | 22 |
|---|---|---|---|---|---|---|---|
| G | 0.19 | 0.11 | 0.10 | 0.10 | 0.09 | 0.10 | 0.10 |
| R | 0.18 | 0.11 | 0.11 | 0.10 | 0.09 | 0.11 | 0.10 |
| Relative sensitivity (1/10 sec exposure) | | | | | | | |
| B | 251 | 253 | 252 | 246 | 209 | 252 | 254 |
| G | 255 | 257 | 256 | 250 | 217 | 255 | 254 |
| R | 268 | 271 | 270 | 263 | 230 | 268 | 268 |

TABLE 4-B

| Experiment No. | 23 | 24 | 25 | 26 | 27 | 28 |
|---|---|---|---|---|---|---|
| Light-sensitive material | Sample 205 | Sample 201 | Sample 201 | Sample 202 | Sample 204 | Sample 204 |
| Replenishing solution | iv | iii | iii | iii | iii | iii |
| Replenishing amount | 30 ml | 100 ml | 100 ml | 100 ml | 100 ml | 100 ml |
| Concentration in developer (mol/l) | | | | | | |
| $[Cl^-]$ Tank solution | $1.2 \times 10^{-1}$ | $7.0 \times 10^{-2}$ | $7.0 \times 10^{-2}$ | $7.0 \times 10^{-2}$ | $7.0 \times 10^{-2}$ | $1.5 \times 10^{-1}$ |
| Replenishing solution | — | $2.6 \times 10^{-2}$ | $2.6 \times 10^{-2}$ | $2.7 \times 10^{-2}$ | $2.7 \times 10^{-2}$ | $1.0 \times 10^{-2}$ |
| $[Br^-]$ Tank solution | $7.0 \times 10^{-4}$ | — | $2.5 \times 10^{-4}$ | $2.5 \times 10^{-4}$ | $2.5 \times 10^{-4}$ | $1.0 \times 10^{-3}$ |
| Replenishing solution | $3.5 \times 10^{-4}$ | — | $1.0 \times 10^{-5}$ | $1.3 \times 10^{-4}$ | $1.3 \times 10^{-4}$ | $9.0 \times 10^{-4}$ |
| At the start of continuous processing | | | | | | |
| Fogging | | | | | | |
| B | 0.07 | 0.12 | 0.11 | 0.10 | 0.10 | 0.08 |
| G | 0.08 | 0.11 | 0.11 | 0.09 | 0.10 | 0.09 |
| R | 0.09 | 0.12 | 0.11 | 0.10 | 0.09 | 0.09 |
| Relative sensitivity (1/10 sec exposure) | | | | | | |
| B | 249 | 100 | 91 | 147 | 258 | 251 |
| G | 253 | 100 | 94 | 150 | 262 | 255 |
| R | 266 | 100 | 87 | 158 | 271 | 264 |
| Maximum color density | | | | | | |
| B | 2.28 | 2.32 | 2.30 | 2.29 | 2.30 | 2.28 |
| G | 2.46 | 2.55 | 2.52 | 2.50 | 2.51 | 2.49 |
| R | 2.58 | 2.74 | 2.71 | 2.69 | 2.70 | 2.68 |
| At the end of continuous processing | | | | | | |
| Fogging | | | | | | |
| B | 0.12 | 0.20 | 0.16 | 0.15 | 0.11 | 0.10 |
| G | 0.11 | 0.18 | 0.13 | 0.15 | 0.11 | 0.10 |
| R | 0.11 | 0.19 | 0.15 | 0.14 | 0.12 | 0.11 |
| Relative sensitivity (1/10 sec exposure) | | | | | | |
| B | 245 | 79 | 81 | 118 | 252 | 249 |
| G | 250 | 72 | 75 | 113 | 256 | 253 |
| R | 263 | 65 | 68 | 107 | 264 | 261 |
| Maximum color density | | | | | | |
| B | 2.22 | 2.23 | 2.18 | 2.19 | 2.27 | 2.26 |
| G | 2.42 | 2.41 | 2.37 | 2.41 | 2.49 | 2.47 |
| R | 2.54 | 2.65 | 2.62 | 2.61 | 2.68 | 2.66 |
| Pressure-sensitized streak in processing solution | A | D | C | C | A | A |
| Remarks | This Invention | Comp. Example | Comp. Example | Comp. Example | This Invention | This Invention |

(Note):
The photographic properties for the blue sensitive layer, green sensitive layer and red sensitive layers are represented by B, G and R, respectively. The relative sensitivity is expressed as a relative value based on a sensitivity value of 100 for the specimen 201 that was exposed for 1/10 sec with 250 CMS and processed with the developing solution of Experiment No. 24 for each of B, G and R.

As is apparent from the above results, the light-sensitive material having the emulsion of the present invention and processed using a developing solution of the present invention provides the same excellent performance as in Example 1. The results are excellent, even when a multi-layered color light-sensitive material is continuously processed with a reduced replenishing amount.

Furthermore, as a result of examining the extent of reciprosity law failure for each of the samples, the sample 205 is superior to the sample 204 in that it has higher sensitivity in a wider range of illumination.

It is clearly seen from the results shown in the examples that high quality, high sensitivity color prints are produced stably by continuous rapid processing even using a reduced replenishing amount according to the method of the present invention.

While the invention has been described in detail and with reference to specific embodiments thereof, it will be apparent to one skilled in the art that various changes and modifications can be made therein without departing from the spirit and scope thereof.

What is claimed is:

1. A method for forming a color image using an image-wise exposed silver halide color photographic material comprising, a reflective support having thereon at least one silver halide emulsion layer containing at least one coupler that forms a dye by means of a coupling reaction with the oxidation product of an aromatic primary amine developing agent and silver halide grains comprising silver bromochloride containing not less than 90 mol% silver chloride and substantially not containing silver iodide, said silver halide grains having a localized silver bromide phase having a silver bromide content of not less than 20 mol% and being chemically sensitized at the surface thereof to provide substantially surface latent image type grains, comprising developing the light-sensitive material with a color developing solution containing from $3.5\times10^{-2}$ to $1.5\times10^{-1}$ mol/l of chloride ions and from $3.0\times10^{-5}$ to $1.0\times10^{-3}$ mol/l of bromide ions.

2. The method for forming a color image as claimed in claim 1, wherein said silver halide grains are formed in the presence of an iridium compound.

3. The method for forming a color image as claimed in claim 2, wherein said iridium compound is used in an amount of $5\times10^{-9}$ to $1\times10^{-4}$ mol per mol of the finally formed silver halide grains.

4. The method for forming a color image as claimed in claim 1, wherein the total amount of the coated silver in said silver halide color photographic material is not greater than 0.80 g/m$^2$.

5. The method for forming a color image as claimed in claim 1, wherein said color developing solution contains from $4\times10^{-2}$ to $1.0\times10^{-1}$ mol/l of chloride ions.

6. The method for forming a color image as claimed in claim 1, wherein said color developing solution contains from $5\times10^{-5}$ to $5.0\times10^{-4}$ mol/l of bromide ions.

7. The method for forming a color image as claimed in claim 1, wherein said color developing solution contains an organic preservative compound in an amount of from 0.005 to 0.5 mol/l.

8. The method for forming a color image as claimed in claim 1, wherein said silver halide grains have a localized silver bromide phase having a silver bromide content of from 20 to 60 mol%.

9. The method for forming a color image as claimed in claim 1, wherein said silver halide grains comprise silver bromochloride containing not less than 95 mol% of the entire silver halide constituting the silver halide grains.

10. The method for forming a color image as claimed in claim 1, wherein said silver halide grains have a localized silver bromide phase having a silver bromide content of from 30 to 50 mol%.

11. The method for forming a color image as claimed in claim 1, wherein said localized silver bromide phase constitutes from 0.1 to 20% of the total amount of silver contained in the silver halide grains.

12. The method for forming a color image as claimed in claim 1, wherein said localized silver bromide phase constitutes from 0.5 to 7% of the total amount of silver contained in the silver halide grains.

13. The method for forming a color image as claimed in claim 1, wherein said localized silver bromide phase is deposited together with at least 50% of the total iridium added in the preparation of the silver halide grains.

14. The method for forming a color image as claimed in claim 1, wherein said localized silver bromide phase is deposited together with at least 80% of the total iridium added in the preparation of the silver halide grains.

15. The method for forming a color image as claimed in claim 2, wherein said localized silver bromide phase is deposited together with the total iridium added in the preparation of the silver halide grains.

16. The method for forming a color image as claimed in claim 2, wherein said iridium compound is a water soluble iridium compound.

17. The method for forming a color image as claimed in claim 4, wherein said total amount of the coated silver is from 0.25 to 0.75 g/m$^2$.

18. The method for forming a color image as claimed in claim 1, wherein said at least one silver halide emulsion layer further contains a mercaptothiazole selected from the compounds represented by formulae (I), (II) and (III) in an amount of from $1\times10^{-5}$ to $5\times10^{-2}$ mol per mol of silver halide:

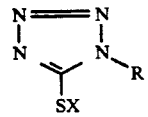

(I)

wherein R represents an alkyl group, alkenyl group or aryl group; X represents a hydrogen atom, an alkali metal atom, ammonium group or a precursor, which precursor is a group in which X becomes a hydrogen atom or an alkali metal under alkaline conditions:

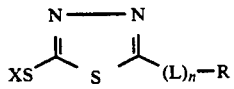

(II)

wherein L represents a bivalent linkage group, R represents a hydrogen atom, an alkyl group, an alkenyl group or an aryl group; X has the same meaning as in formula (I); and n represents 0 or 1:

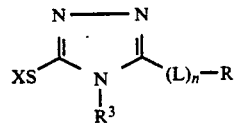

(III)

wherein R and X have the same meaning as in formula (I) and L and n have the same meaning as in formula (II); $R^3$ has the same meaning as R, and $R^3$ and R may be the same or different.

19. The method for forming a color image as claimed in claim 1, wherein said silver halide color photographic material contains a compound represented by formula (M-3):

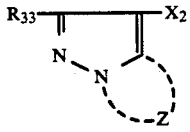

(M-3)

wherein $R_{33}$ represents a hydrogen atom; Z represents a non-metal atom group necessary for forming a 5-membered azole ring containing 2 to 4 nitrogen atoms, which azole ring may be substituted and may also form a condensed ring; and $X_2$ represents a hydrogen atom or a releasing group.

* * * * *